US009428901B2

(12) United States Patent
Price

(10) Patent No.: US 9,428,901 B2
(45) Date of Patent: Aug. 30, 2016

(54) MODULAR BUILDING SYSTEM

(71) Applicant: NEV-X SYSTEMS LIMITED, Auckland (NZ)

(72) Inventor: Neville Holmes Price, Kerikeri (NZ)

(73) Assignee: NEV-X SYSTEMS LIMITED, Auckland (NZ)

( * ) Notice: Subject to any disclaimer, the term of this patent is extended or adjusted under 35 U.S.C. 154(b) by 0 days.

(21) Appl. No.: 14/401,509

(22) PCT Filed: Apr. 30, 2013

(86) PCT No.: PCT/IB2013/053391

§ 371 (c)(1),
(2) Date: Nov. 14, 2014

(87) PCT Pub. No.: WO2013/171605

PCT Pub. Date: Nov. 21, 2013

(65) Prior Publication Data

US 2015/0135605 A1 May 21, 2015

(30) Foreign Application Priority Data

May 14, 2012 (NZ) ..... 599982

(51) Int. Cl.
*E04H 1/00* (2006.01)
*E04B 1/343* (2006.01)
(Continued)

(52) U.S. Cl.
CPC ..... *E04B 1/34321* (2013.01); *E02D 27/02* (2013.01); *E04B 1/34315* (2013.01);
(Continued)

(58) Field of Classification Search
CPC ..... E02D 27/02; E02D 2250/0023; E04B 2001/2684; E04B 1/04; E04B 2/8652; E04B 1/21; E04B 2/86; E04B 2002/0243; E04B 5/36; E04B 1/165; E04B 2005/322; E04B 1/34321; E04C 5/08; E04C 5/12; E04C 2/40
See application file for complete search history.

(56) References Cited

U.S. PATENT DOCUMENTS 1,397,976 A 11/1921 McAvoy et al.
3,621,624 A * 11/1971 Gustafson ..... 52/91.1
(Continued)

FOREIGN PATENT DOCUMENTS

DE 3215579 A1 10/1983
GB 1284268 A 8/1972
(Continued)

OTHER PUBLICATIONS

International Search Report and Written Opinion received for PCT Patent Application No. PCT/IB2013/053391, mailed on Oct. 8, 2013, 14 pages.
(Continued)

*Primary Examiner* — Brian Glessner
*Assistant Examiner* — Gisele Ford
(74) *Attorney, Agent, or Firm* — Morrison & Foerster LLP

(57) ABSTRACT

A building having a foundation and abutting wall panels seated on the foundation. Together they define at least one wall section, tied together by orthogonal tensioners. The tensioners include vertical tensioners located parallel and between adjacent wall panels and fixed to the foundation and at a respective anchor positioned at the top of the adjacent wall panel. These vertical tensioners allow a binding of the adjacent wall panel by said vertical tensioner onto the seat of the foundation. The tensioners also a horizontal tensioner extending between said anchors at each end of the wall section to allow a horizontal binding of wall panels of the wall section together.

14 Claims, 47 Drawing Sheets

(51) Int. Cl.

| | |
|---|---|
| ***E02D 27/02*** | (2006.01) |
| ***E04B 1/38*** | (2006.01) |
| ***E04B 5/04*** | (2006.01) |
| ***E04B 2/00*** | (2006.01) |
| ***E04G 9/00*** | (2006.01) |
| ***E04G 17/00*** | (2006.01) |
| ***E04B 1/61*** | (2006.01) |
| ***E04B 2/72*** | (2006.01) |
| ***E04B 9/04*** | (2006.01) |
| ***E04B 5/02*** | (2006.01) |
| *E04B 1/35* | (2006.01) |
| *E04C 2/00* | (2006.01) |

(52) U.S. Cl.

CPC ..... *E04B1/34384* (2013.01); *E04B 1/38* (2013.01); *E04B 1/61* (2013.01); *E04B 2/721* (2013.01); *E04B 5/04* (2013.01); *E04B 9/0435* (2013.01); *E04C 2/44* (2013.01); *E04C 2/46* (2013.01); *E04C 2/50* (2013.01); *E04G 9/00* (2013.01); *E04G 17/001* (2013.01); *E02D 2250/0007* (2013.01); *E02D 2250/0023* (2013.01); *E02D 2600/20* (2013.01); *E04B 2001/3583* (2013.01); *E04B 2001/6195* (2013.01); *E04C 2002/001* (2013.01)

(56) References Cited

U.S. PATENT DOCUMENTS

| | | | | |
|---|---|---|---|---|
| 4,294,051 | A * | 10/1981 | Hughes, Jr. | 52/98 |
| 4,569,167 | A | 2/1986 | Staples | |
| 4,584,805 | A | 4/1986 | Meiry | |
| 6,035,594 | A | 3/2000 | Leslie | |
| 6,098,357 | A | 8/2000 | Franklin et al. | |
| 6,105,326 | A * | 8/2000 | Schmidt-Lutz | 52/437 |
| 6,119,417 | A * | 9/2000 | Valverde et al. | 52/223.7 |
| 6,151,856 | A * | 11/2000 | Shimonohara | 52/426 |
| 6,223,487 | B1 * | 5/2001 | Dinkel | 52/285.1 |
| 6,256,960 | B1 * | 7/2001 | Babcock et al. | 52/592.1 |
| 6,260,320 | B1 * | 7/2001 | Di Lorenzo | 52/414 |
| 6,272,810 | B1 | 8/2001 | Ingram et al. | |
| 6,698,150 | B1 * | 3/2004 | DiLorenzo | 52/414 |
| 6,976,344 | B2 * | 12/2005 | Sanger | 52/741.1 |
| 7,121,061 | B2 * | 10/2006 | Jazzar | 52/745.13 |
| 8,567,153 | B1 * | 10/2013 | Francavilla | 52/741.13 |
| 8,919,057 | B1 * | 12/2014 | Dupray | 52/223.14 |
| 2002/0017068 | A1 * | 2/2002 | Monachino | 52/247 |
| 2002/0046521 | A1 * | 4/2002 | Steinacker, Sr. | 52/274 |
| 2002/0078659 | A1 * | 6/2002 | Hunt | 52/745.13 |
| 2004/0000114 | A1 | 1/2004 | Schools et al. | |
| 2004/0093824 | A1 * | 5/2004 | Huber et al. | 52/721.4 |
| 2005/0016083 | A1 * | 1/2005 | Morin et al. | 52/79.14 |
| 2005/0160695 | A1 * | 7/2005 | Sanchez | 52/583.1 |
| 2006/0137269 | A1 * | 6/2006 | Di Lorenzo | 52/250 |
| 2007/0094963 | A1 | 5/2007 | McDonald et al. | |
| 2007/0294969 | A1 * | 12/2007 | Kim et al. | 52/292 |
| 2008/0216445 | A1 * | 9/2008 | Langer | 52/745.09 |
| 2008/0282623 | A1 * | 11/2008 | Powell | 52/71 |
| 2010/0011699 | A1 * | 1/2010 | Weimer et al. | 52/745.1 |
| 2010/0162658 | A1 * | 7/2010 | Nagy et al. | 52/745.13 |
| 2011/0036966 | A1 * | 2/2011 | Benedict | 249/25 |
| 2011/0041449 | A1 * | 2/2011 | Espinosa | 52/698 |
| 2011/0047898 | A1 * | 3/2011 | Hudgins | 52/169.9 |
| 2011/0113707 | A1 * | 5/2011 | Stephens, Jr. | 52/220.2 |
| 2011/0232216 | A1 * | 9/2011 | Schroeder et al. | 52/223.8 |
| 2012/0005976 | A1 | 1/2012 | Leonard | |
| 2012/0047816 | A1 * | 3/2012 | Zhong | 52/11 |
| 2013/0174503 | A1 * | 7/2013 | Olson et al. | 52/223.6 |

FOREIGN PATENT DOCUMENTS

| | | | |
|---|---|---|---|
| GB | 1572278 | A | 7/1980 |
| WO | 98/03736 | A1 | 1/1998 |
| WO | 99/40275 | A1 | 8/1999 |
| WO | 2004/094739 | A2 | 11/2004 |
| WO | 2006/058391 | A1 | 6/2006 |
| WO | 2010/099354 | A2 | 9/2010 |
| WO | 2011/137496 | A9 | 11/2011 |

OTHER PUBLICATIONS

International Preliminary Report on Patentability received for PCT Patent Application No. PCT/IB2013/053391, mailed on Mar. 31, 2014, 5 pages.

* cited by examiner

MODULAR BUILDING SYSTEM

CROSS-REFERENCE TO RELATED APPLICATIONS

This is a U.S. National Phase patent application of PCT/IB2013/053391, filed Apr. 30, 2013, which claims the benefit of New Zealand Application no. NZ 599982, filed May 14, 2012, each of which is hereby incorporated by reference in the present disclosure in its entirety.

FIELD OF THE INVENTION

The present invention relates to building and building systems and related methods. In particular but not solely to systems for modular buildings that may be erected from prefabricated panels and components and constructed on site.

BACKGROUND

There are many construction systems for low to mid-rise structures that commonly use factory made component such as panels of concrete, wood or other framing materials. The panels are located with a structural frame, securing one panel to the other such as by bolts or nails to form part of a building or enclosure. These are commonly used in low cost housing through to industrial buildings.

Such buildings are invariably built on a conventional concrete slab that has been established using removable formwork, with anchors for anchoring the panels directly or indirectly to the slab. The anchors are either cast in during the pour, or post pour drilled and secured using epoxy.

One of the difficulties/expense in constructing of buildings is time and labour input. Where walls are to be secured to the slab, alignment of any pre-defined anchor points on the panels with the anchors presented at the slab can be difficult and requires skilled tradesmen.

Errors in the positioning of such components in the slab permit misalignment and the advantages of factory ensured accuracies are lost. As a result correction and reinstatement can be required and can be expensive and negate any advantages initially given by the modular panels.

In addition, reinstatement may be done in a manner that creates deviation from the plans. Inaccuracies at the foundation level can quickly translate into inaccuracies in many other aspects of the building. Sometimes compounding inaccuracies occur that require the fit-out work to be entirely custom rather than relying on kitset component to complete the building.

It is therefore an object of the present invention to provide a building, system and/or structure that offers at least some solution to overcome the abovementioned issues and/or to provide the industry with a useful choice.

SUMMARY OF THE INVENTION

In a first aspect the present invention may broadly be said to a building comprising a foundation and a plurality of upstanding juxtaposed wall panels together defining at least one wall section of said building seated on said foundation and tied together by orthogonal tensioners comprising;

a. at each end of the wall section, a vertical tensioner located parallel an adjacent wall panel and fixed by and extending between the foundation and a respective anchor positioned to act at or near the top of the adjacent wall panel to allow a binding of the adjacent wall panel by said vertical tensioner onto the seat of the foundation, b. a horizontal tensioner extending between said anchors at each end of the wall section to allow a horizontal binding of wall panels of the wall section together.

Preferably intermediate of and parallel with adjacent wall panels of said wall section is an intermediate vertical tensioner that is fixed by and extends between the foundation and a respective mid wall anchor positioned to act at or near the top of the two adjacent wall panels to allow binding of the two adjacent wall panels by said vertical tensioner onto the seat of the foundation.

Preferably said horizontal tensioner extends from and acts directly on the anchor at one end of the wall section to the anchor at the other end of the wall section to bind all wall panels in the wall section horizontally together.

Preferably the horizontal tensioner does not act on the intermediate vertical anchor.

Preferably the mid wall anchor is positioned on top of two adjacent wall panels.

Preferably each vertical tensioner extends from the foundation to a respective anchor.

Preferably the intermediate tensioner extends from the foundation to a respective anchor.

Preferably each anchor is keyed or registered to the wall panel(s) at which it is located in a manner to hold it in place against the force(s) applied to it by one of more tensioners.

Preferably a said anchor is integrally formed with a wall panel.

Preferably the vertical tensioner(s) is/are located in a slot (preferably along the entire of and) at the side edge of an adjacent wall panel.

Preferably each tensioner is a variable operative length tensioner.

Preferably each tensioner comprised a rod having a threaded section at which the tensioner can vary its operative length.

Preferably building is self shoring, the wall panels shoring themselves with each other and with the foundation as a result of the tension established by the tensioners.

Preferably each anchor is located at or near the upper edge of the wall panels.

Preferably the tensioners at a wall section are coplanar the wall section.

Preferably tensioners extend adjacent all sides of each wall panel save for the side at which each wall panel is seated to the foundation.

Preferably the horizontal tensioners act only on anchors at the ends of the wall section to bind all wall panels of that section together.

Preferably the tensioners are adjustable tensioners.

Preferably a lateral wall section extends from said first mentioned wall section, said lateral wall section comprising of a wall panel located contiguous the end wall panel of the first mentioned wall section, the vertical tensioner at the end of the first mentioned wall section located therebetween, its respective anchor located also at the wall panel or the lateral wall section.

Preferably a lateral wall section horizontal tensioner extends from said respective anchor to a further anchor, the lateral wall section horizontal tensioner and the first mentioned horizontal tensioners able to cooperate together to bind the lateral wall section and the first mentioned wall section together.

Preferably a ceiling or roof comprising of a row of contiguous cover panels is at least partially supported by and at the top of the wall panels.

Preferably the mid wall anchor(s) anchor cover panel tensioners and extend between adjacent cover panels.

Preferably cover panel tensioners extend between adjacent cover panels from a mid wall anchor on one wall section to another anchor.

Preferably the other anchor is to a mid wall anchor on an opposed wall section.

Preferably the cover panels are quadrilateral in shape.

Preferably at least two opposed sides of each cover panel include a slot or rebate at where the cover panel tensioner is located.

Preferably there are two contiguous rows of cover panels.

Preferably the cover panels slope to define a sloping roof of said building.

Preferably the cover panels are horizontal and define a sloping roof or ceiling/floor of said building.

Preferably the cover panels are horizontal and a lateral tensioner extends between the two rows of horizontal panels, that is anchored at a mid wall anchor located at the top of a wall section aligned therewith.

Preferably the lateral tensioner extends at 90 degrees to the first mentioned cover tensioner.

Preferably the cover panels tessellate together.

Preferably the cover panel tensioners are rods. Preferably such are as herein described with reference to the vertical tensioners.

Preferably the mid wall anchor is keyed to the wall panel to prevent it from moving parallel to the normal of the wall panel.

Preferably at least two of the wall panels are identical.

Preferably the wall panels are prefabricated.

Preferably said building that has a second storey located above the wall panels, the second storey comprising of a plurality of second storey wall panels supported above the first mentioned wall panels.

Preferably said second storey comprise a plurality of upstanding juxtaposed second storey wall panels together defining at least one second storey wall section of said building wherein at each end of the second storey wall section, a second storey vertical tensioner is located parallel an adjacent second storey wall panel and fixed by and extending between the anchor of the and a respective second storey anchor positioned to act at or near the top of the adjacent second storey wall panel.

Preferably a second storey horizontal tensioner extends between said second storey anchors at each end of the second storey wall section to allow a horizontal binding of second storey wall panels of the second storey wall section together.

Preferably intermediate of and parallel with adjacent second storey wall panels of said second storey wall section is an intermediate vertical tensioner that is fixed by and extends between the anchor and a respective mid wall second storey anchor positioned to act at or near the top of the two adjacent second storey wall panels.

Preferably said second storey horizontal tensioner extends from and acts directly on the second storey anchor at one end of the second storey wall section to the anchor at the other end of the second storey wall section to bind all second storey wall panels in the second storey wall section horizontally together.

Preferably beams span between opposing wall sections of the building at or near the upper edges of the walls.

Preferably tensioners extend along the top of the beams between said separated parts.

Preferably the wall sections are planar wall sections.

Preferably said foundation compromises footing at which said wall panels are seated.

Preferably said footing is assembled on site from a plurality of prefabricated footers rigidly connected together and supported by ground below.

Preferably said footing defines a seat for said wall panels to register.

Preferably said footers are located at least at the perimeter of the footprint of the building to be erected on the foundation.

Preferably the footers are located at least at the perimeter for supporting said wall panels that define at least part of the envelope of the building.

Preferably said seat is elevated above the ground by which said foundation is supported.

Preferably said prefabricated footers are supported on the ground below.

Preferably said footers are connected together by connectors that create a rigid connection between adjacent footers.

Preferably said footing comprises said connectors.

Preferably said connectors locate intermediate of said footers and each connect to at least two said footers.

Preferably said connectors are adapted and configured to allow a sliding engagement therewith by adjacent footers.

Preferably the connectors effect a dovetail connection between adjacent footers.

Preferably the footing includes adjustable ground engageable props.

Preferably the ground engageable props can be adjusted to help level and prop up the footing from uneven ground below. The propping may be only until such time as poured concrete has set and then assumes the propping function for the footing or part of the footing.

Preferably the props include feet connected to said footing.

Preferably said props are threadingly adjustable.

Preferably said connectors may form part of the footing of the foundation.

Preferably said connectors are carried by or integrally formed with the footers or a combination of such.

Preferably the connectors effect a rigid connection between footers to create a footing that is resistant to being deformed.

Preferably foundation comprises a filler.

Preferably the filler includes a cementitious material.

Preferably the filler is poured concrete.

Preferably the footing defines formwork for the pour and remains in place during and after the pour.

Preferably the footing is amalgamated by and with the filler.

Preferably the poured concrete embeds some of the footing therein to amalgamate the footing to the concrete once set.

Preferably the filler material is located between the seat of the footing and the ground below.

Preferably the filler material is located against the footing to support wall loading on the seat of the footing from the ground below.

Preferably the footers provide said seat at a location above the ground below, part of said footer supported on said filler located between the seat and the ground below.

Preferably the footers have at least one undercut or rebate or ledge or aperture below said seat, the filler material vertically supporting said footers thereat.

Preferably the undercut allows for weight being borne on the footing to be largely transferred to the filler material.

Preferably the foundation may also comprise of a gap filler embedded in the filler.

Preferably the foundation may also comprise of a foam insert located in the filler. This may be supported on the ground below and under the filler. The foam insert may increase thermal insulation for the building.

Preferably the footers function as formwork during the pouring and setting of the poured concrete.

Preferably the filler defines a floor pad.

Preferably the top of the footers are coplanar and the filler is level with the top of the footers.

Preferably the top of the footers are coplanar and defines a screed guide for the poured filler material to screed the filler material flush with the top of the footers.

Preferably the floor pad is the internal floor pad of the building.

Preferably the footing remains in-situe.

Preferably the foundation presents a plurality of fixtures at which the vertical tensioners secure.

Preferably the footing presents a plurality of fixtures for securing said vertical tensioners.

Preferably the fixtures are spaced apart from each other at predefined locations.

Preferably the fixtures are spaced apart from each other at predefined locations by virtue of the footers being pre fabricated.

Preferably the fixtures are spaced apart from each other at equispaced locations.

Preferably the fixtures are located at the seat of the footing.

Preferably each fixture allows a threaded engagement therewith by said tensioner.

Preferably the footing secures tensioners for binding the wall panels at the seat with the footing.

Preferably a plurality of footers have such a tensioner located. These may be pre-located to the footer prior to their assembly on site or post located.

Preferably the fixtures are embedded at least partially in said filler.

Preferably the foundation defines the ground floor to the building.

Preferably the footers extend orthogonal to each other.

Preferably the footing allows a plurality of wall panels to be registered in a manner to define an at least partial envelope to the building.

Preferably the footers are shaped and adapted to allow and interlocking together with a plurality of wall panels.

Preferably the interface between the footers and wall panels is an at least partial nesting of the panel with the formwork.

Preferably the interface is waterproof.

Preferably the interface is waterproof by the inclusion of a seal or foam filler.

Preferably the interface is waterproof by the inclusion of a lapped relationship between the wall panel and the footing.

Preferably the foundation defines a seat, the seat includes a lip laterally against which a wall panel can register and a lower surface on top of which a wall panel can register.

Preferably the lower surface is outward of the building more than the lip.

Preferably the footer defines the seat. Preferably the top edge of the footing is proximate more the lip than the lower surface.

Preferably the lower surface includes a region that is downwardly sloping towards the lip.

Preferably a wall panel can locate on top of the sloping region to be biased under its own weigh and any clamping more down and laterally towards the lip.

Preferably the seat is in a channel formation.

Preferably the footing presents major forming faces facing each other to define a void to receive a pourable settable filler material.

Preferably the footing defines a perimeter to contain the poured filler material.

Preferably the footing defines a perimeter that encases the poured filler material.

Preferably the foundation may sit above or be set in the ground on which the building is to be located.

Preferably the footers are external footers to define the perimeter of the foundation and are connected to internal footers connected extending across the foundation.

Preferably the internal footers brace the external footers.

Preferably the internal footers brace the external footers until the poured concrete has set.

Preferably the internal footers include several aspects of the external footers as is herein described.

Preferably the internal footers define a seat for wall panels to register.

Preferably the seat is defined at a channel of the internal footer.

Preferably the wall panel can register by way of an at least partial nesting at the channel.

Preferably the interface between the wall and the internal footer may be such as to define a channel there between.

Preferably the channel can allow for utilities to be run there through.

Preferably below the seat of the internal footer is a conduit to allow for utilities to be run through.

Preferably the footers comprise of at least one elongate member to generally extend horizontally.

Preferably said elongate member is taller than it is wide.

Preferably two said elongate members are provided each extending at an acute or obtuse angle to the other.

Preferably the angle is 90 degrees.

Preferably two said elongate members are provided integrally formed with each other and each extending at an acute or obtuse angle to the other.

Preferably said footer is provided at a corner of the foundation.

Preferably said two members are coplanar each other.

Preferably the footing is supported by ground below and wherein at least some footers are so supported via at least one intermediate member.

Preferably said intermediate member includes a post.

Preferably said intermediate member includes a bearer.

Preferably the foundation is supported on un even ground.

Preferably the foundation is supported on sloping ground.

Preferably said foundation comprises of formwork that co-operates with the ground on which it is supported to define a cavity for receiving a concrete pour, said formwork remaining in-situ after said pour.

Preferably the formwork is footing adapted and configured to seat said wall panels.

Preferably the footing is as herein described.

Preferably the footing comprises of a plurality of interconnecting footers that can define an enclosure for the concrete pour.

Preferably the footers include registration surfaces to allow the registration of a wall or wall panels to be supported on said formwork.

Preferably the footers are of a kind as herein described.

Preferably the formwork includes fixtures to allow vertical tensioners to threadingly engage.

In a further aspect the present in invention may be said to be a footer to define footing of said foundation of the building or building systems or building structure as herein described, the footer being prefabricated and able to connect with like footers at the building site for creating said foundation.

Preferably the footer is able to connect with like footers to create a rigid footing and define formwork to receive a pour of settable material.

Preferably the footer comprises a first elongate section and a second elongate section extending from the first at an angle thereto.

Preferably the first and second sections are integrally formed.

Preferably a fixture is located in a location thereof that, once the footer is connected with like footers, creates a series of fixtures.

Preferably the adjacent fixtures of the series are regularly spaced (preferably equispaced) from each other.

Preferably adjacent fixtures are positioned so as to be spaced from each other once the footing is completed at wall panel width distances apart.

Preferably each wall panel bear onto said footing only.

Preferably the footing is made from interconnectable footers that are prefabricated.

In a further aspect the present invention may be said to be a modular building structure comprising:

(a) a foundation (b) a plurality of abutting transverse wall sections, each wall section comprising of a linear array of adjacent abutting wall panels, each seated at a seat on the foundation, (c) a plurality of vertical tensioners upwardly extending from the foundation to a wall anchoring location allowing them to compress the wall panels against the foundation to bind them onto the foundation at their seat, (d) extending at the top of each wall section and parallel thereto, a horizontal tensioner terminating with a like located horizontal tensioner of an abutting wall section at an anchor to together bind said abutting wall sections together and bind the wall panels of their respective wall sections together.

Preferably said horizontal tensioner and like horizontal tensioner are secured at the opposite ends of their respective wall sections to where they terminate at the anchor.

In yet a further aspect the present invention may be said to be a modular building structure comprising:

(a) a foundation comprising of footing assembled on site from prefabricated footers each connected together, (b) a plurality of abutting wall panels creating wall sections of the building, each wall panel supported on the footing, (c) a plurality of elongate vertical wall tensioners each located between and parallel to two adjacent wall panels and secured at (a) one end by the footing (preferably by a footer) and (b) at an anchoring location to the two adjacent panels, to allow each wall tensioner to clamp two adjacent panels from above onto the footing, (d) extending parallel to and at the top of at least two adjacent said panels of each wall section, an elongate horizontal tensioner to bind the two adjacent panels together at where they abut, a said vertical and horizontal tensioner connected (directly or indirectly) at said anchoring location, (e) a roof or ceiling connected secured above the plurality of panels.

Preferably the plurality of abutting wall panels create wall sections of the envelope of the building.

Preferably the horizontal wall tensioner is anchored at each end thereof.

Preferably a wall section of abutting wall panels abuts with a lateral thereto like wall sections of the building.

Preferably each wall section comprises of a linear array of abutting wall panels, there being a said elongate vertical wall tensioner intermediate of the contiguous wall panels of abutting wall sections.

Preferably each wall section comprises of a linear array of abutting wall panels, there being a said elongate vertical tensioner between abutting wall panels of the array.

Preferably said elongate vertical wall tensioners are located between and parallel to two adjacent wall panels of laterally disposed abutting wall sections and are each secured to an anchor at a respective said anchoring location.

Preferably said anchor secured a said vertical tensioner.

Preferably the elongate horizontal tensioner at each wall section extends at the top of all abutting wall panels of the wall section and is anchored at each end of the wall section.

Preferably the anchor is located atop of said adjacent panels.

Preferably said horizontal tensioner of each said abutting wall section is secured to a said anchor.

Preferably a plurality of vertical tensioners are connected to the footing.

Preferably the plurality of vertical tensioners are fastened to the footing.

Preferably the plurality of vertical tensioners are each fastened to the footing at a fixture.

Preferably the fixture is embedded in a footing.

Preferably the fixture presents a threaded portion to which a vertical tensioner can threadingly engage.

Preferably the threaded portion of the fixture is a threaded stud or a threaded aperture (blind or otherwise).

Preferably the vertical and horizontal tensioners are connected together by an anchor.

Preferably the anchor can key with the wall panels at which it is to be located.

Preferably the anchor presents securing locations for the tensioners to present therefrom at 90 or 180 degrees to each other.

Preferably each tensioner has a threaded section to locate through an aperture of the anchor and a threaded members (e.g. a nut) can engage thereat, to change the operative length of the tensioner.

Preferably each panel has two parallel vertical edges and a said vertical tensioner is located at each said edge.

Preferably each panel has two parallel horizontal edges, and a horizontal tensioner is located at the top edge of said two parallel horizontal edges.

Preferably the tensioners are able to be tensioned by reacting against the anchors as a result of a changing of their operative length.

Preferably such tensioning is by use of threaded couplings or connections.

Preferably the roof or ceiling is secured to the vertical tensioners.

Preferably said prefabricated footers have been connected with like footers at the building site for creating said foundation.

Preferably the footer is able to connect with like footers to create a rigid footing and define formwork to receive a pour of settable material.

Preferably the footers are bound together by a settable material.

Preferably the settable material is located at least partially below at least part of the footers and above ground there below.

Preferably the footer comprises a first elongate section and a second elongate section extending from the first at an angle thereto.

Preferably the first and second sections are integrally formed.

Preferably a series of fixtures are located by said footing.

Preferably the adjacent fixtures of the series are regularly spaced (preferably equispaced) from each other.

Preferably adjacent fixtures are positioned so as to be spaced from each other once the footing is completed at wall panel width distances apart.

Preferably each wall panel bear onto said footing only.

Preferably the footing is made from interconnectable footers that are prefabricated.

In a further aspect the present invention may be said to be a method of forming a modular building comprising:

(a) preparing a ground site for said building, (b) establishing a foundation on said ground site, said foundation presenting a plurality of fixtures for receiving tensioners, (c) attaching a plurality of exterior wall panels to said foundation to form the walls of said building, (d) attaching a plurality of interior wall panels to said foundation to form rooms in said building, (e) attaching one end of each tensioner to a respective fixture, (f) attaching the other end of each tensioner to a bracket at or near the end of each wall panel distal the foundation, and (g) securing a roof above.

Preferably step (b) comprises placing formwork (preferably of a kind as herein described and preferably of a kind as herein described as footers) on the prepared ground site to define a cavity to receive a concrete pour.

Preferably the method includes pouring concrete into said cavity allowing the concrete to cure to thereby bind the formwork together.

Preferably horizontal tensioners are connected to the bracket at or near the end of each wall panel.

Preferably the tensioners are tensioned once connected.

Preferably the tensioners are tensioned once connected to shore up the structure so formed.

In yet a further aspect the present invention may be said to be a modular building system to create a building at a building site, said system comprising;

a. prefabricated footers to be rigidly connected together to define a footing on site to create a building foundation supported by ground below, and b. a plurality of prefabricated wall panels be supported on said footers.

Preferably said footers define a seat for wall panels to register.

Preferably said footers are to be located at least at the perimeter of the footprint of the building to be erected.

Preferably the footers are located at least at the perimeter for supporting wall panels that define at least part of the envelope of the building.

Preferably said seat is provided at a location to be elevated above the ground by which said foundation is to supported.

Preferably said prefabricated footers are in use, capable of being supported on the ground below.

Preferably said footers are connected together by connectors that create a rigid connection between adjacent footers.

Preferably said footing comprises said connectors.

Preferably said connectors locate intermediate of said footers and each connect to at least two said footers.

Preferably said connectors are adapted and configured to allow a sliding engagement therewith by adjacent footers.

Preferably said connectors may form part of the footing of the foundation.

Preferably said connectors are carried by or integrally formed with the footers or a combination of such.

Preferably the connectors effect a rigid connection between footers to create a footing that is resistant to being deformed.

Preferably said footers are adapted and configured to act as formwork for a filler.

Preferably the footers are adapted to become amalgamated by and with the filler.

Preferably said fillers is a settable poured material and said footers are adapted and configured to be amalgamated by and with the settable material once set.

Preferably the footers provide said seat to be at a location above the ground below, part of said footer adapted and configured to allow poured concrete to run under a supporting surface of said footer to become located on top of said poured concrete located between the seat and the ground below.

Preferably the footers have at least one undercut or rebate or ledge or aperture below said seat, to allow poured concrete to locate there under for vertically supporting said footers thereat.

Preferably the top of the footers are able to be assembled to be coplanar and define a screed guide for poured filler material to locate adjacent, to screed the filler material flush with the top of the footers.

Preferably the footers remains in-situe over the life of the building to be erected.

Preferably said footers can locate (and preferably carry) at least one fixtures for binding the wall panels at to the footers.

Preferably at least one footer presents at least one fixture that can receive tensioners for binding wall panels to the footer.

Preferably at least one footer carries at least one tensioner for binding the wall panels to the footer.

Preferably the fixtures are provided by a or each said footer so as to become spaced apart from each other at predefined locations.

Preferably the fixtures are spaced apart from each other at predefined locations by virtue of the footers being pre fabricated.

Preferably the fixtures are spaced apart from each other at equispaced locations.

Preferably the fixtures are located at the seat of the footer.

Preferably each fixture allows a threaded engagement therewith by said tensioner.

Preferably the footer secures tensioners for binding the wall panels at the seat with the footers.

Preferably each footer has such a tensioner located. These may be pre-located to the footer prior to their assembly on site or post located.

Preferably the fixtures are embedded at least partially in said filler.

Preferably the footers allows a plurality of wall panels to be registered therewith in a manner to define an at least partial envelope to the building.

Preferably the footers are shaped and adapted to allow and interlocking together said wall panels.

Preferably the interface between the footers and wall panels is an at least partial nesting of the panel with the formwork.

Preferably the seat includes a lip laterally against which a wall panel can register and a lower surface on top of which a wall panel can register.

Preferably the lower surface is outward of the building more than the lip.

Preferably the top edge of the footing is proximate more the lip than the lower surface.

Preferably lower surface includes a region that is downwardly sloping towards the lip.

Preferably a wall panel can locate on top of the sloping region to be biased under its own weigh and any clamping more down and laterally towards the lip.

Preferably the seat is in a channel formation.

Preferably the footers, once connected present major forming faces facing each other to define a void to receive a pourable settable filler material.

Preferably the footers once connected define a perimeter to contain the poured filler material.

Preferably the footers are external footers to define the perimeter of the foundation and are to be connected to internal footers connected extending across the foundation.

Preferably the internal footers brace the external footers.

Preferably the internal footers brace the external footers until the poured concrete has set.

Preferably the internal footers include several aspects of the external footers as is herein described.

Preferably the internal footers define a seat for wall panels to register.

Preferably the seat is defined at a channel of the internal footer.

Preferably the wall panel can register by way of an at least partial nesting at the channel.

Preferably the interface between the wall and the internal footer may be such as to define a channel there between.

Preferably the channel can allow for utilities to be run there through.

Preferably below the seat of the internal footer is a conduit to allow for utilities to be run through.

Preferably the footers comprise of at least one elongate member to generally extend horizontally.

Preferably said elongate member is taller than it is wide.

Preferably two said elongate members are provided each extending at an acute or obtuse angle to the other.

Preferably the angle is 90 degrees.

Preferably said two said elongate members are provided integrally formed with each other and each extending at an acute or obtuse angle to the other.

Preferably said footer is provided at a corner of the foundation.

Preferably said two members are coplanar each other.

Preferably said footers are to be supported by ground below and wherein at least some footers are to be so supported via at least one intermediate member.

Preferably said system includes said intermediate member and may be a post.

Preferably said intermediate member includes a bearer.

Preferably the foundation is supported on un even ground.

Preferably the foundation is supported on sloping ground.

In yet a further aspect the present invention may be said to be a kit for a modular building:

a. a foundation of or for a building comprising formwork that co-operates with the ground on which it is supported to define a cavity for receiving a concrete pour, said formwork remaining in-situ after said pour b. wall panels to be supported on said formwork.

Preferably the formwork is footing adapted and configured to support said wall panels to be located on top.

Preferably the footing comprises of a plurality of footers adapted and configured to be interconnected to define an enclosure for the concrete pour.

Preferably the footers include registration surfaces to allow the registration of a wall or wall panels to be supported on said formwork.

Preferably the footers are of a kind as herein described.

Preferably the formwork includes fixtures to allow vertical tensioners to threadingly engage.

In yet a further aspect the present invention may be said to be an anchor for securing a vertical tensioner at the top of a wall of a building or building structure or building system as herein defined.

Preferably the anchor is also capable of also securing a vertical tensioner of a second storey of the building to be located above.

Preferably the anchor is also capable of securing a horizontal tensioners to extend between cover panels (roof or ceiling panels) to be supported at the top of said wall panels.

Preferably the foundation may be created by a modular foundation system comprising a plurality of prefabricated footers to be supported by ground each capable of being connected together to define a rigid footing, said footers each presenting interfaces for receipt of wall panels of said building thereat, the footing also presenting fixtures for securing the said wall panels to said foundation.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification that include that term, the features, prefaced by that term in each statement, all need to be present but other features can also be present. Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

The invention will now be described by way of example only and with reference to the following drawings of a scale model designed and built to demonstrate the assembly process.

FIG. 8 shows a close up view of a corner footer showing a corner fixture and vertical tensioner extending there from.

FIG. 9 shows a close up view of a divider fixture on the footing with a vertical tensioner extending there from.

Figure 20:
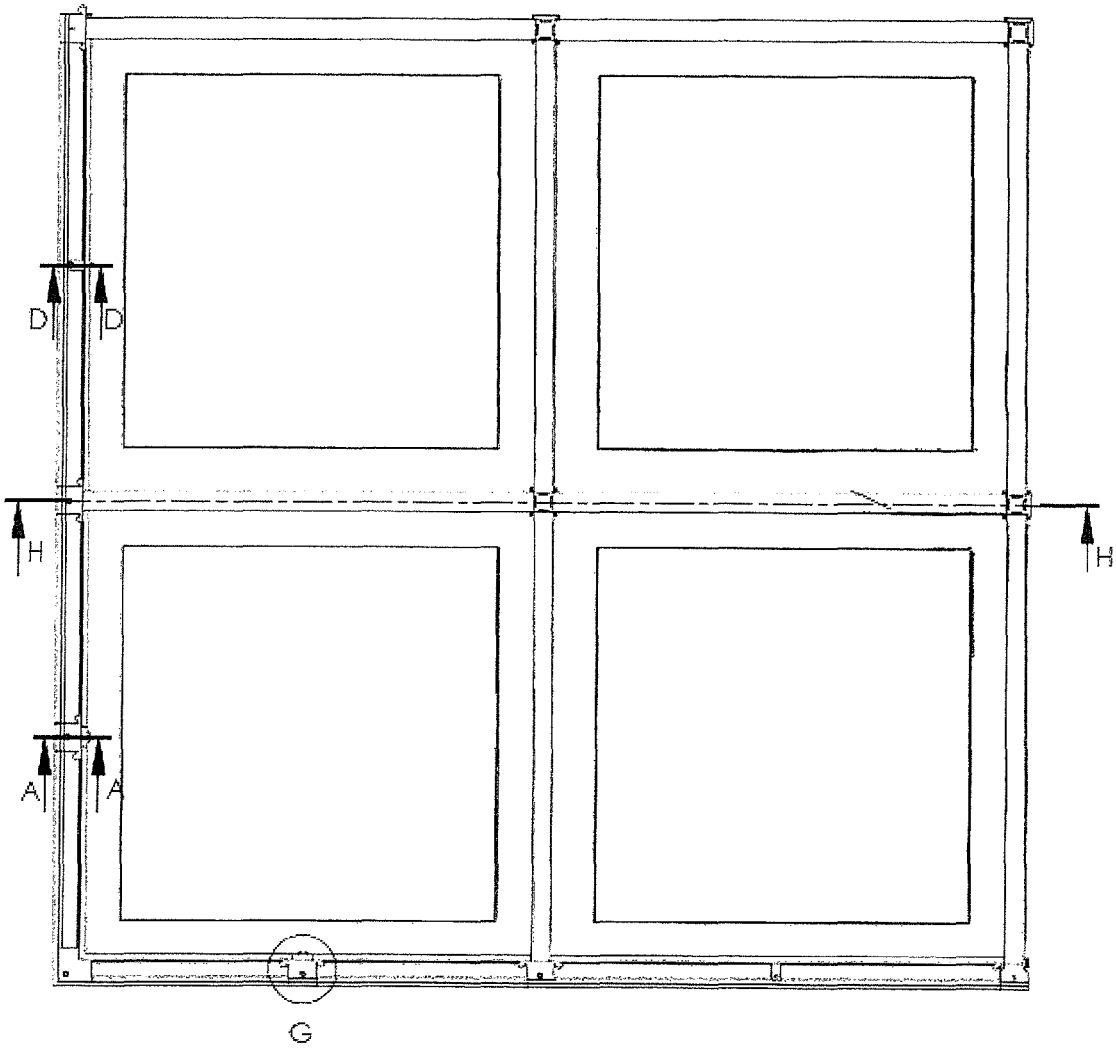

The following figures describe some variations to some of that shown in the figures above and in which:

FIG. 20 is a plan view of a foundation showing 4 cells adjacent each other.

Figure 21:
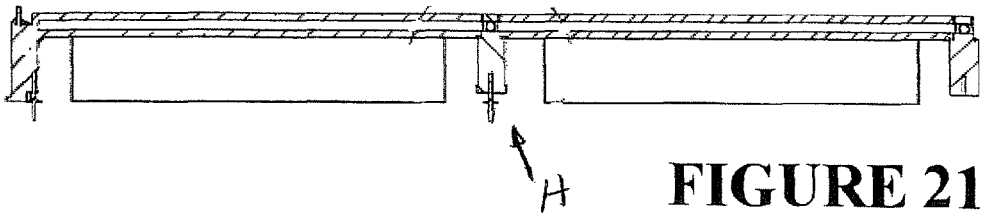

FIG. 21 is a sectional view of detail H of FIG. 20.

Figure 22:
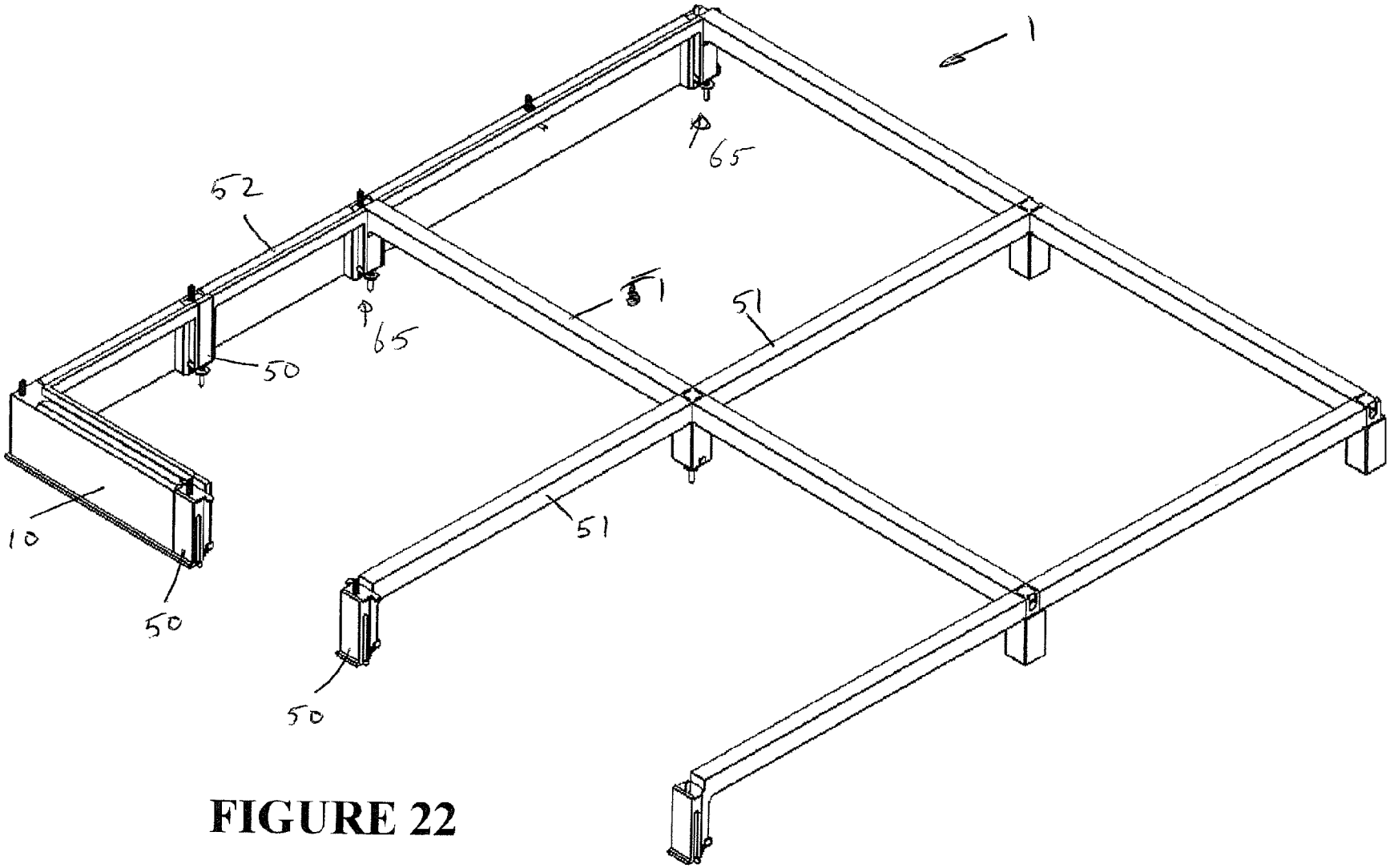

FIG. 22 is a perspective view of a partially assembled footing.

Figure 23:
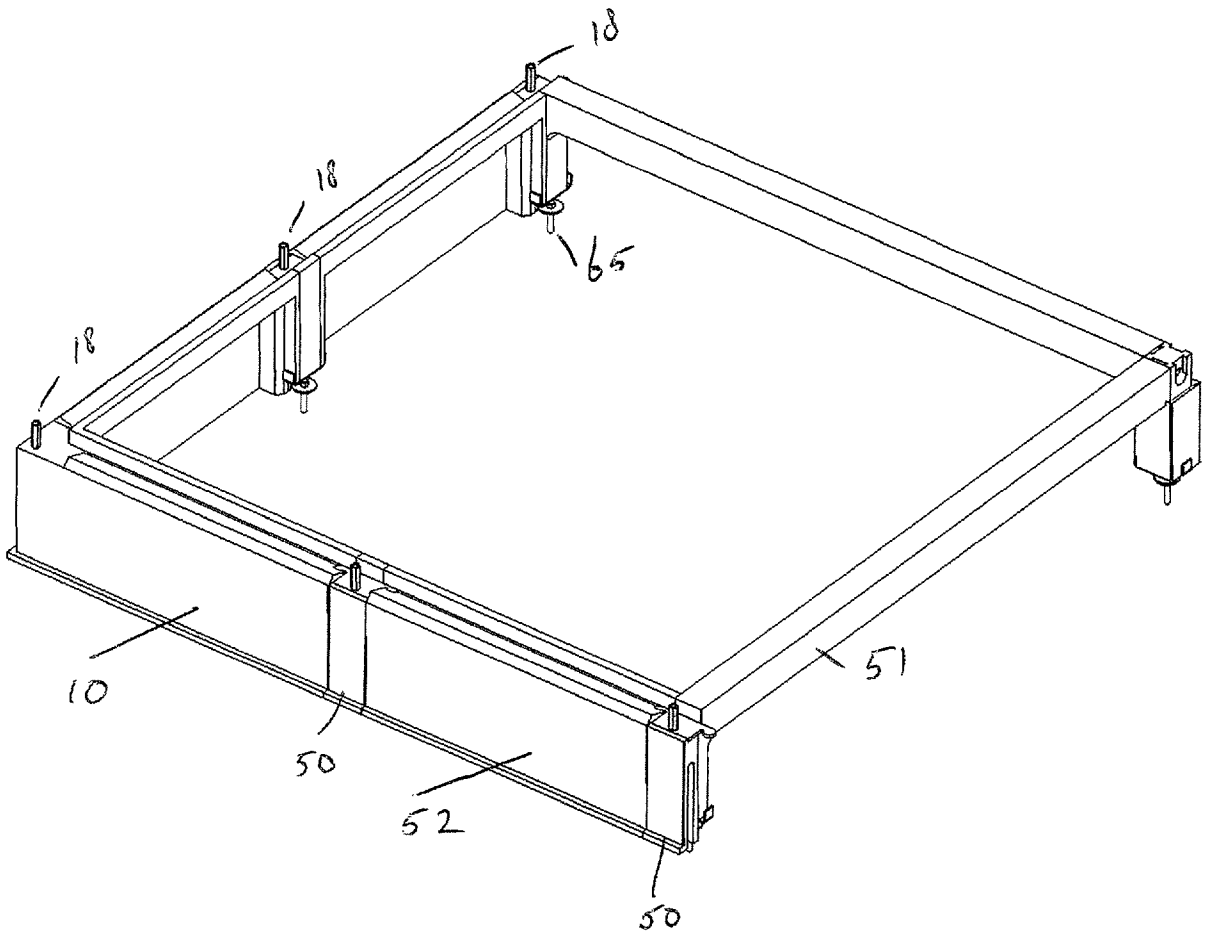

FIG. 23 is a perspective view of a partially assembled footing.

Figure 24B:
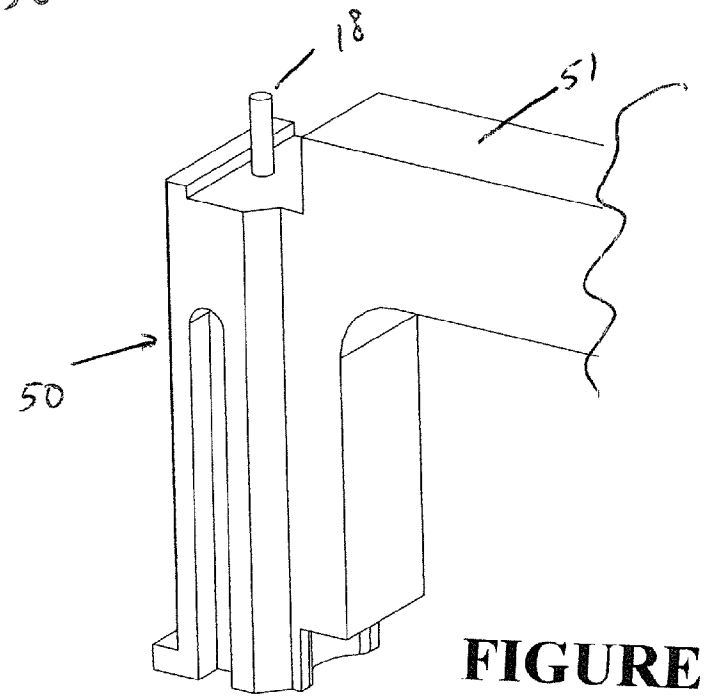
Figure 24A:
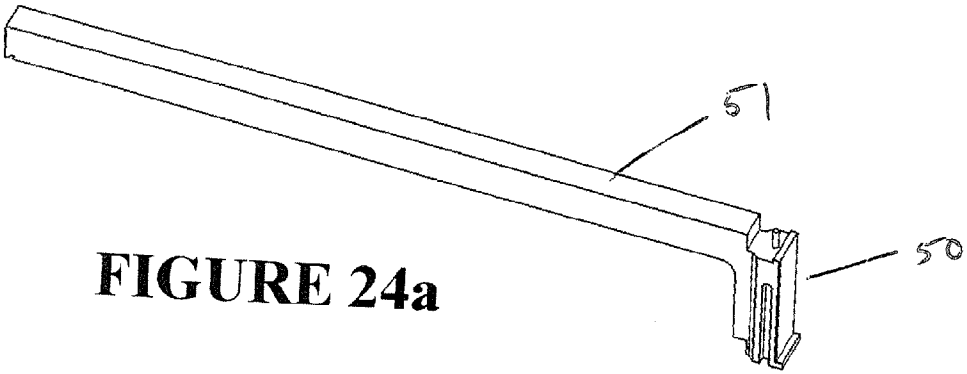

FIG. 24*a* is a perspective view of an internal footer that may be used.

FIG. 24*b* is an alternative perspective view of an internal footer that may be used.

Figure 25:
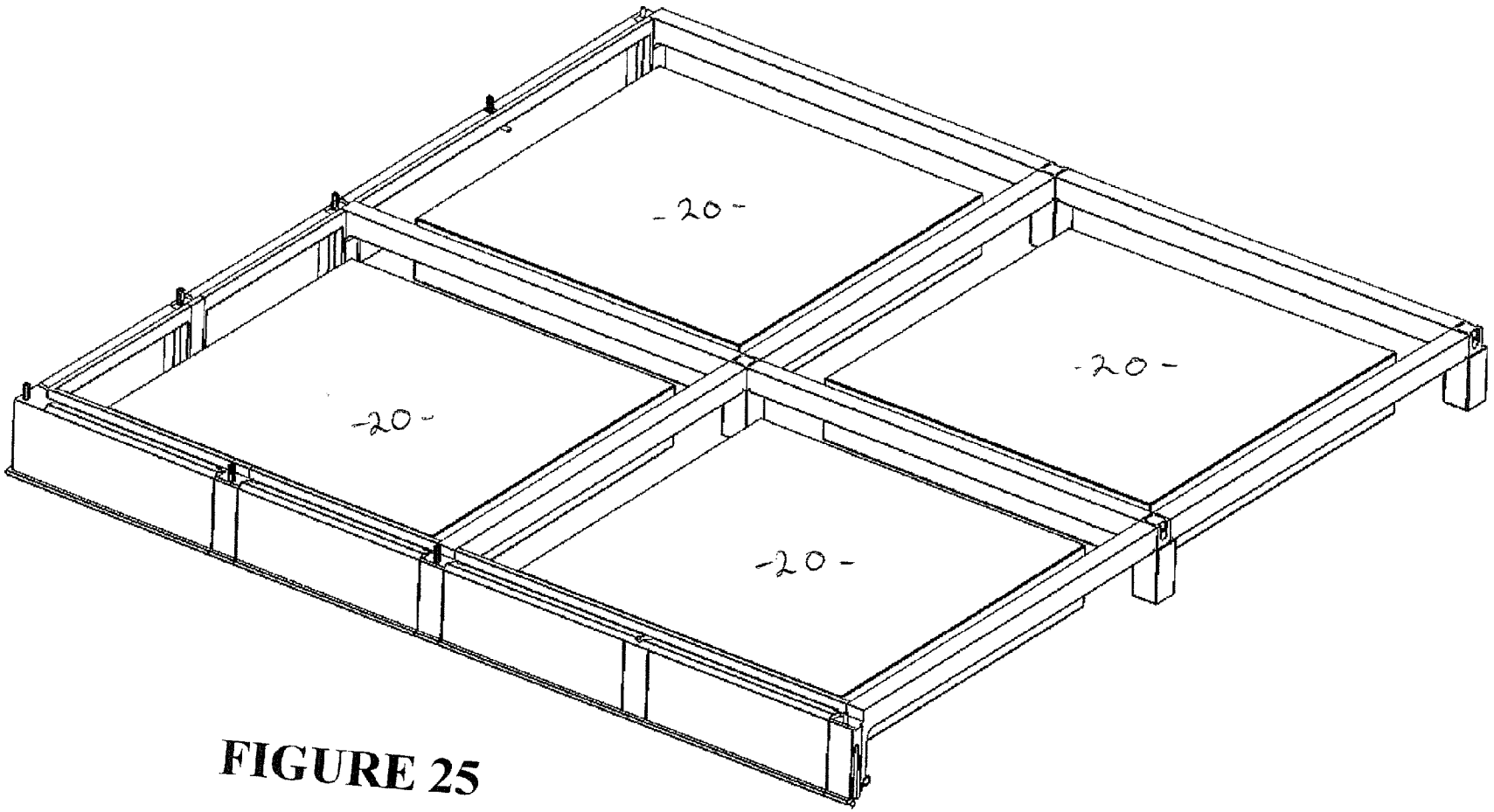

FIG. 25 is a perspective view of a partially assembled footing with foam pods located in each cell.

Figure 26A:
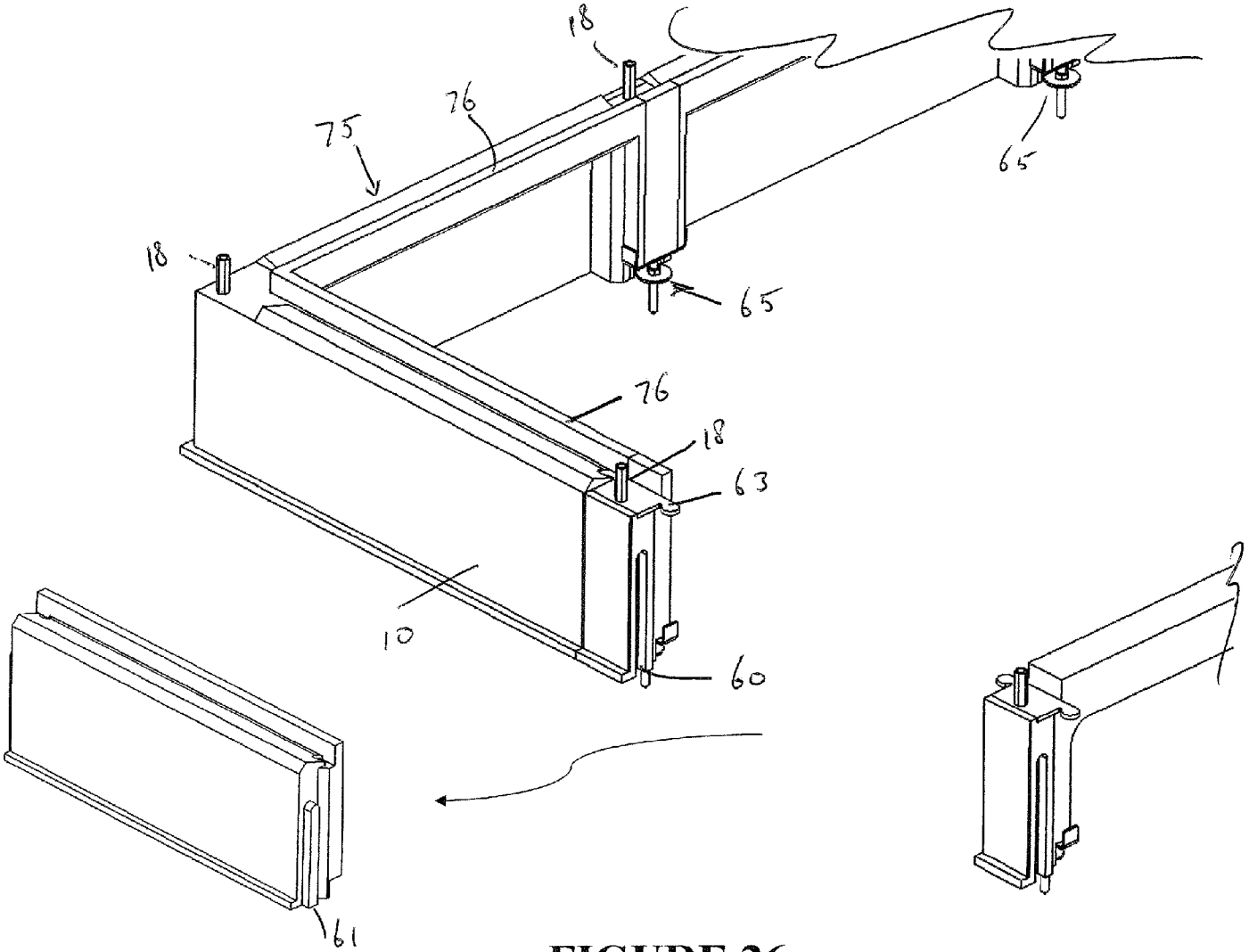

FIG. 26*a* is a perspective view of a partially assembled footing with a footer being removed to help show the modularity and connectivity between components of the footing.

Figure 26B:
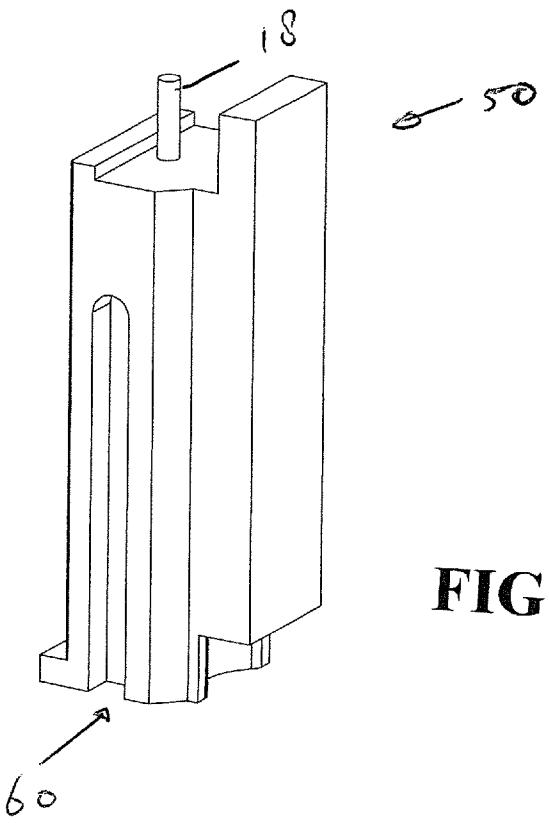

FIG. 26*b* is a perspective view of a footing connector.

Figure 26C:
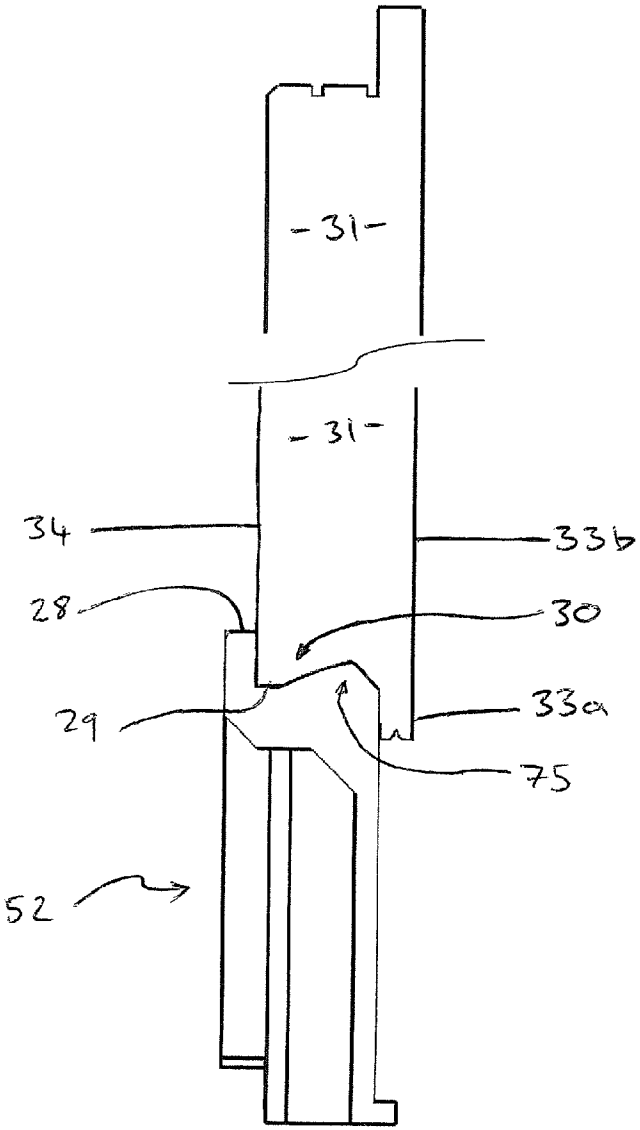

FIG. 26*c* is a side cross section view of a showing the lower wall and footer interaction.

Figure 27:
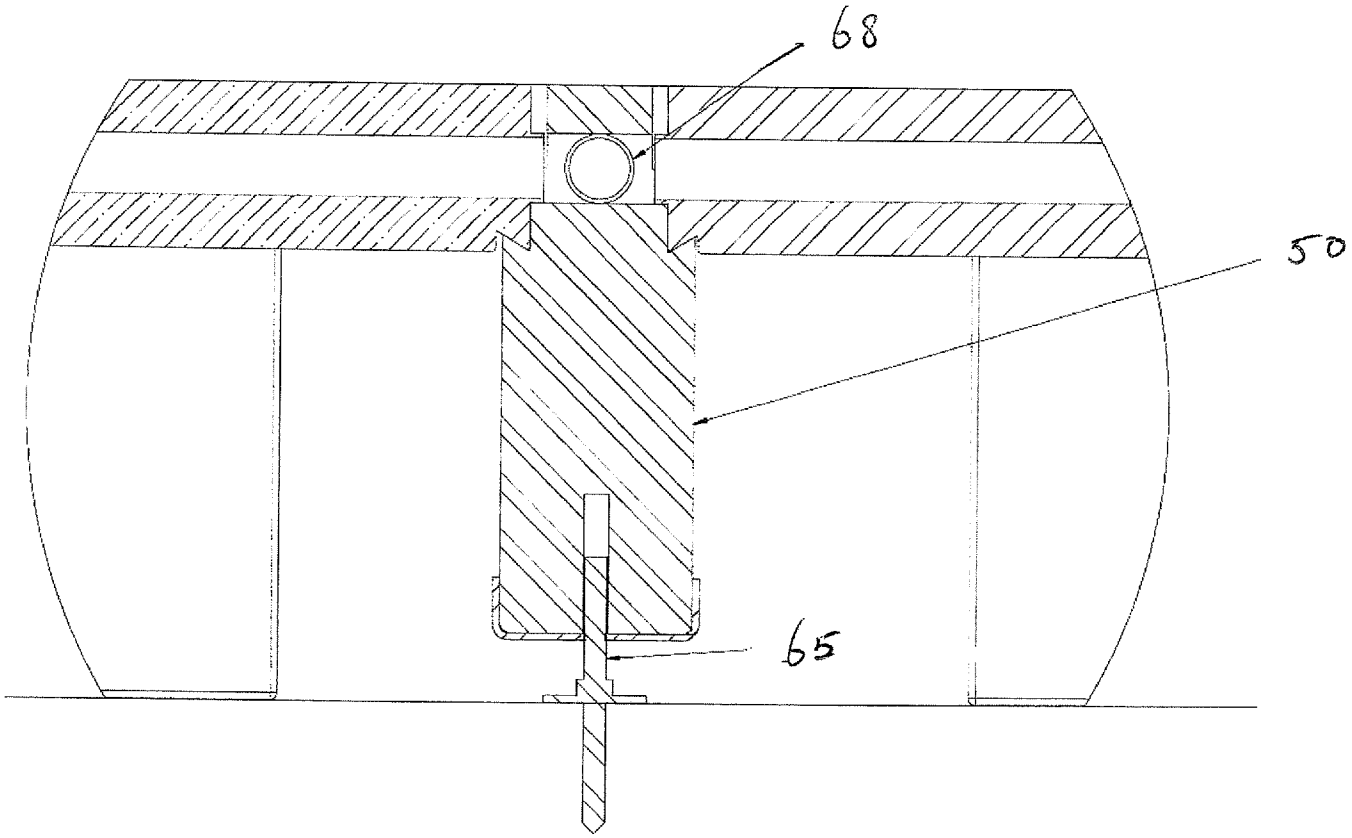

FIG. 27 is a close up view at region H of FIG. 20 of a footing connector that may form part of an internal footer.

Figure 28:
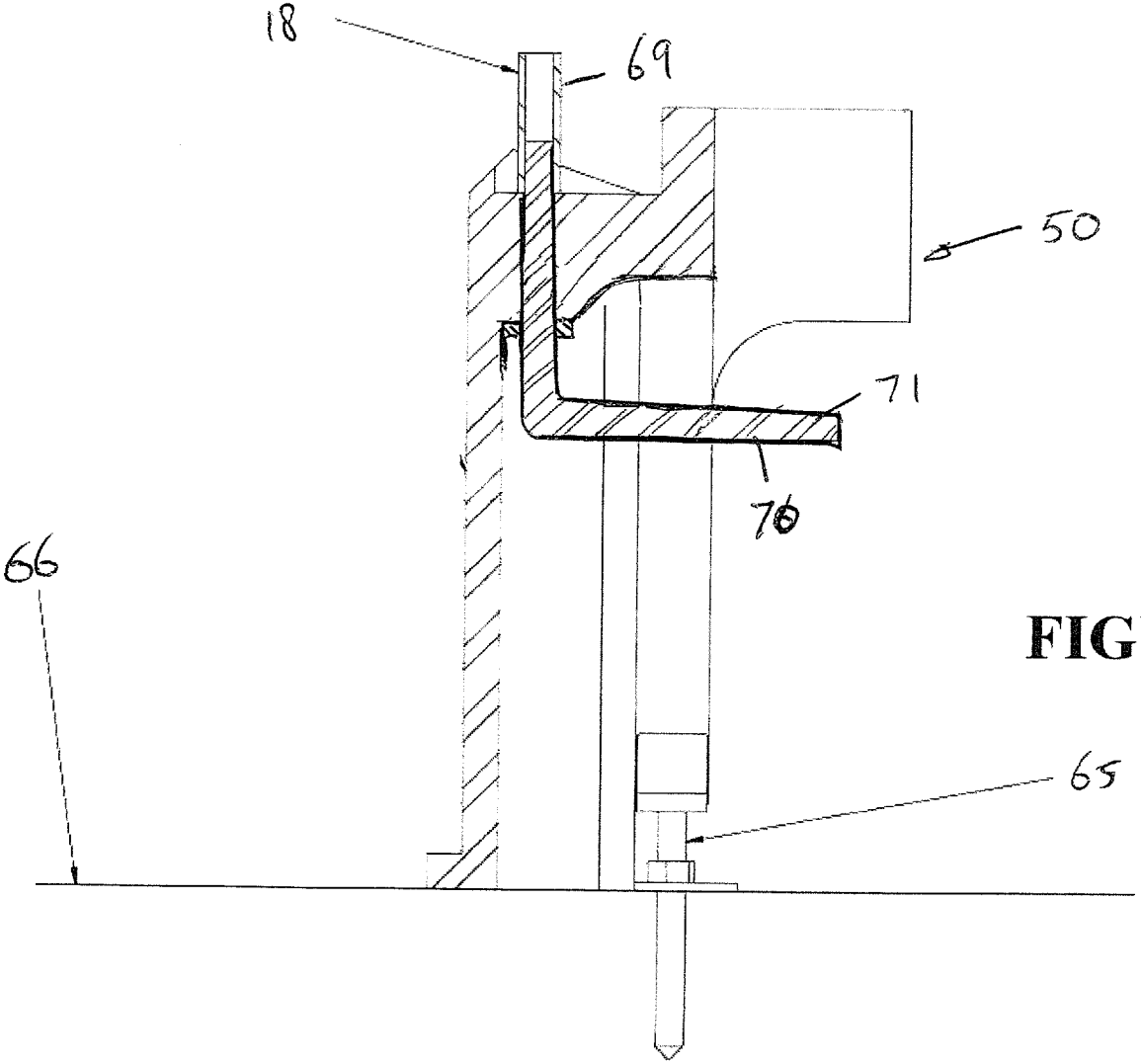

FIG. 28 is a sectional view of section DD of FIG. 20.

Figure 29:
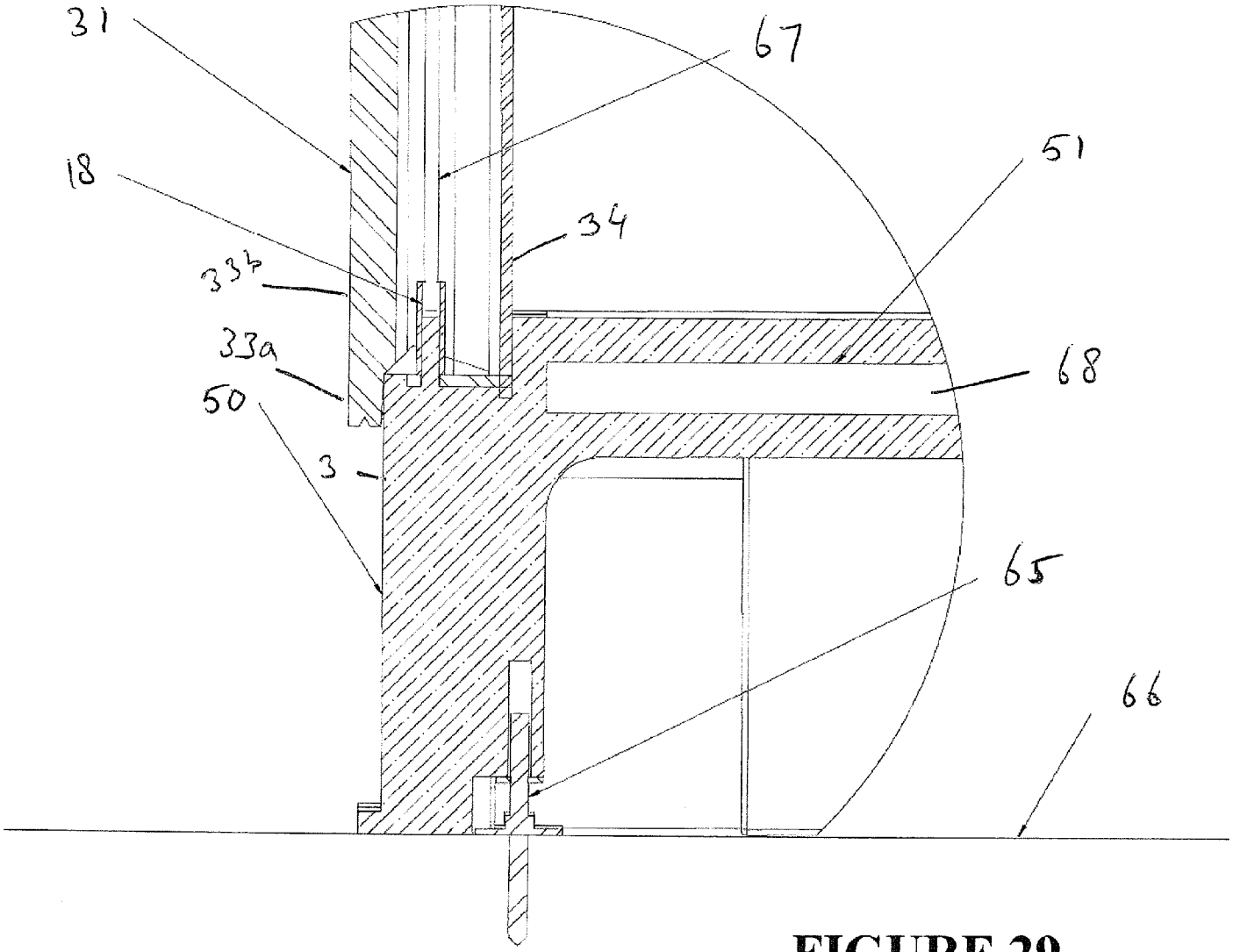

FIG. 29 is a sectional view at part of section HH of FIG. 20 and with a wall panel in part shown above.

Figure 30:
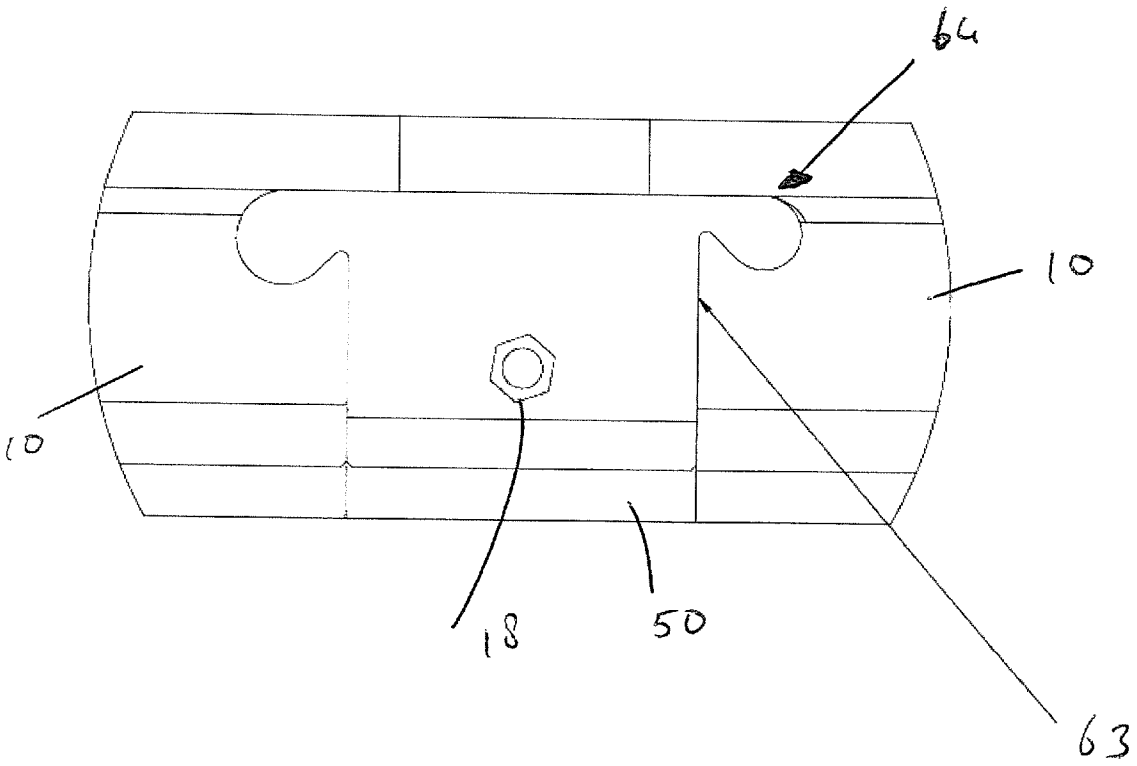
Figure 31:
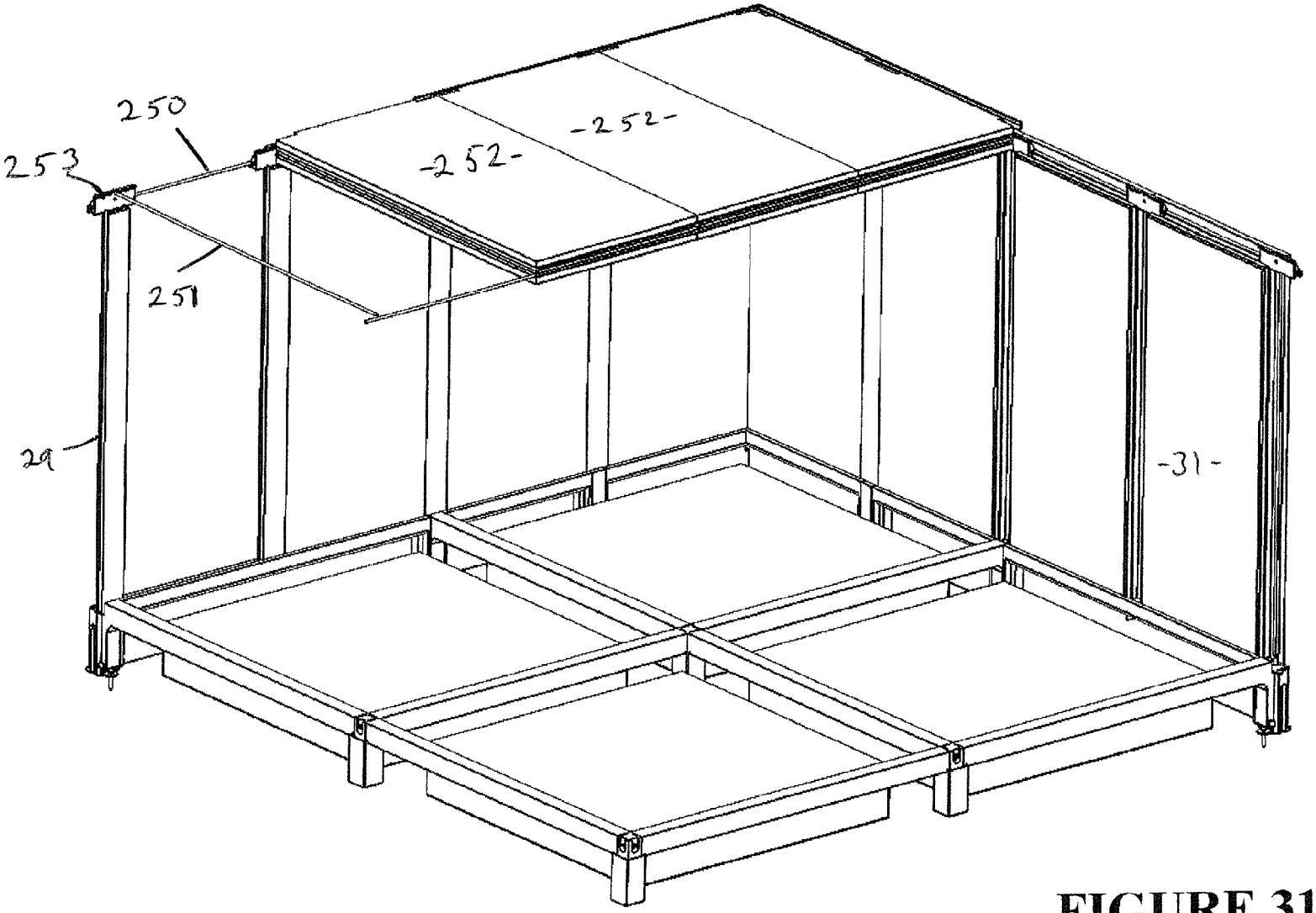

FIG. 30 is a plan view of a footing connector,

FIG. 31 is a perspective view of a building prior to a concrete foundation pour and with a ceiling/roof partially installed.

Figure 32:
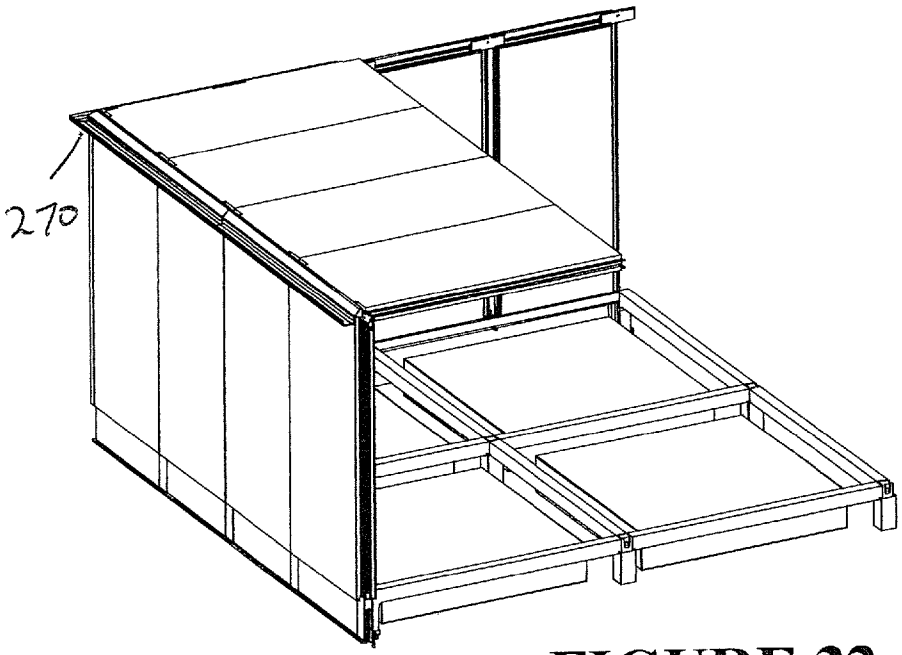

FIG. 32 is an alternative perspective of the building with a roof partially installed.

Figure 33:
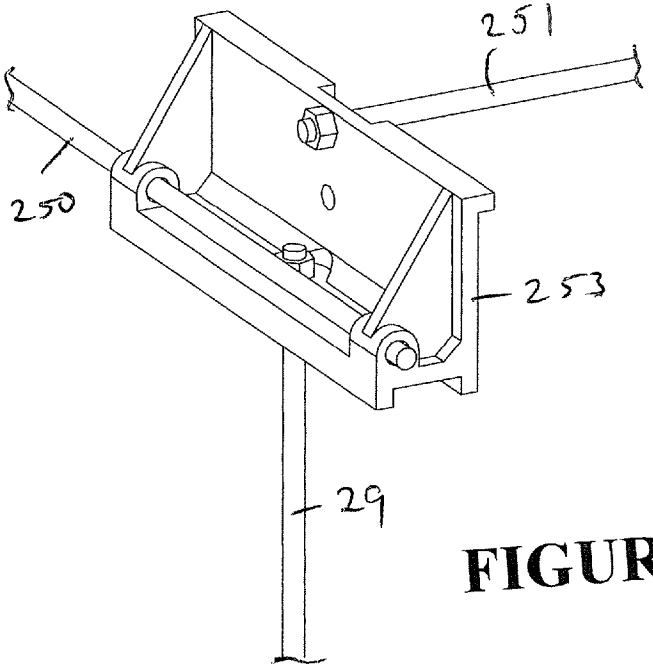

FIG. 33 is a view of a wall to roof anchor.

Figure 34:
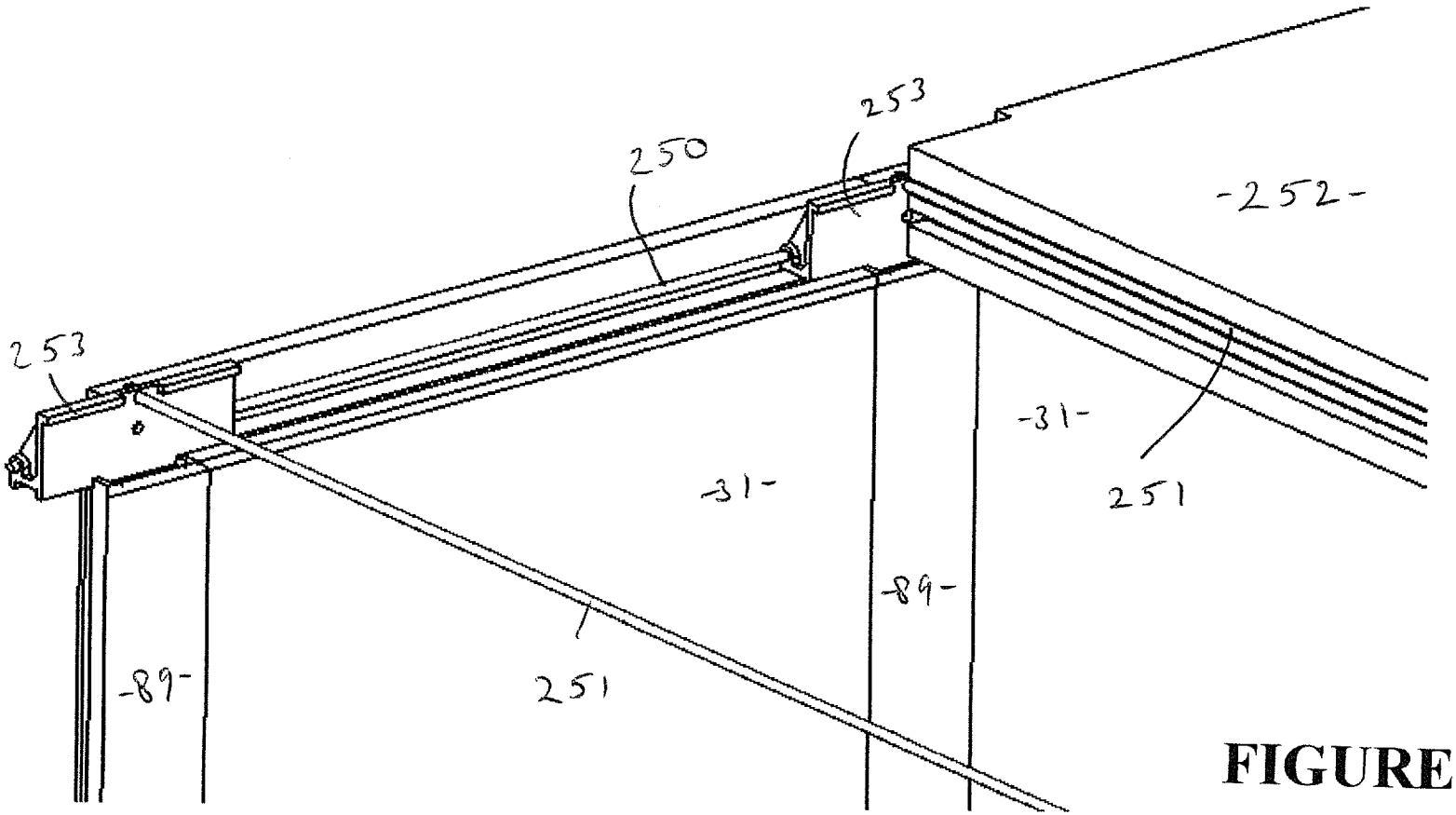

FIG. 34 is a close up view of the interface between the wall and roof showing the wall to roof anchor in place with tensioners connected.

Figure 35:
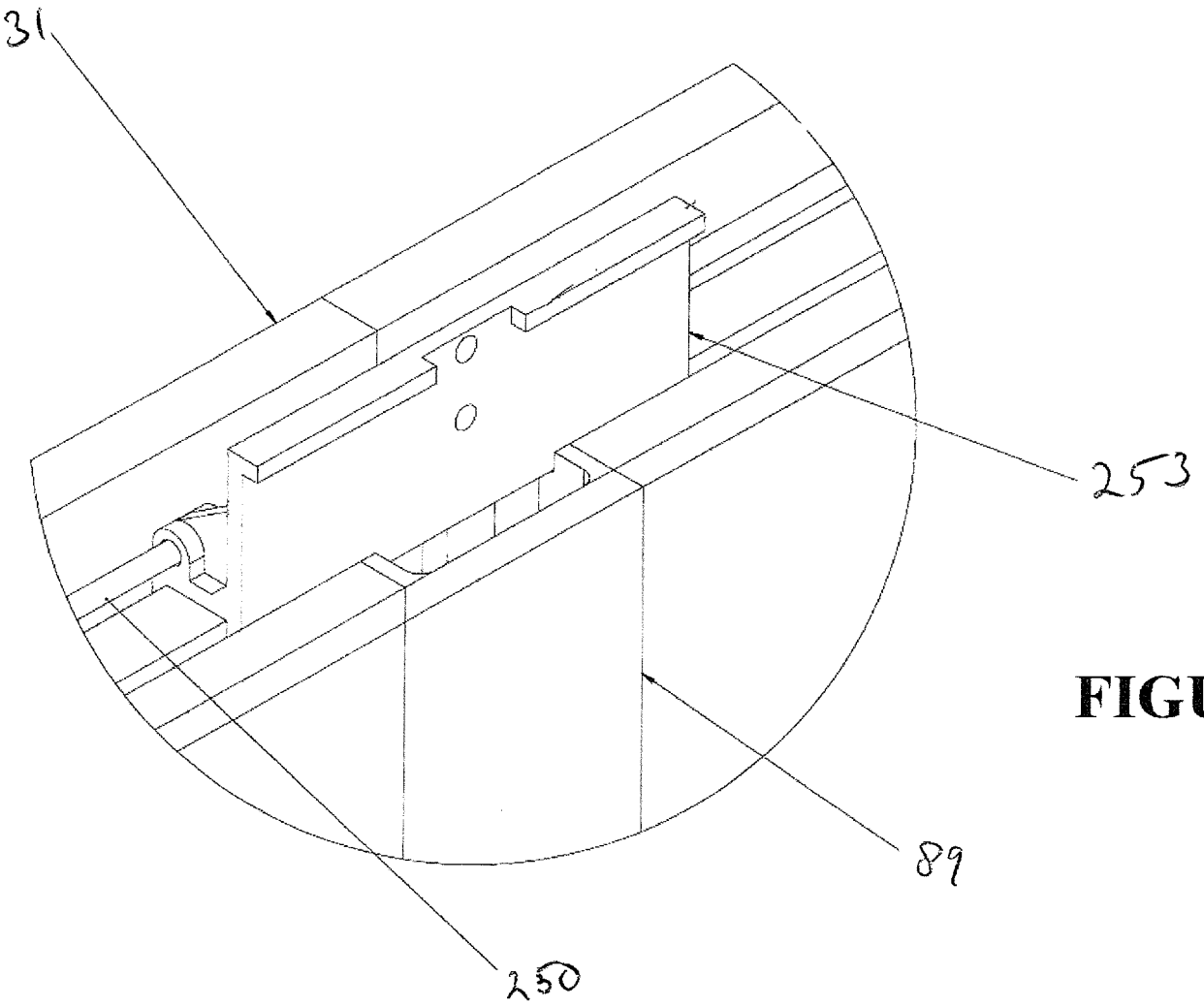

FIG. 35 is a close up view of a wall to roof anchor located at the top of a wall.

Figure 36:
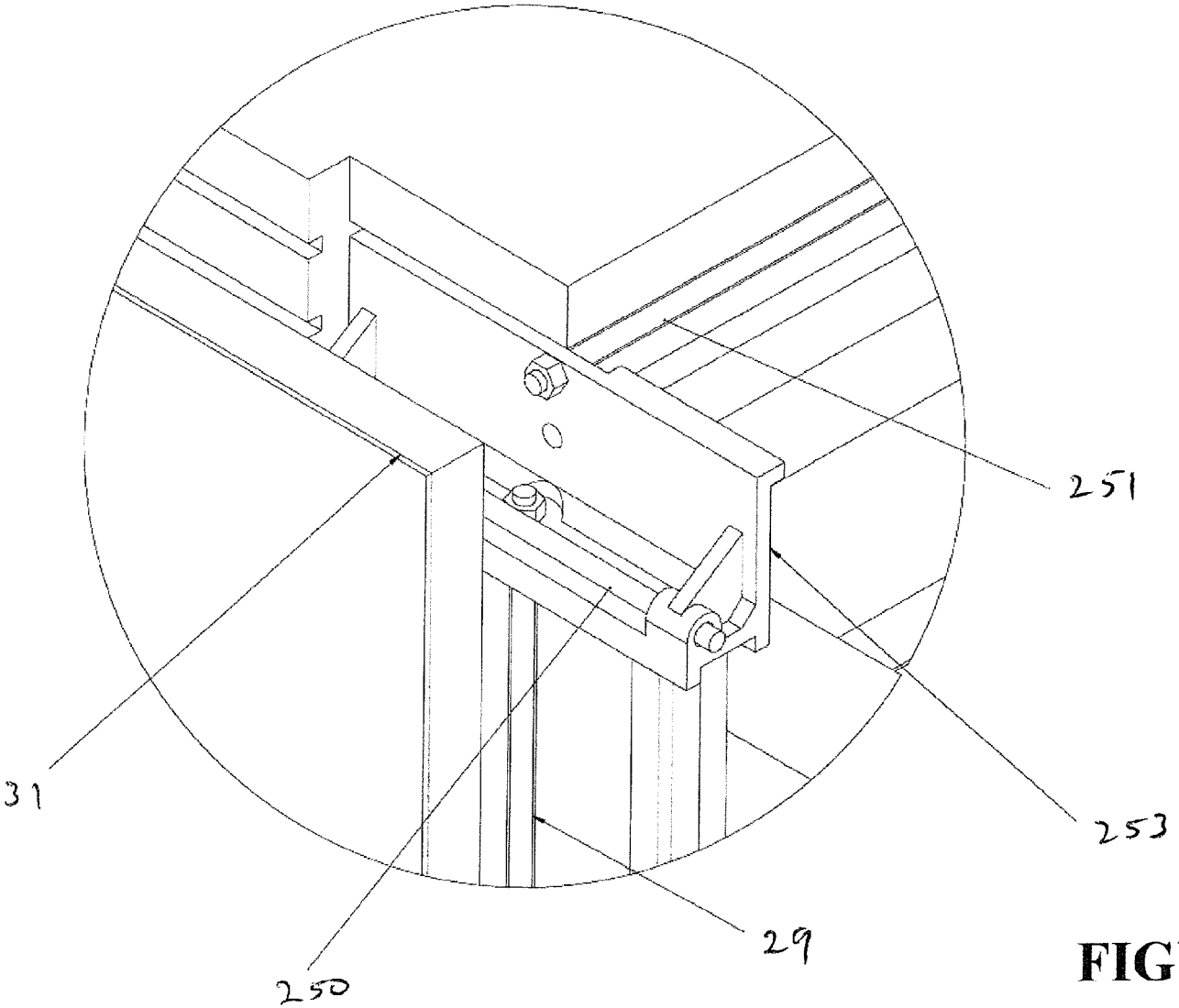

FIG. 36 is a close up view of a wall to roof anchor located at the top of a wall and a roof panel adjacent.

Figure 37:
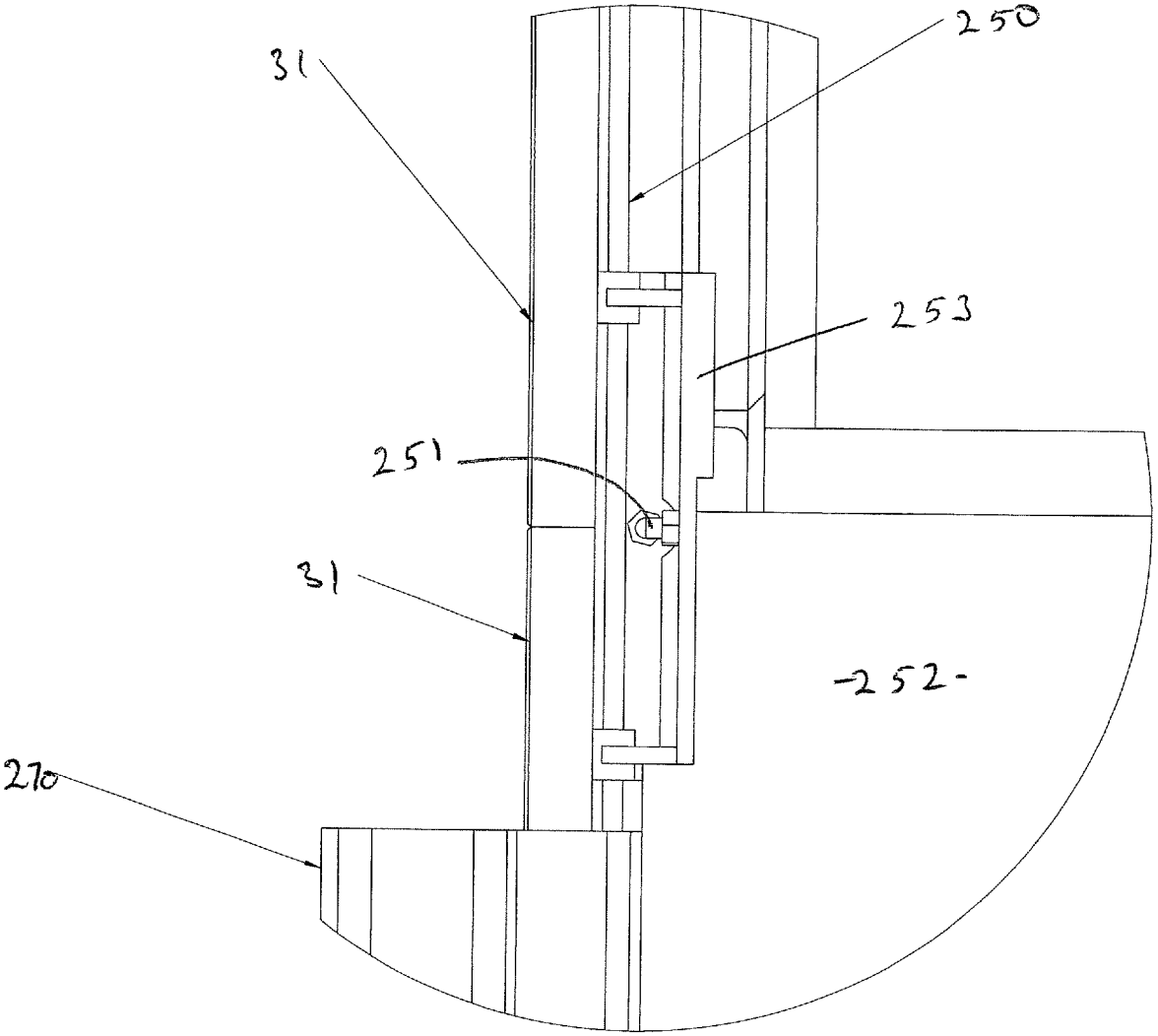

FIG. 37 is a plan view of components at the roof to wall interface, including a gutter.

Figure 38:
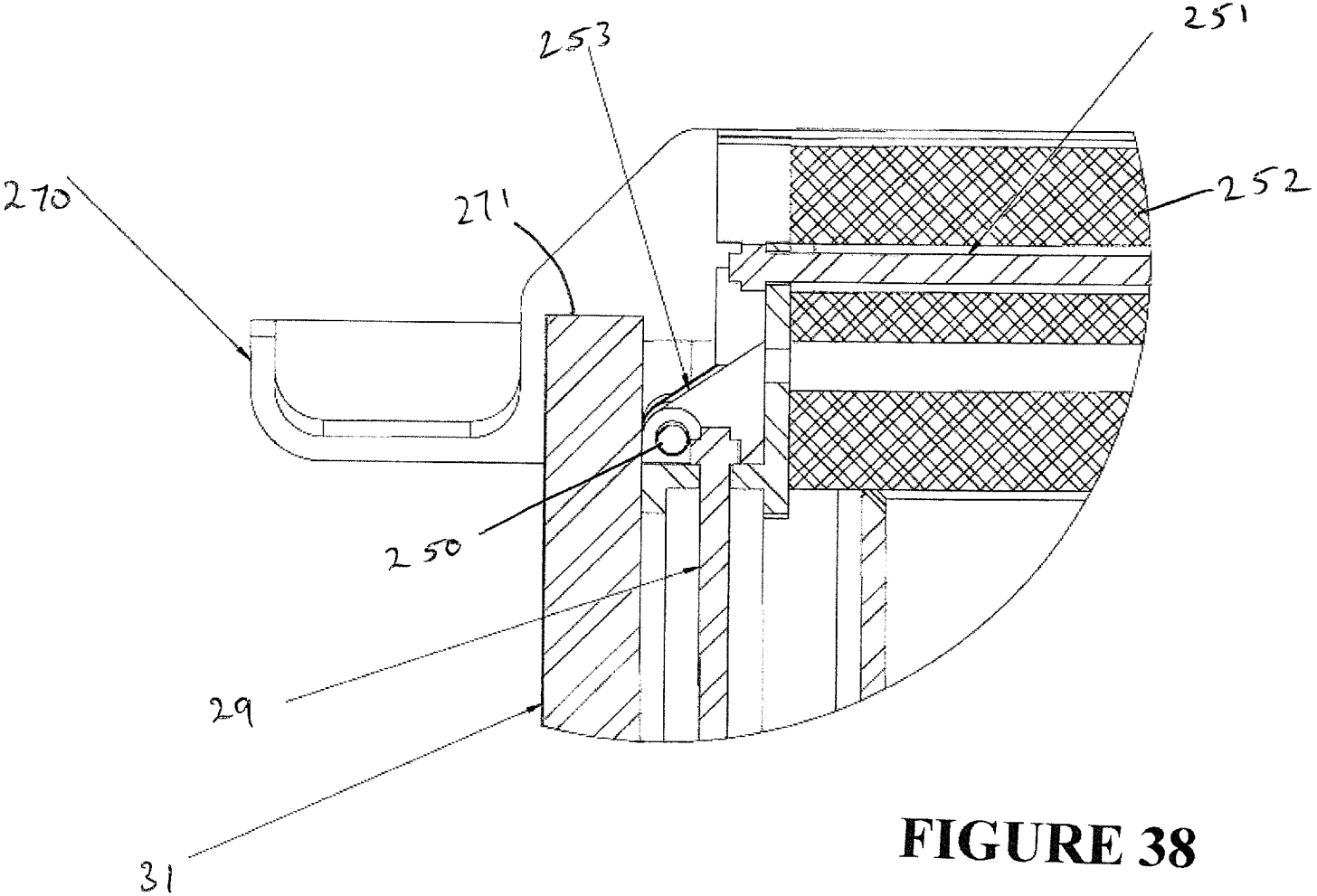

FIG. 38 is a sectional view looking horizontally at the interface between the roof and the wall and a gutter.

Figure 39:
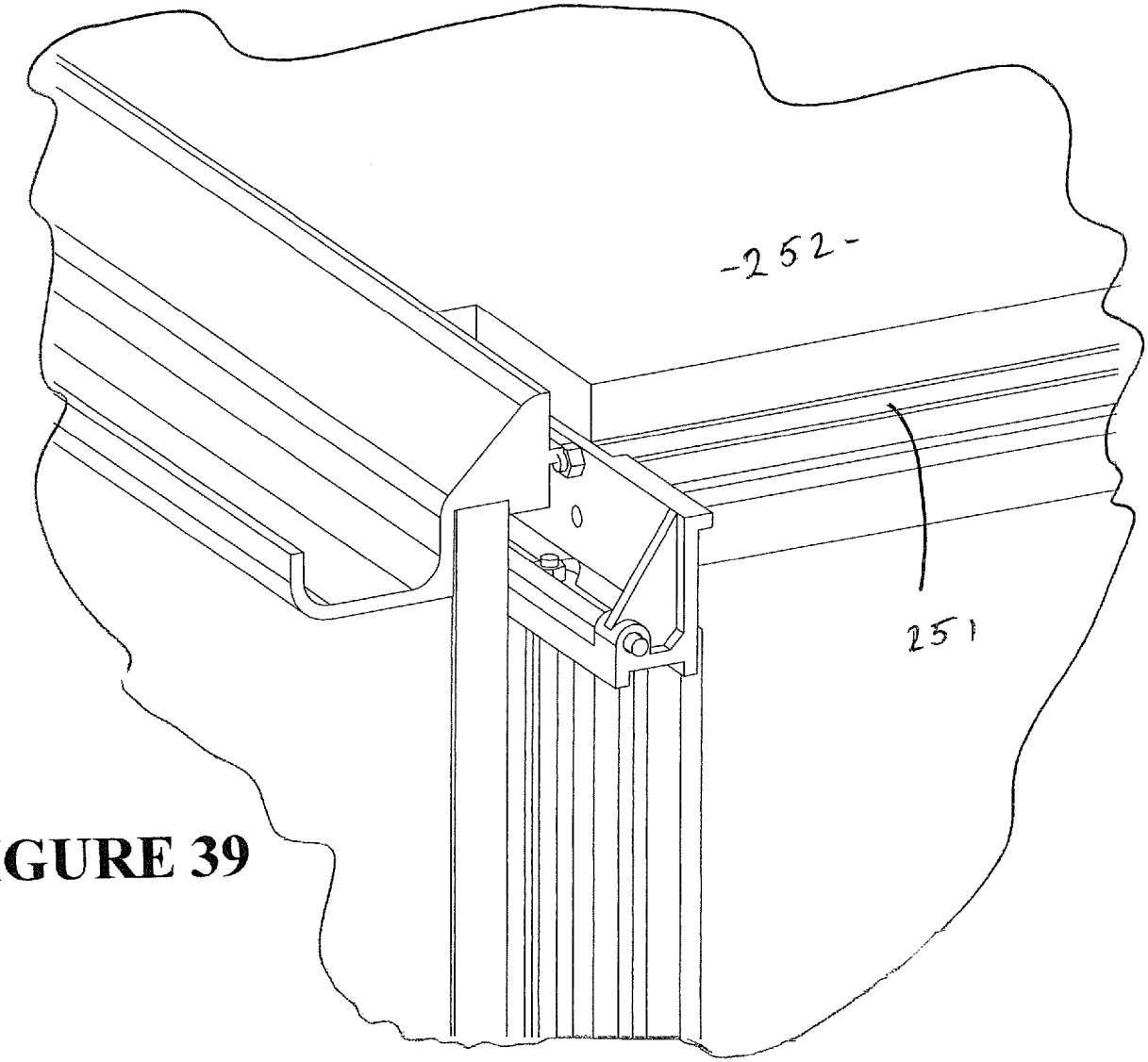

FIG. 39 is a perspective cut away view of the interface between the roof and wall and gutter.

Figure 40:
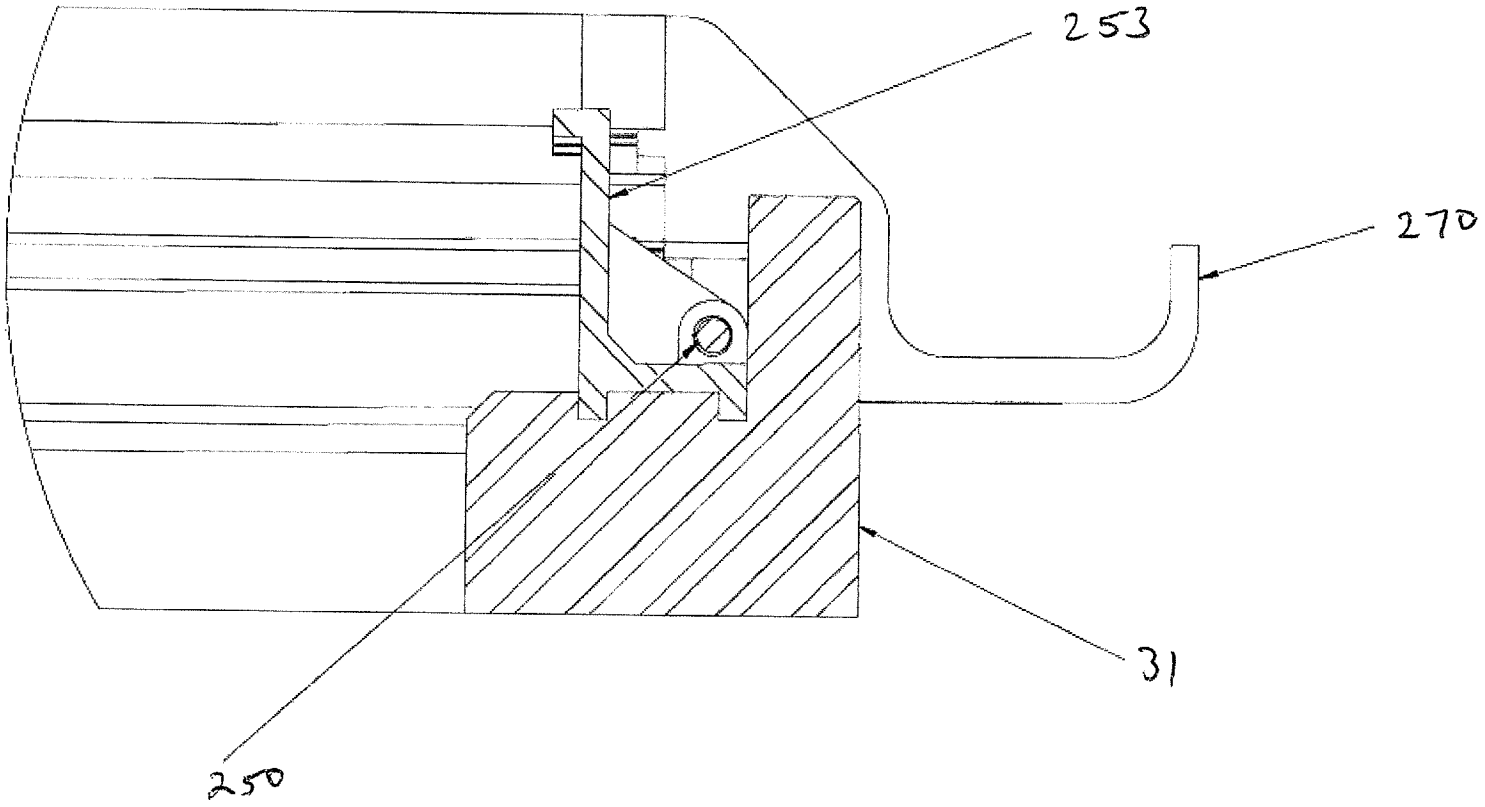

FIG. 40 is a section view looking horizontally at the interface between the roof and the wall.

Figure 41:
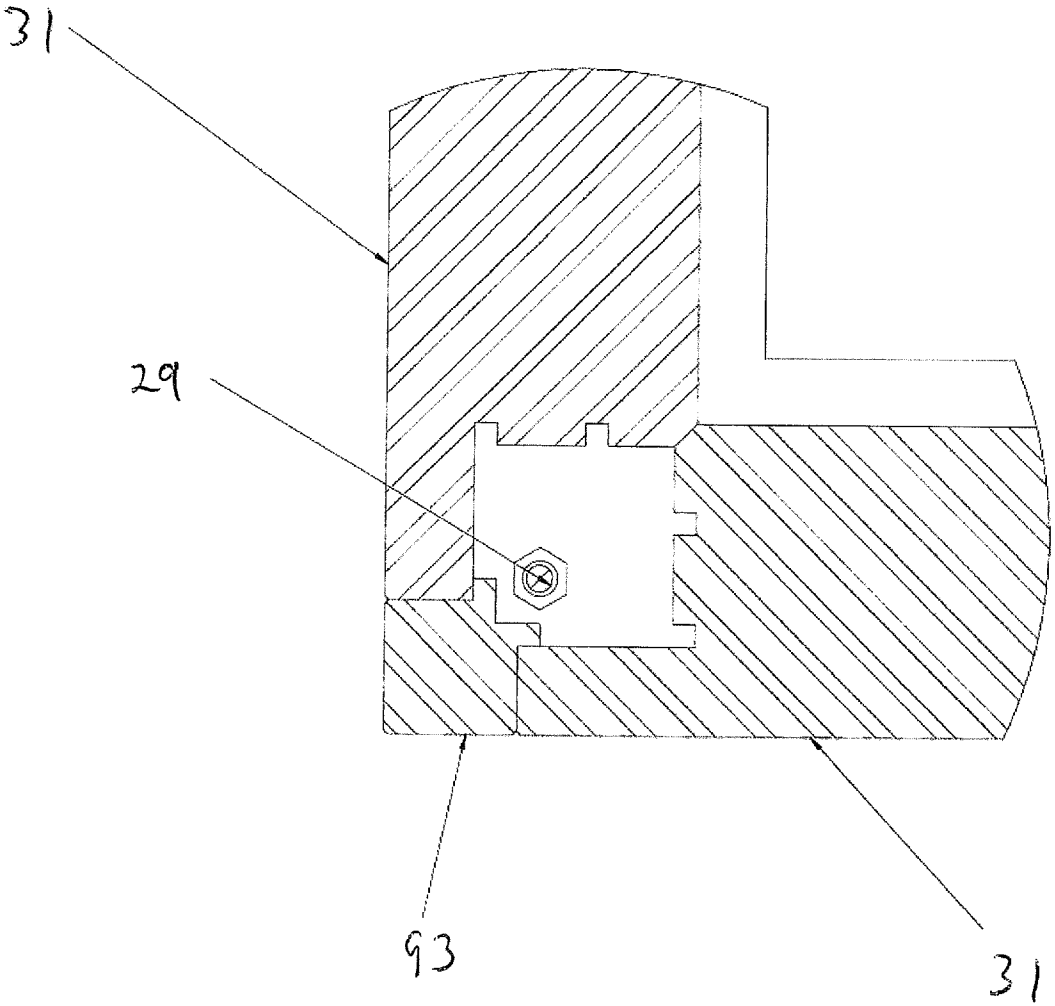

FIG. 41 is a sectional view looking vertically at the interface between two walls at a corner showing an external capping member to cap any gap between the two adjacent panels.

Figure 42:
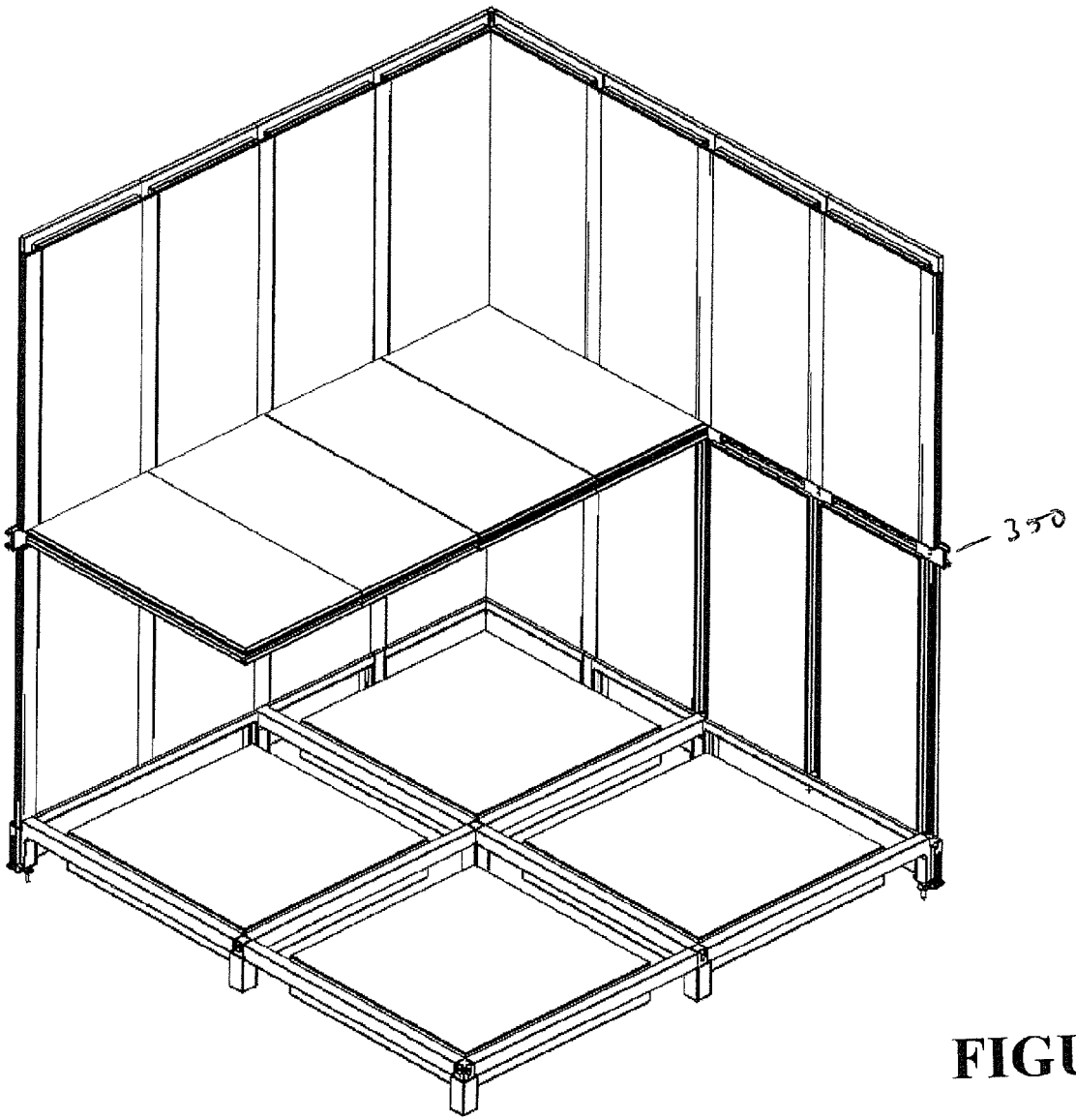

FIG. 42 is a perspective cut away view of part of a two storey building.

Figure 43:
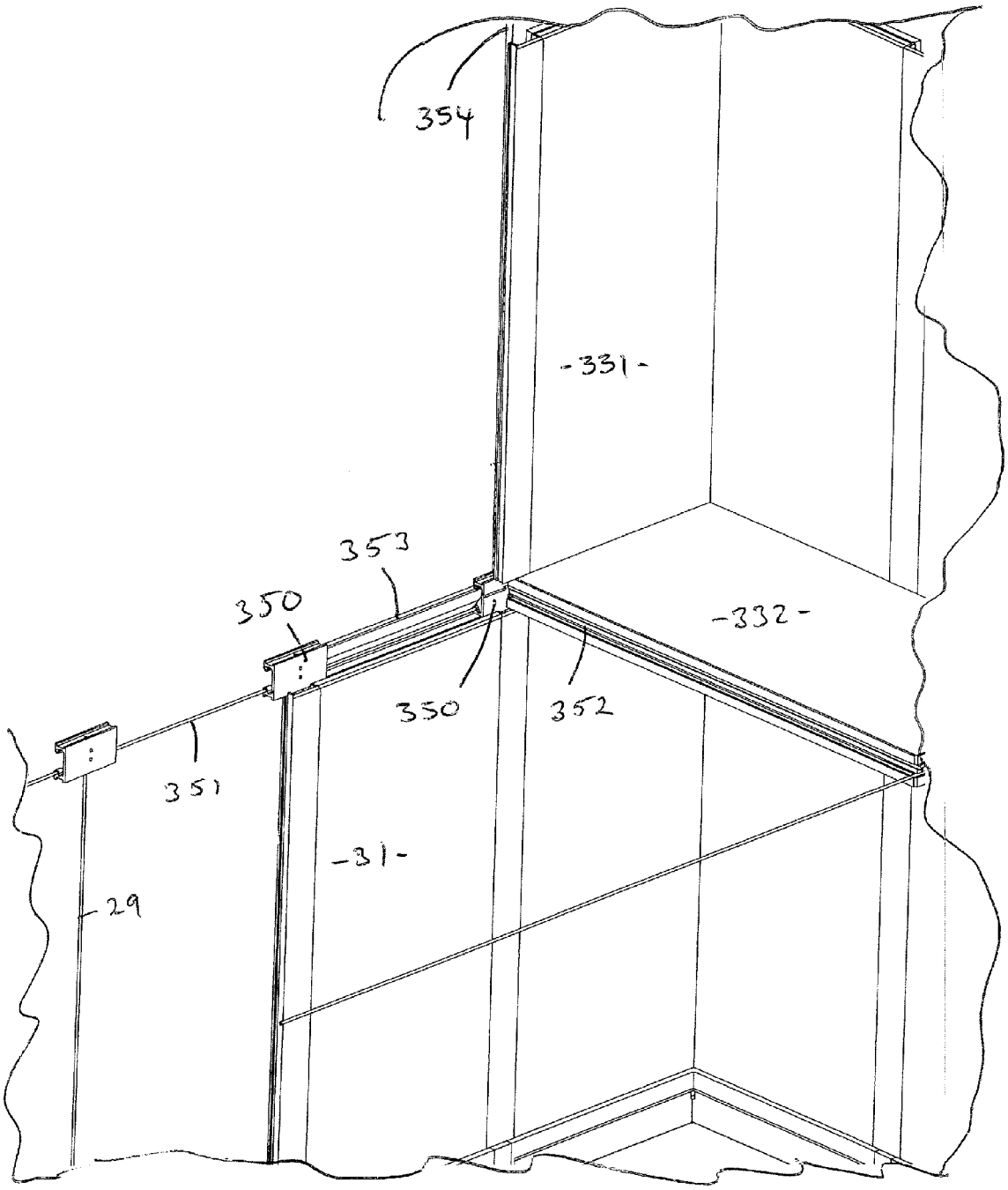

FIG. 43 is a perspective cut away of part of a two storey building.

Figure 44:
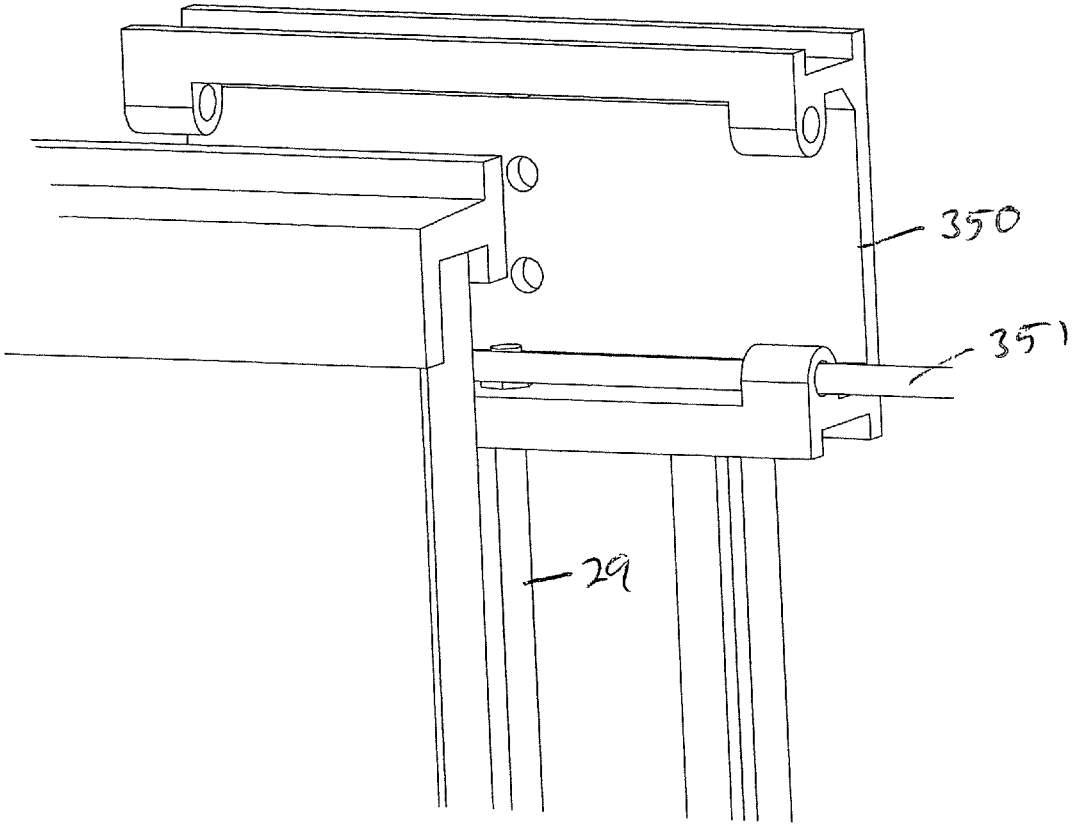

FIG. 44 is a perspective view of a multi-storey wall to floor anchor.

Figure 45:
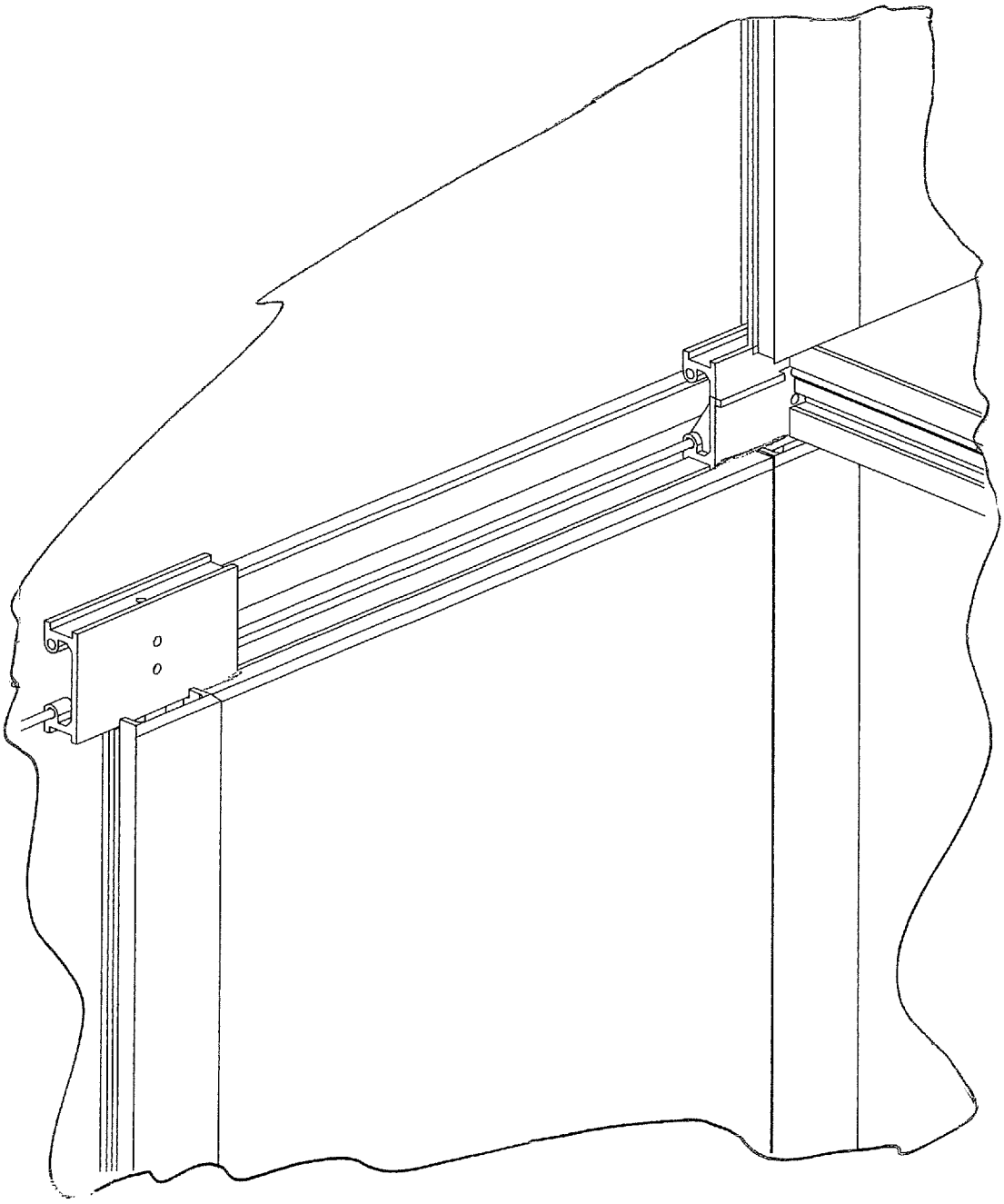

FIG. 45 is a perspective cut away of part of a two storey building.

Figure 46:
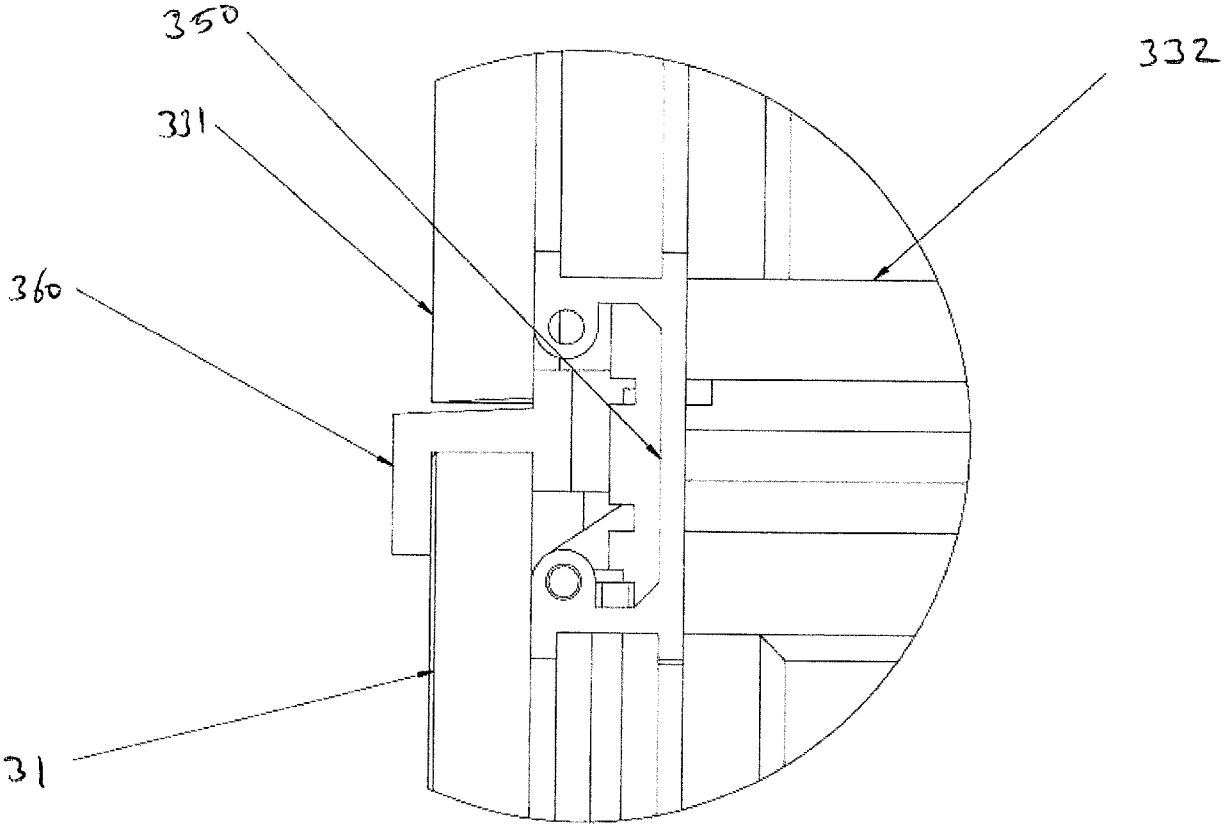

FIG. 46 is a sectional view through of the walls and floor looking horizontally at the interface between a lower and upper more storey.

Figure 47:
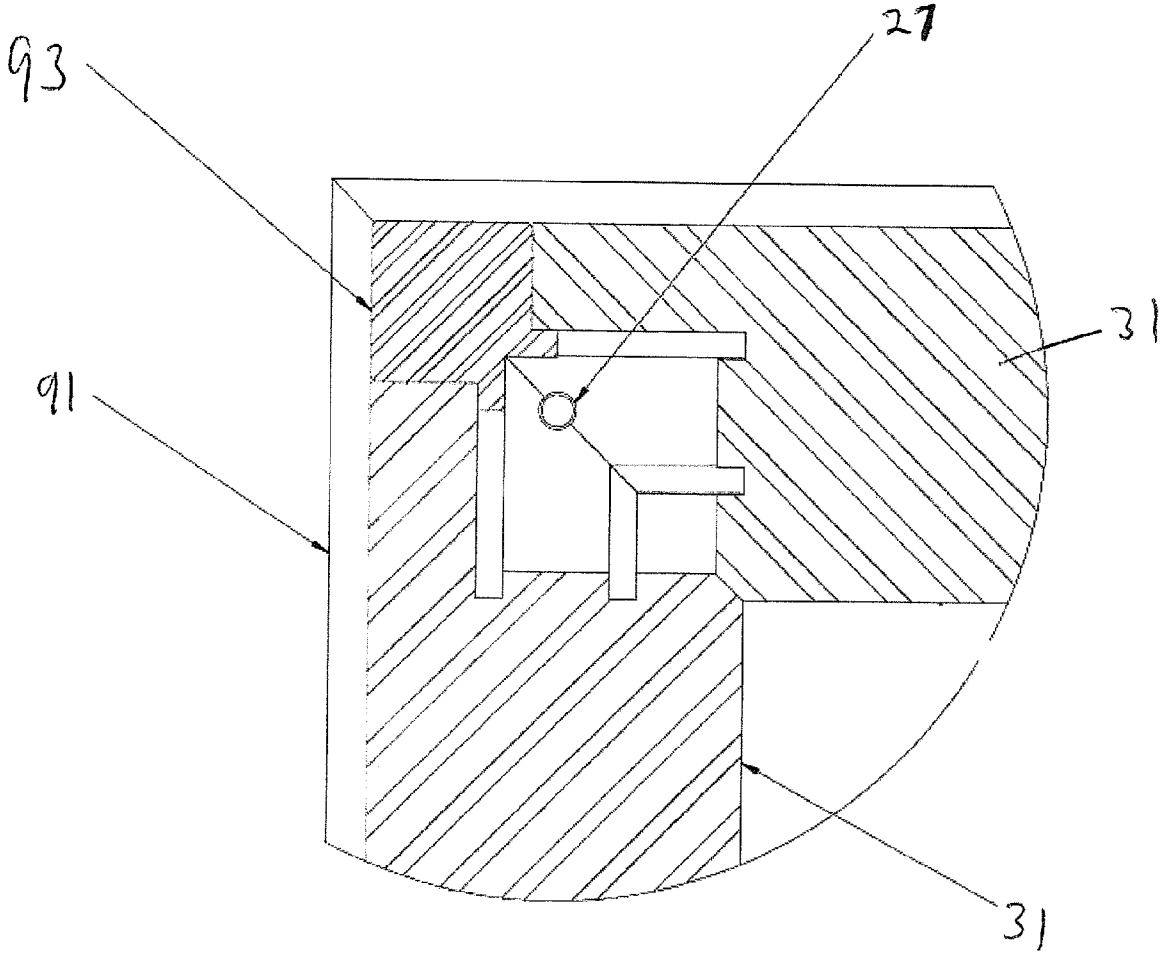

FIG. 47 is a sectional view through of the walls and floor looking vertically at the interface of two adjacent wall panels at a corner.

Figure 48:
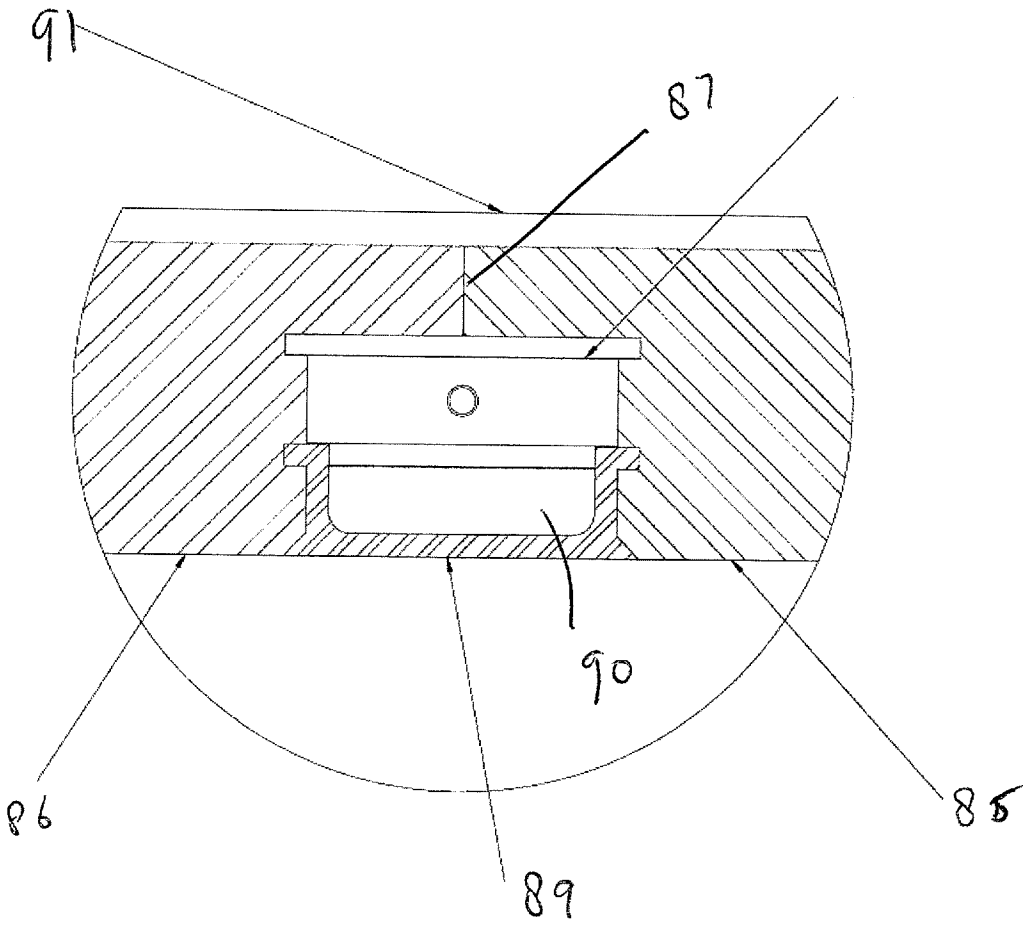

FIG. 48 is a sectional view through of the walls and floor looking vertically at the interface of two adjacent wall panels forming part of a wall of a structure.

Figure 49:
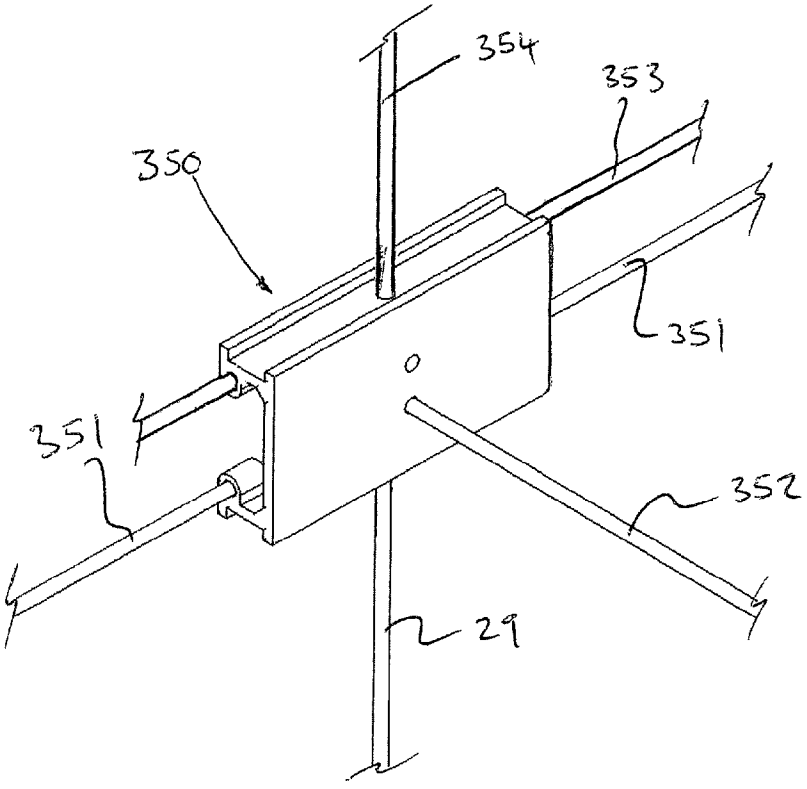

FIG. 49 is a front perspective view of a multi-storey anchor and tensioners.

Figure 50:
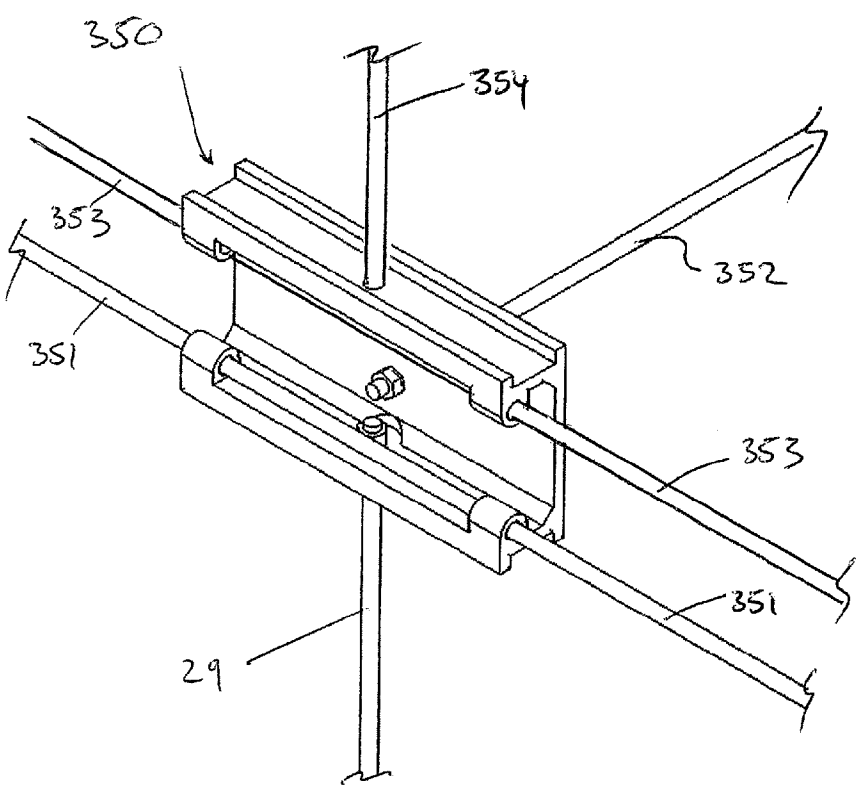

FIG. 50 is a rear perspective view of FIG. 49.

Figure 51:
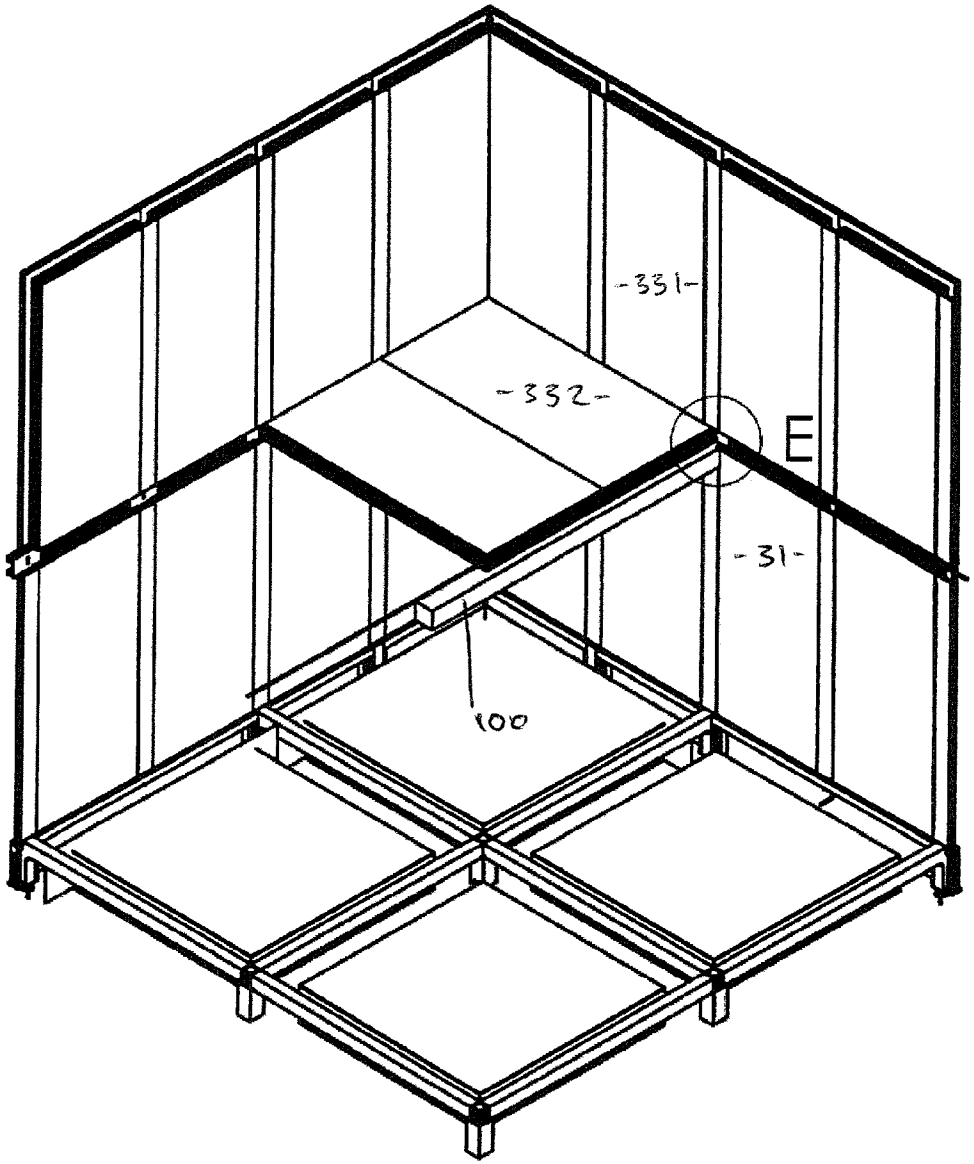

FIG. 51 is a perspective view of a two storey building with a beam.

Figure 52:
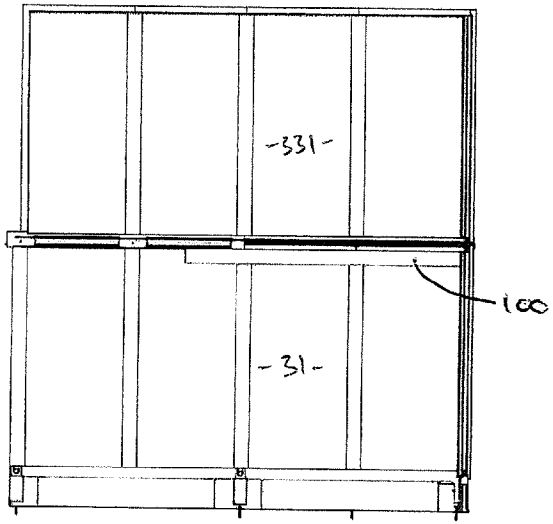

FIG. 52 is a front view of FIG. 51.

Figure 53:
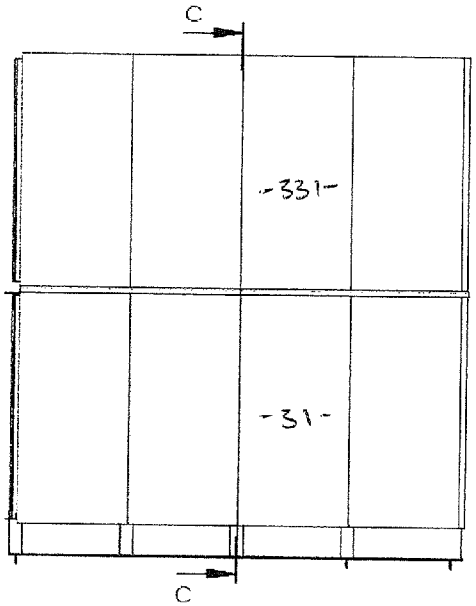

FIG. 53 is an alternate side view of FIG. 51.

Figure 54:
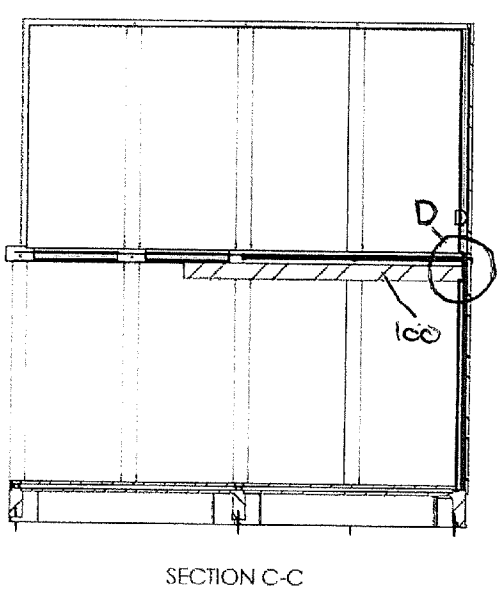

FIG. 54 is cross section C-C of FIG. 53 showing the beam.

Figure 55:
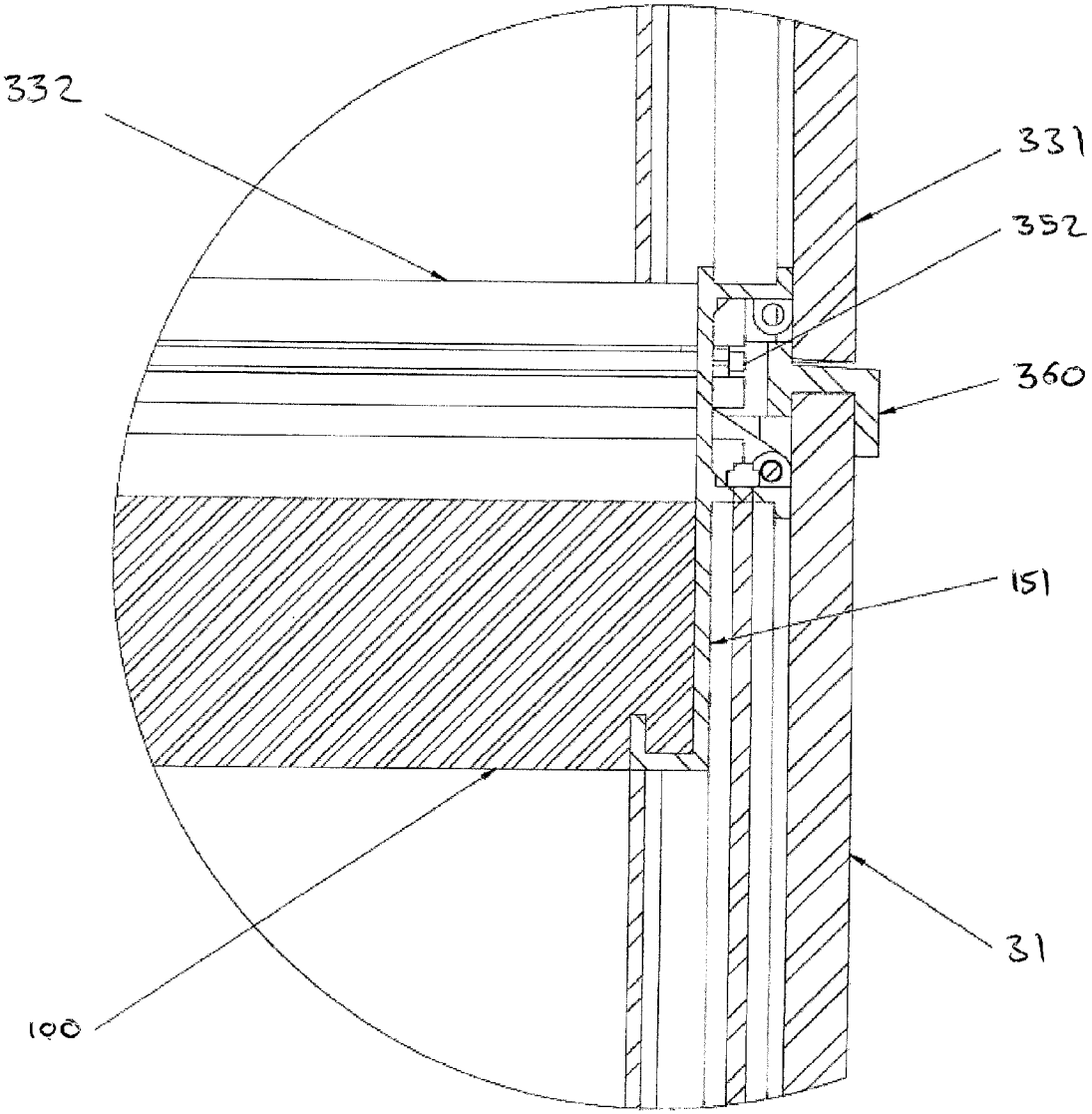

FIG. 55 is a detail view of D in FIG. 54 showing the beam connector

Figure 56:
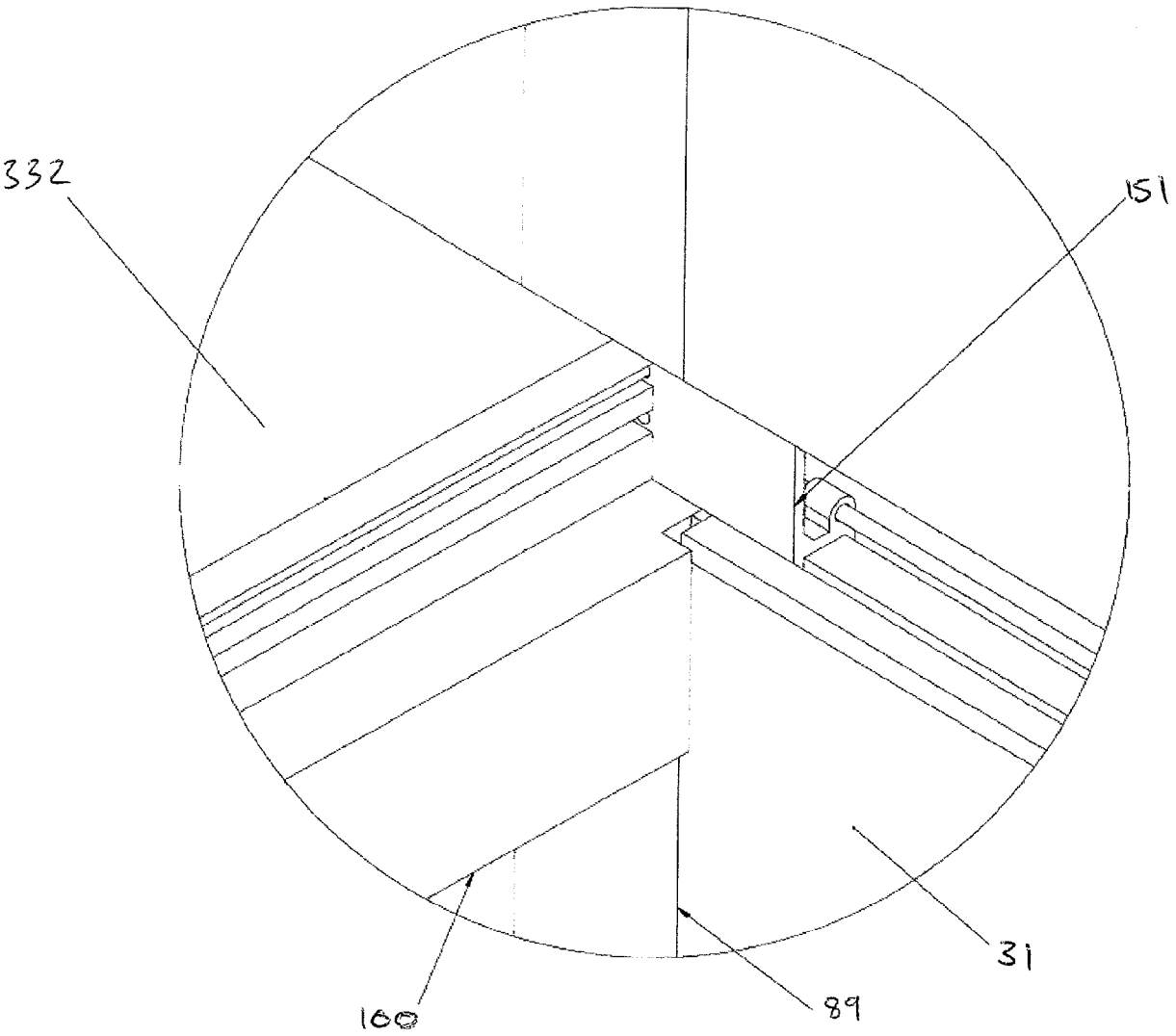

FIG. 56 is a detail view of E in FIG. 51 showing the beam and associated connector.

Figure 57:
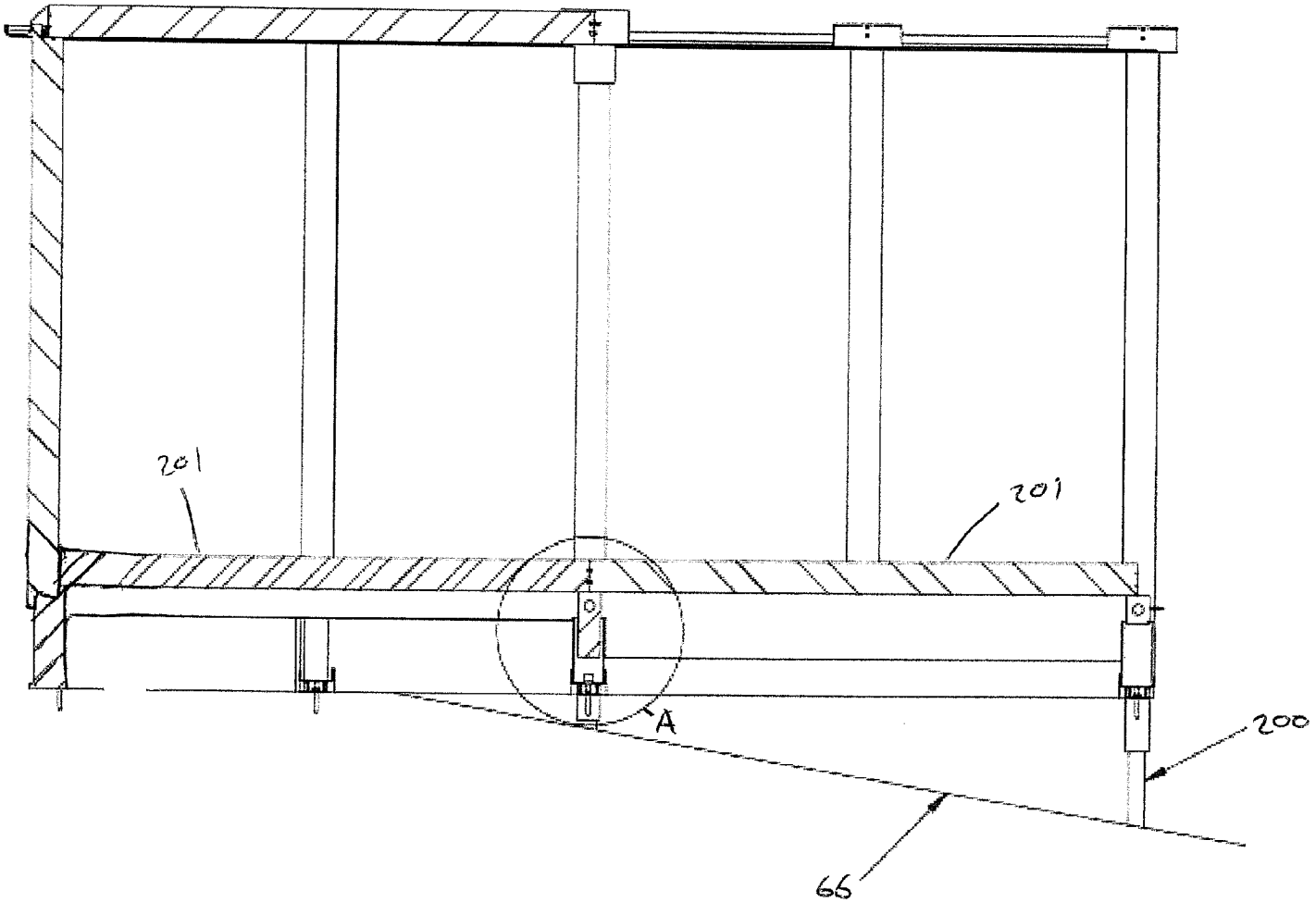

FIG. 57 is a cross section of a one storey construction showing sloped ground foundations.

Figure 58:
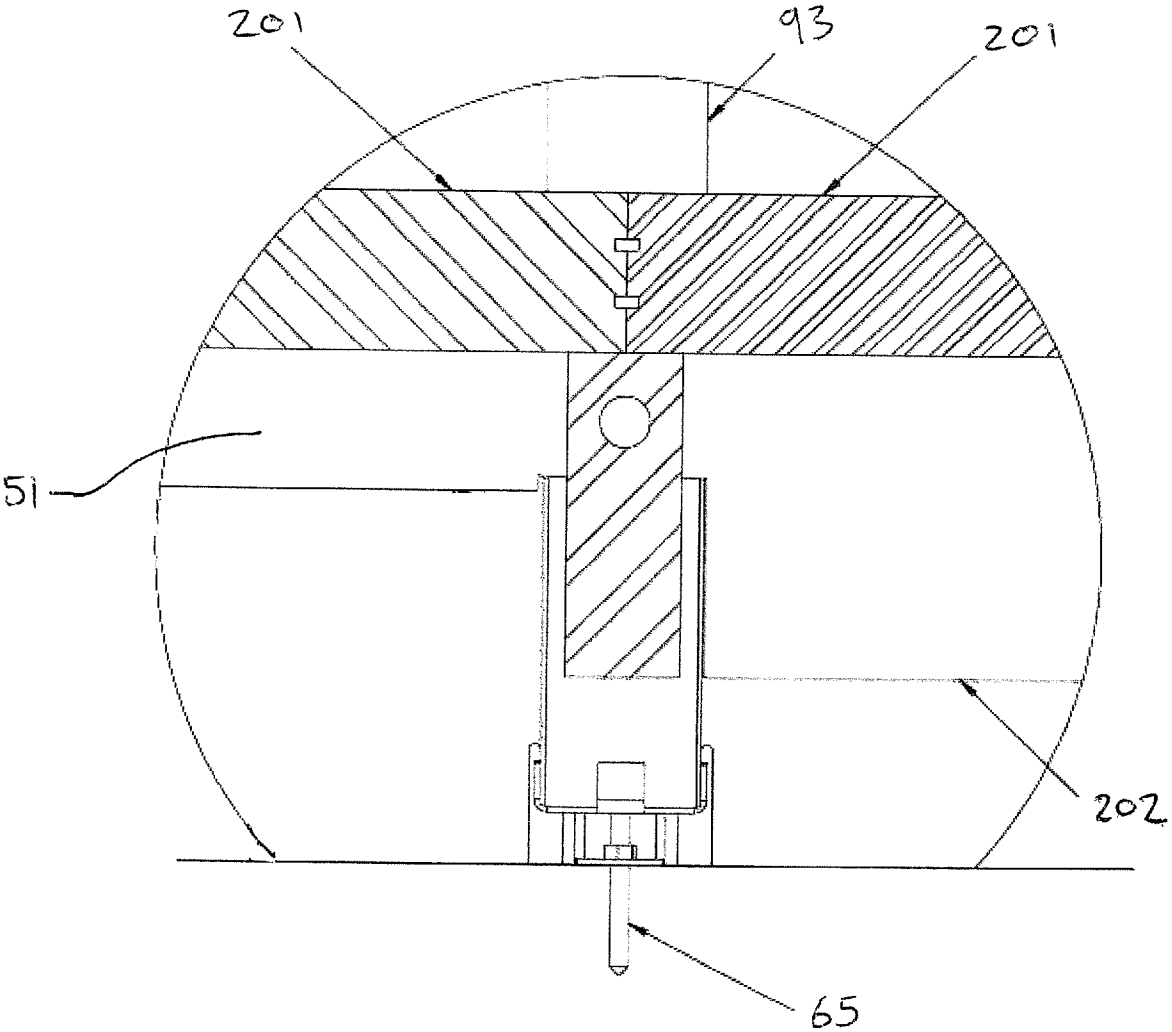

FIG. 58 shows a close up view of detail A of FIG. 57.

DETAILED DESCRIPTION OF THE PREFERRED EMBODIMENTS

Here below is described a modular building, components and aspects therefore and methods of their construction. The building can be formed using modular components including panels. Many of the components are able to connect and cooperate such as by interlocking with each to create a rigid building structure. The foundation of the building includes a footing. The foundation may also include concrete preferably poured adjacent the footing. The footing is formed by prefabricated footers that may be connected together to define the footing of the foundation. A number of panels are used to form either outer walls of the building or internal walls, forming rooms or partitions within the building envelope. The panels may include apertures for window or doors or the like. Each of the panels is capable of being fitted to the footing. A roof may be fitted on the top of the panels supported on the footing or alternatively a roofed second storey may be supported.

Components are factory made with precision so as to ensure accurate assembly on site right from the foundation up.

Foundation

Figure 6:
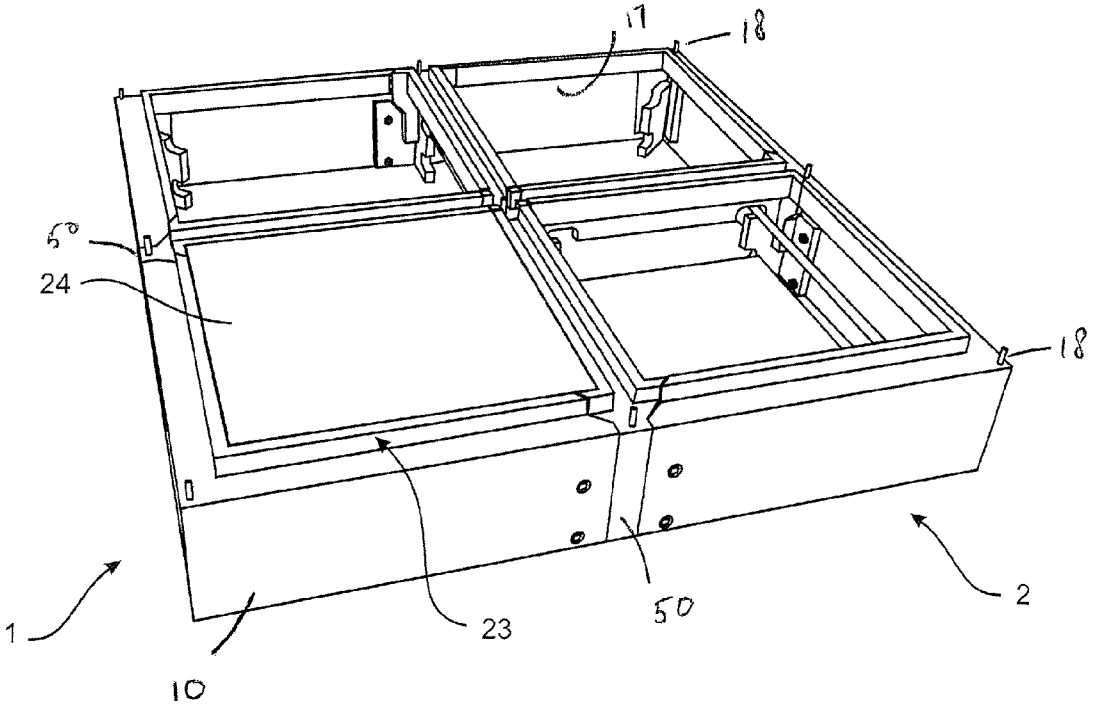
FIG. 6 shows a perspective view of the footing of FIG. 5 with one of the 4 cells filled with concrete for illustrative purposes.

With reference to FIG. 6, there is shown a foundation 1 for a simplified representation of a building, namely one that has a square footprint.

The foundation 1 includes a footing 2. The footing 2 is created by the use of prefabricated components that are able to be assembled on site.

The site may be prepared by levelling and compacting the ground sufficiently to be able to place the footing thereon. The foundation may be set down below ground level or may sit at ground level. No trenching is required as the foundation is capable of sitting on top of compacted ground.

The prefabricated components of the footing may comprise of footers such as external corner footers 10. These may be connected to like corner footers or other shaped footers.

Footing connectors 50 may be used to connect footers together so that they can be assembled on site with each other to define the footing.

The foundation of the building preferably comprises such footing to support panels that form the exterior walls of a building. Interior wall or partition panels may be supported on internal footers that will herein after be described.

The external footers once placed on the ground, can create a formwork or cavity for a concrete pour. This can be seen in FIG. 6 where the bottom left part of the foundation is shown to have been filled with concrete to the top of the external corner footer 10. Filling may be achieved by other composites or appropriate settable materials as are known in the art, concrete being an easily accessible material.

Filling with concrete or the like amalgamates components of the footing together. It also creates a load transfer path to the ground below as it can be seen that the concrete pour is at least partially into the ground below and in particular onto the ground below, below and/or adjacent where the footers will receive wall panel loading.

The poured concrete can settle onto the ground below, even if it is not perfectly smooth or coplanar with the lower edge of the footing. The concrete can act as a gap-filler between the ground and where building structure load transfer will occur from the footing. The foundation may remain as a raft foundation with little or no ties to the ground below that may restrict its lateral movement such as during an earth quake.

Figure 1:
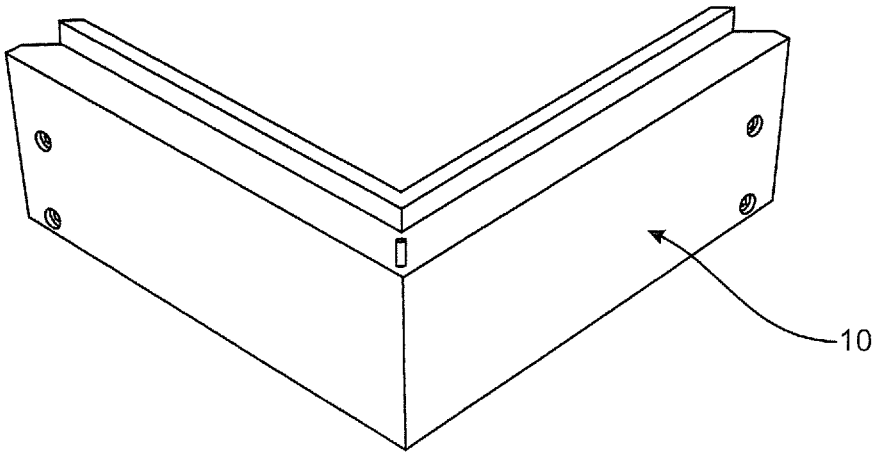
FIG. 1 is an exterior corner footer of footing of a foundation of a modular building and system.
Figure 2:
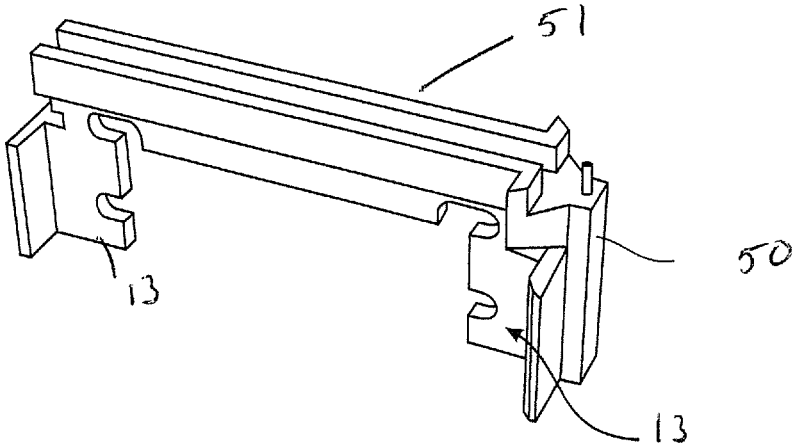
FIG. 2 is an internal footer of the footing.
Figure 3:
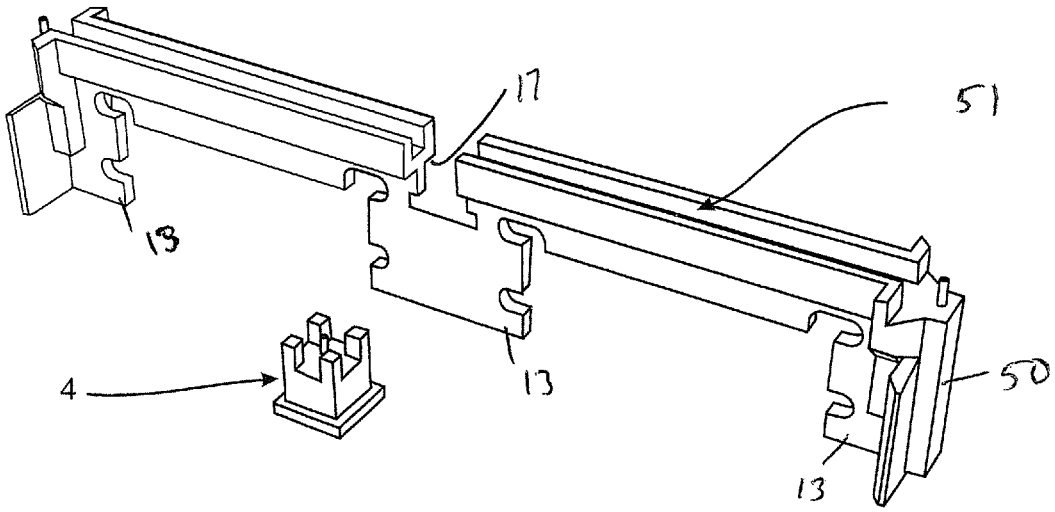
FIG. 3 is a double internal footer that may be used in creating the footing.

FIGS. 1 to 3 show various parts making up the footing 2 of the foundation 1. The footing 2 may be individual footers that can be connected or joined together. They may create an endless footing or a footing having two ends. Preferably the footing is created to define an enclosure. Wall panels may be supported on top of the footers.

In the examples shown, the footers may include external corner footers 10. To ensure accuracy of the foundation, the external corner footers 10 are prefabricated with their corner angle predefined. This ensures that for example, 90 degree corner accuracy is maintained when the components making up the footing are assembled on site. This helps keep the footing true and square when assembled and during the concrete pour. In particular designs, the external corner footers may not be 90 degrees. The flexibility of multiple angles allows more design options. Acute or obtuse angles are also envisaged between the elongate sections of a corner footer.

The footing 2 may also have internal footers 51 that support internal walls of the building. The internal footers 51 may be of a single span as shown in FIG. 2 or a multi-span crossing over other internal footer(s) as shown in FIG. 3. Also shown in FIG. 3 is a connector 4 that incorporates a hold down bolt that slots into the internal junction of the divider pieces. The connector supports the divider pieces intermediate of the frame of the footing.

Figure 4A:
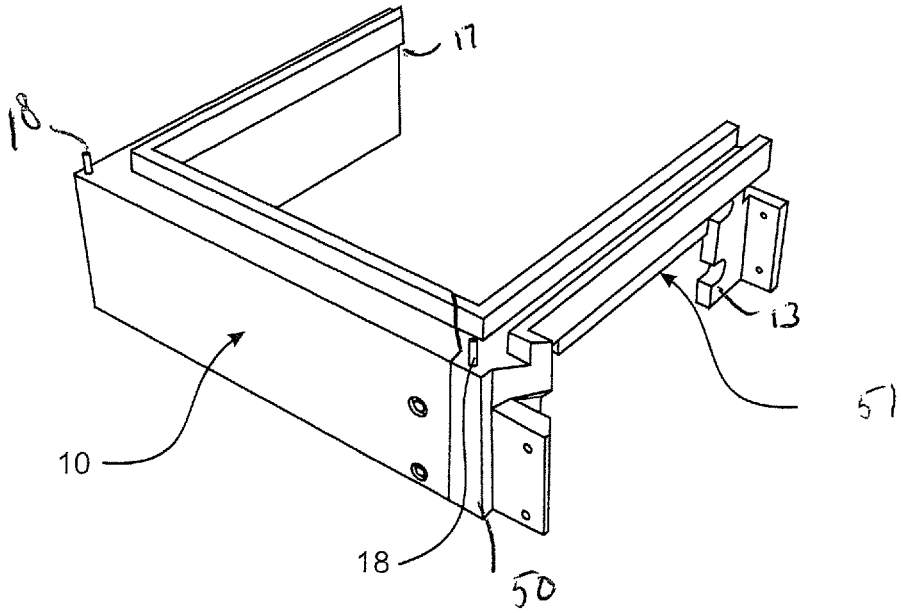
FIG. 4*a* shows the exterior corner footer of FIG. 1 and internal footer of FIG. 2 connected.
Figure 4B:
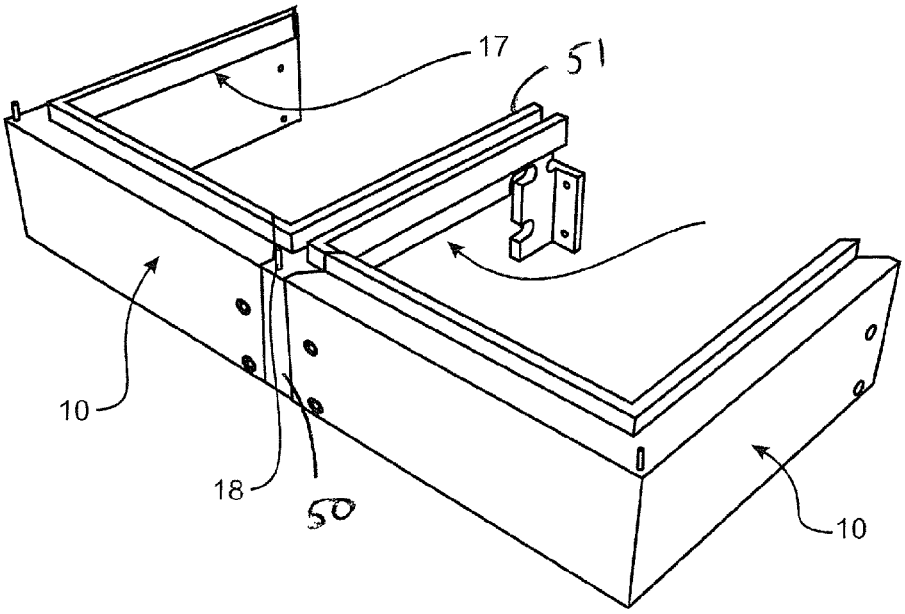
FIG. 4*b* shows two exterior corner footer of FIG. 1 and internal footer of FIG. 2 connected.

The internal footers 51 and external footers may be connected to each other using footer connectors 50. As shown in FIGS. 2 and 3 the footer connectors may be integrally formed with the internal footers 51. Alternatively, they may be integrally formed with the external footers or both. Alternatively, separate components may be used to connect adjacent footers together. Bolt through securing of the footers and the connectors may be achieved as seen in FIG. 4*a*. Alternatively, locking or interlocking features and/or components may be provided such as dove tail, mortise and tenon or dowel joint configurations to ensure a securing of the footing components together.

In the example model foundation as shown in FIG. 6, four corner footers 10 are used to form a square shaped foundation. However, other external footers such as straight external footers, opposite acting corner footers and the like could be used to construct different shaped foundation layouts for a building.

The footer pieces are preferably factory made to exact sizes, so that they can be easily handled and fitted together. They may be made in a mould or they may be cast in a mould.

Figure 4C:
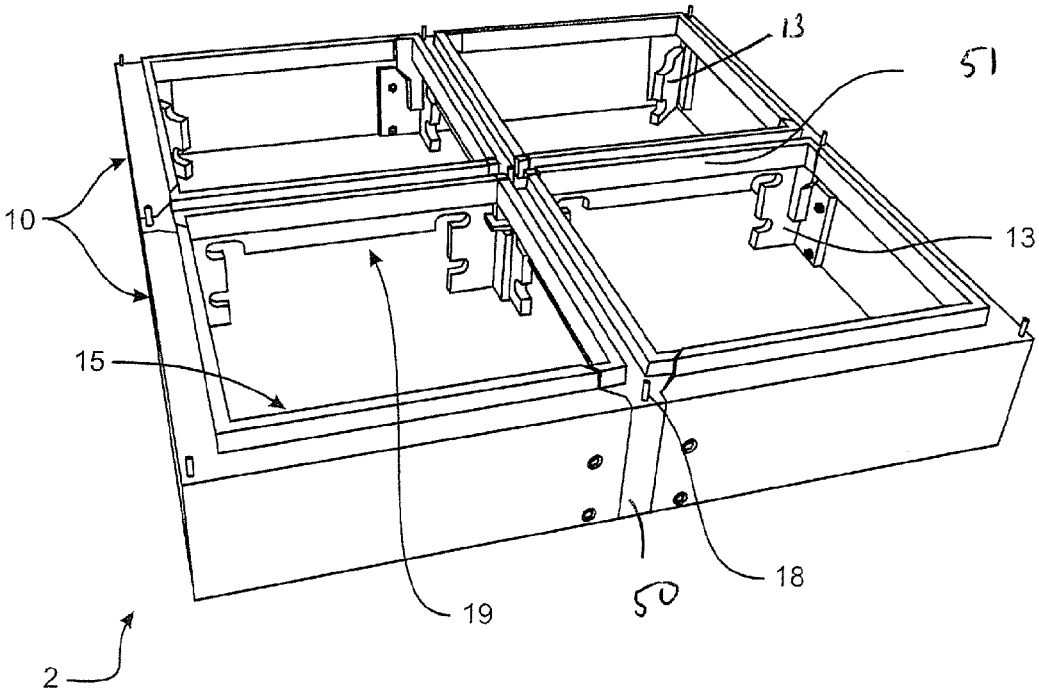
FIG. 4*c* shows footing constructed from four exterior corner footers and two double span internal footers.

The interface of joining footers allows substantial resistance to out of horizontal plane deformation of adjacent footers. This helps ensure that the footers remain fixed to each other and coplanar and a flat concrete floor slab can be poured. This is important from a building accuracy point of view. Additionally, the internal footers may also have a downwardly facing surface or lip 19 as shown in FIG. 4*c*, defining an undercut for the filler material to sit under the members. The filler, abutting the surface helps support the footer once the filler material is insitue.

The interface between adjacent footers and their connection via intermediate footer connectors to achieve resistance to deformation is achieved by having a sufficiently high I-value. E.g. by having a high footer wall height and/or vertically spread connection points of two connected footer components, to resist horizontal bending of two connected footers. Resistance to bending of two connected external footers in a lateral direction can be achieved by there being an internal footer extending from at or near the junction of the two external footers to as to create support thereat.

Figure 5:
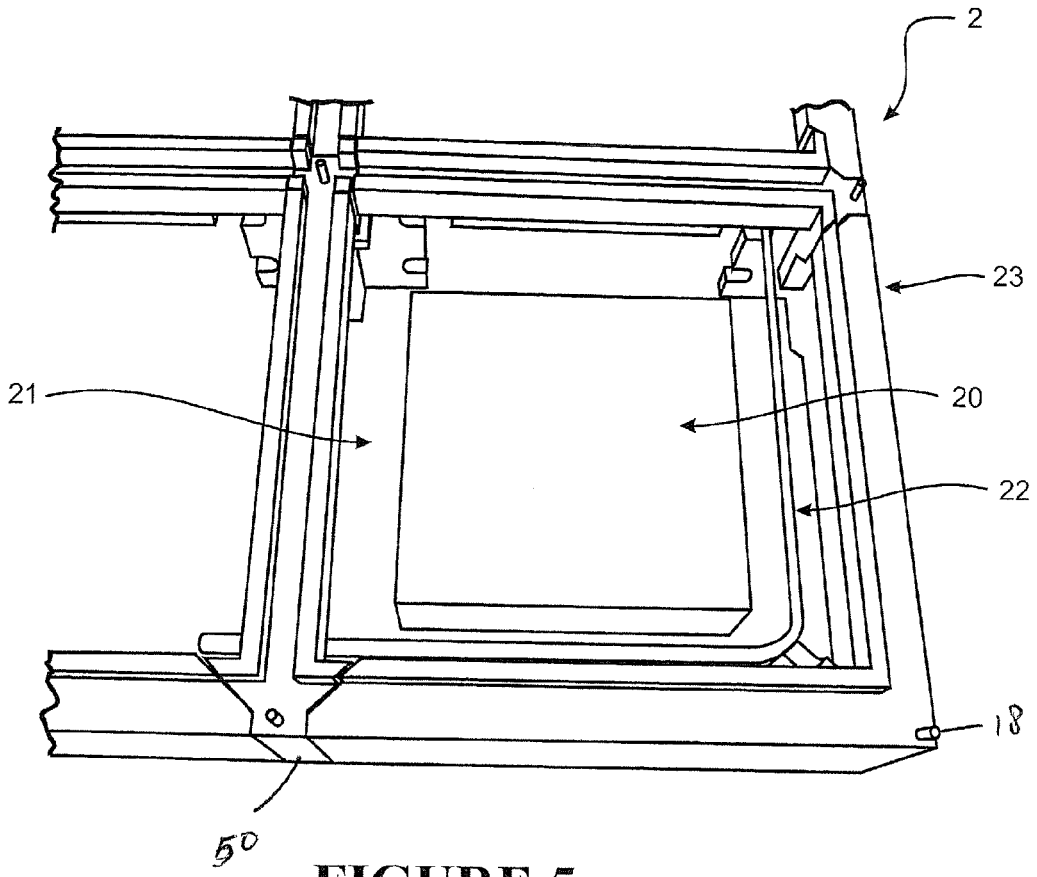
FIG. 5 is a close up view of the footing, showing reinforcement rods and spacing members for insulation and reducing concrete requirements.

Once the footing 2 is in place on supporting ground, such as is shown in FIG. 4*c*, spacers 20 may be placed in bay(s) or void(s) 21 created. In FIG. 5, only one spacer is shown in one bay. However, in the preferred embodiment of the present invention any appropriate number of spacers may be used in any number of bays in the footing assembly. Preferably all bays have at least one spacer in them. The spacers are preferably made from foam, polystyrene or any other appropriate material that will provide insulative properties. They also help reduce volume of the subsequent concrete pour.

Provision may be made for reinforcement or rebars. These may be supported by the footers for support and positioning during the concrete pour to become embedded in the concrete. Rebar hangers 13 may be carried by or from part of the footers. The hangers may include apertures or slots that are of a size and shape to receive reinforcement rods or rebars 22. The rods or rebars may be made from any appropriate material, for example, steel or glass fibre.

Once the footing is constructed, any spacers and reinforcement rods laid, a filler material may be poured. The top edge 23 of the footers forms the screed guide for the filler poured. The filler flows about the reinforcing rods, spacers and fills all the reaming spaces within the footing. Once the filler has set, the footers, rods and spacers remain as an integral part of the foundation 1.

In FIG. 6, a foundation is shown with one bay filled up to illustrate the level of the filler 24. In the preferred form the filler fills all voids forming a single integral base.

In the preferred form of the invention the filler is concrete, but other filler materials known in the art may be used. Examples include but are not limited to UHPC, Taktl™, GRFC, or plastic or other resins.

In the resulting foundation, the external footers form the perimeter of the foundation with the internal footers providing internal wall support and support to the external footers during construction of the foundation.

The perimeter footers also provide an exterior finish for the foundation as the filler material is fully enclosed and not visible to the outside.

The direct load from the walls and roofing that will be placed upon the foundation is taken by the footers. However, some or most of the weight loading will be transferred to the set filler material to the ground below. Preferably the footers are shaped and configured to have a lip 17 or undercut or space or similar for the filler material to flow under at least part of the footers. The undercut(s) allow for weight being borne on the footer to be at least partially transferred to the filler material.

At least one of the footers (and when used the footer connectors) present a fixture 18 for use in creating the above foundation structure.

Each fixture 18 may be cast into or secured to the footer or footer connector at a factory, precisely in location to accurate positioning such for subsequent alignment with wall panels. Such positioning is to ensure they are accurately spaced from each other and to correspond to the panels to be located on the footers.

The fixtures allow the connection thereto of a rod or cable 27 that is used in the subsequent construction process that will later be described in detail. The rod or cable may be directly connected to the fixture. Alternatively the connection may be indirect. Or alternatively, the rod or cable is already located with the footer or footer connector with or without the use of the fixture.

Each fixture in one form may be or include an anchoring bolt. The anchoring bolt may be a threaded upstand or stud to which a vertical tensioning cable or rod can be attached. Alternatively, the fixture may be barrel nut of the like having a threaded aperture, blind or otherwise into which a swaged fitting at the end of a tensioning cable of tensioning rod may be threaded.

Figure 7:
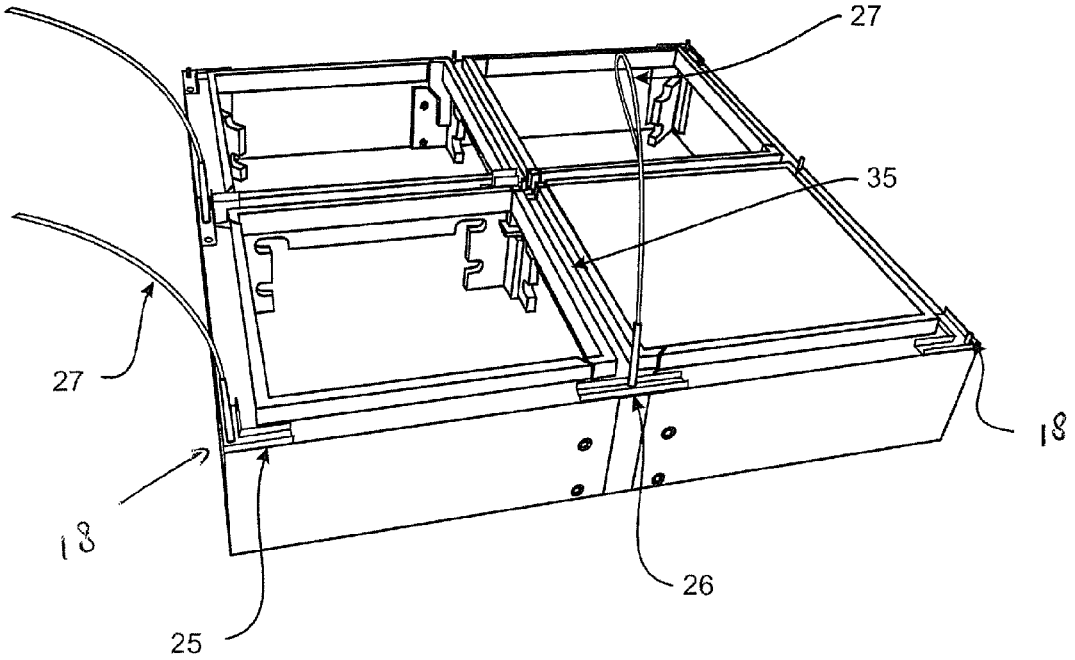
FIG. 7 shows the foundation of FIG. 6 with the addition of foundation fixture, where vertical tensioners are attached to each of the fixtures.
Figure 8:
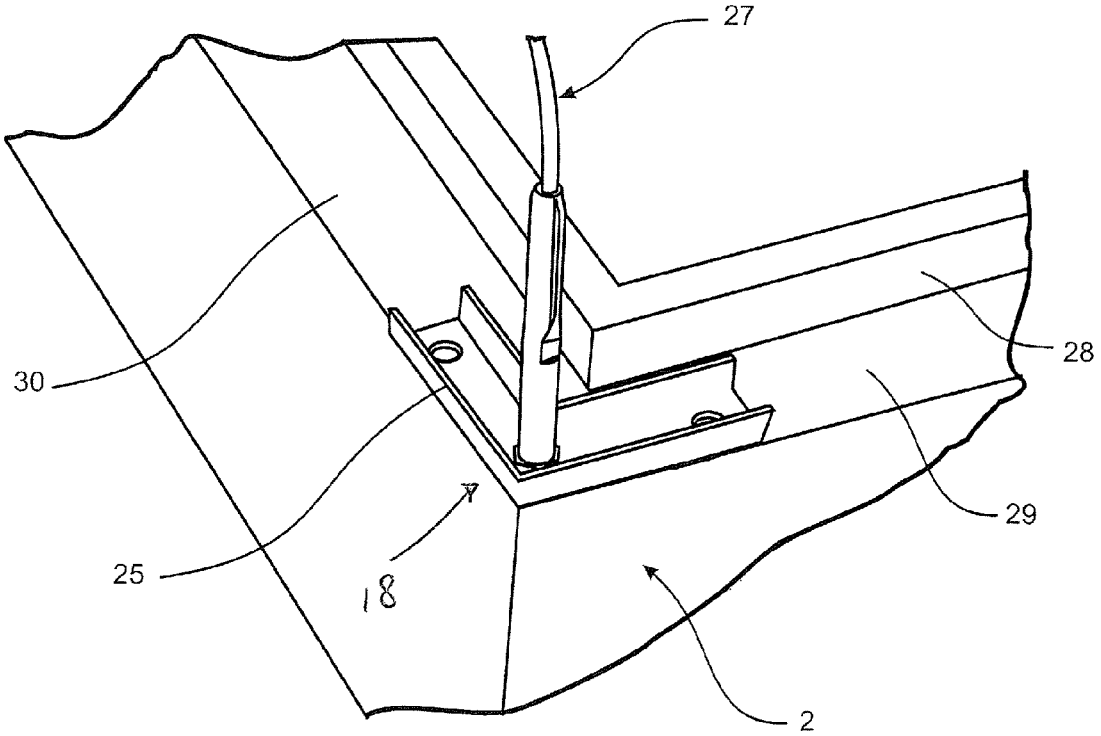

FIG. 7 shows the fixture being secured to the footer using brackets 25, 26. Shown are brackets 25 that are L shaped at 90 degrees, attached to the corners of the footing 2, and brackets 26 that are straight. Each of these brackets help secure the fixture to a footer in a defined location. These brackets may also have a purpose of helping to locate the wall panels that will be placed and fixed to the foundation and anchor tensioners that tension during location of the wall panels. The brackets 25, 26 preferably include a lip that can locate with a wall panel to position the wall panel.

A variation to what has been described to now with reference to FIGS. 1 to 9 will now be described with reference to FIGS. 20 to 29.

With reference to FIGS. 20 to 29 there is shown a variation of the foundation as described above. The foundation illustrated is still in a simplified form, substantially of a square plan.

With reference to FIG. 22 the footing 2 comprises of external corner footers 10, external straight footers 52 and internal footers 51. The footing 2 also includes footing connectors 50 which connect the external corner footers 10 together and/or to the external straight footers 52 as shown in FIG. 22. Where the footer connectors 50 connect internal footers 51 to external footers, the footing connector 50 may be integrally formed with the internal footer as shown in FIG. 24*a*. Where the footing connector 50 connects between, for example, an external corner footer 10 and a straight footer 52, the footer connector 50 may look like that shown in FIG. 26*b*.

The connectors 50 and the external footers preferably include locators 60 and 61 to help locate the footers with the connectors in a condition where they are desirably aligned.

The locators 60 and 61 may for example be a mortise and tenon like configuration or may be of a dowel pin or dovetail configuration. The dovetail configuration can allow for a vertical sliding between a connector and a footer to occur to locate the two together. The locators 60 and 61 help ensure correct alignment and positioning of the components of the footing. The use of a dovetail-like configuration may avoid the need for fasteners that have previously been described as being useful for connecting the footers together.

A top plate 63 of a connector as seen in FIG. 30 may have a dovetail-like zone 64 for location with a complimentary zone of an adjacent footer 10 or the like. This can help establish a connection between the adjacent components.

As can be seen with reference to FIG. 26*a* and FIG. 29, height adjustment feet 65 may be utilised for the purposes of levelling the footing during installation. The feet 65 may be threadingly adjustable relative to the connector and/or footer from which they are disposed. In the example shown in FIG. 29 the foot 65 is disposed from a connector 50 and is supported on the ground 66 on which the foundation is to be established. In situations where the ground is uneven a foot can be adjusted to thereby support the connector 50 and/or the footer until such time as the concrete pour has set whereupon the concrete will then assume the load bearing responsibility of the foundation and the footer on which the wall panels will be erected.

With reference to FIG. 29, the internal footer 51 preferably includes a service conduit 68 which allows for services such as power cables, data cables or the like and/or water and gas conduits to pass therethrough. This allows for a retrospective fitting of such utilities into the building. The conduit 68 through the internal footer may be set approximately 5 mm below the top surface to permit easy access from the floor by drilling through the top.

The conduit 68 of the internal footer 51 may be aligned with a similar vertically aligned conduit or passage in the walls once they are established. This can allow for data and power cables to pass up through the walls from the conduit 68.

Presented by and preferably protruding from preferably each connector is the fixture 18. The fixture 18 as shown with reference to FIG. 28 includes a barrel nut 69 that has an internal thread that may be threaded to L-shaped rod 70 that is supported by the connector 50. The L-shaped rod 70 is presented in a manner so as to become embedded in the concrete pour of the foundation. The leg 71 of the L-shaped member 70 is presented for becoming so embedded. This provides strong anchoring of the fixture 18.

The barrel nut 69 can be threaded to the L-shaped member or may be integrally formed therewith and is presented to allow for a cable or a rod 67 to be engaged therewith as for example shown in FIG. 29. It can be seen that the connector 50 and likewise the footers 10 and 52 have a profile that includes an undercut under which the concrete pour can run. This ensures that some concrete is located beneath the connectors and/or the footers 10 and 52 so that the concrete then provides some load bearing function for the structure to be built on a foundation.

It can be seen with reference to for example FIG. 26*a* that the footer seat region 75, compared to that of the earlier described embodiment, has a wedge shape profile. A wall placed on top of the seating region of the footers with a complimentary shaped bottom edge to be seated by the seating region, will help locate the wall panels on the footers. In particular once the wall panels are on and are being drawn against the footers by the tensioning cables or rods will force the wall panels against the lip 76 of the footers thereby facilitating in the creation of a close and proximate juxtaposition of the wall panels and the footers 10. An intermediate seal may be provided for helping create an adequately sealed interface between the footers 10 and the wall panels above. This ensures that the sloping angle and the tensioning pressures direct the wall components to fit snugly against the interior floor edge.

The footers are preferably made from an ultra high performance concrete (UHPC), such as Taktl™. However, they may be formed from wood, glass fibre reinforced concrete (GFRC) or other appropriate materials or may be made composite of various materials. The connectors may likewise be made from such materials or other.

The foundation may be placed on a level site, a sloping site, or a site that is a combination of sloping and level as shown in FIG. 58. Where the foundation is to be erected on a non-level site, conventional piles or screw piles may be used to support the foundation. Concrete may be poured or not. If not, floor panels 201 can be supported by the footers.

The footers on a non-level or sloping site may be supported by one or more of the following; beams 202 supported by the footers or anchors, or bearers, joists or piles built into the sloping site. The foundation may be stepped so that any water internal of the walls can drain to the exterior of the building, rather than onto the floor. This is achieved by the top outer edge of the footing, where the wall panels are mounted, comprising a rebate or ledge below the floor level. In the unlikely event water penetrates the panel joint; it falls to the bottom of the rebate to exit outside.

The foundation may be pre-fabricated in a factory, and then transported to the building site. However in the preferred form the footing may only be pre-fabricated in a factory, assembled onsite for the concrete or filler material to then be added on-site.

The footers once connected together are rigidly connected together and do not require additional bracing or support for when the concrete pour is received. The connections between external and internal footers creates a strong footing assembly that can resist, without deformation the hydraulic pressures of the concrete pour whilst it is curing. Internal footers can provide some bracing to the external footers. The footers can establish a gridded footing creating a plurality of cells.

In the preferred form the following steps to construct the foundation may be followed.

1. Optionally excavate the building site.
2. Level the building site to the required levels.
3. As necessary add crushed rock basecourse and compact to the conventional compaction standards.
4. Level the ground to the required heights.
5. Lay out the footing components and fix together to the designed building perimeter, and level using as necessary the optional screw footing height adjusters.
6. Optionally excavate around the footing for storm water drainage to the exterior of the building.
7. Optionally excavate to the footing for soil pipe/s, potable water, gas, electricity, communications cable to the exterior of the building.
8. Install waterproofing membrane within the building perimeter.
9. Add spacers in the center of each bay or void to provide insulation and minimize the concrete volume.
10. Place the reinforcing bar if needed.
11. Add a concrete pad reinforcing mesh if needed.
12. Pour the filler material (e.g. concrete), ensuring the filler is screeded flush with the and level to the top of the footers.

For elevated footings—(for sloping sites)

1. Establish the high datum level of the floor/s.
2. Trench along the line of the upper footing, or if partially at ground level; follow steps 1-11 to lay the first bay module as shown above
3. Locate and place piles as necessary to support the footing beams.
4. Connect and lock in the footing precast beams.
5. Tie together with post tensioned rods/wires.
6. Lay the floor panels on top.
7. Post tension together from the edges.

Modular Building

At the exterior perimeter of the foundation 1 there is defined a seat 30 to receive building wall panels. This is shown in one example in FIGS. 8 and 9.

The seat 30 may be defined by one or more of a protrusion, channel, slot, recess or relief lip, surface by one of each of the footer connectors and/or footers. Intermediate members may be located thereat, such as a seal strip or the like.

The lower edges of the exterior wall panels that are to be placed and fitted to the perimeter of the foundation 1 are of a complimentary shape to become adequately located to the seat at a respective seat. Such location is primarily by way of being clamped, as will herein after be described.

Figure 9:
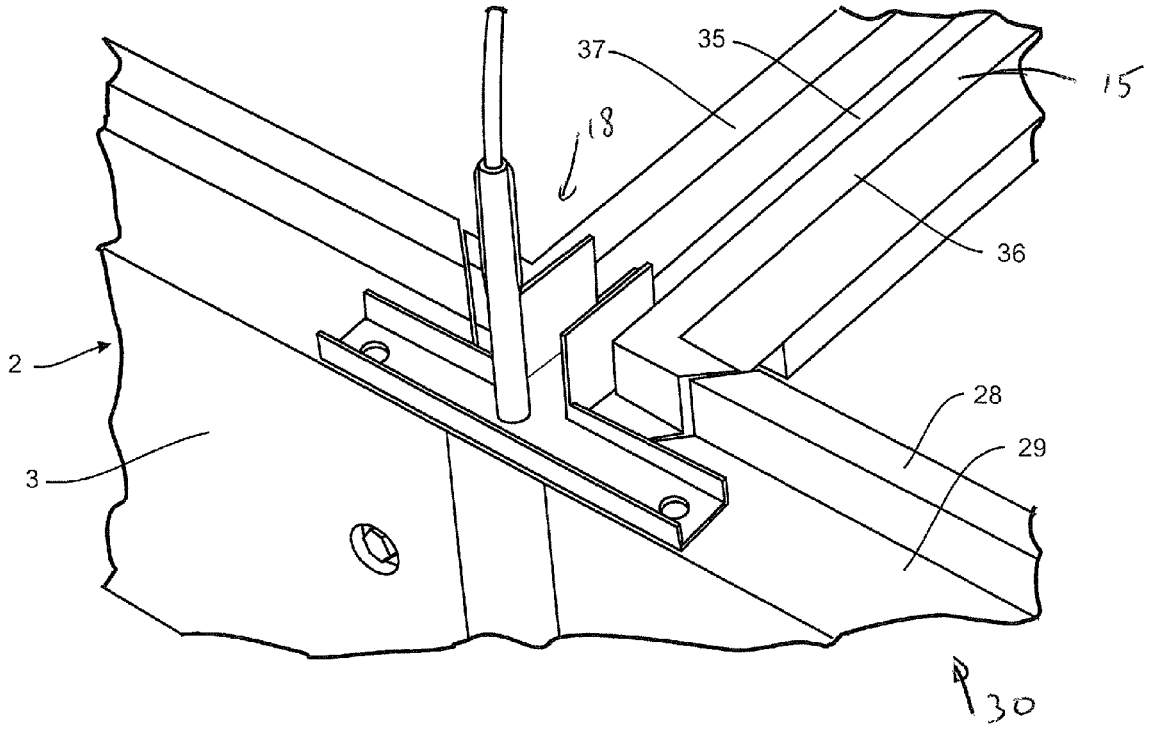

The perimeter footers have a seat of a kind that may include a flat surface 29 bounded to the building interior side thereof by a lip 28 as in FIG. 9. A wall panel can sit on top of the seat and against the lip 28. As will be later described, the wall panel may be pressed against such a lip during assembly of the building structure. The top of lip 28 is the finished floor level. With the wall panel seated in the rebate below the flat surface 29, there can be no water penetration to the floor or interior.

The internal footers may have a channel formation 35 formed in them to define the seat for the inner wall panels. The lips 36, 37 to the channel 35 extend to the screed surface 15 of the footing 2.

Figure 10:
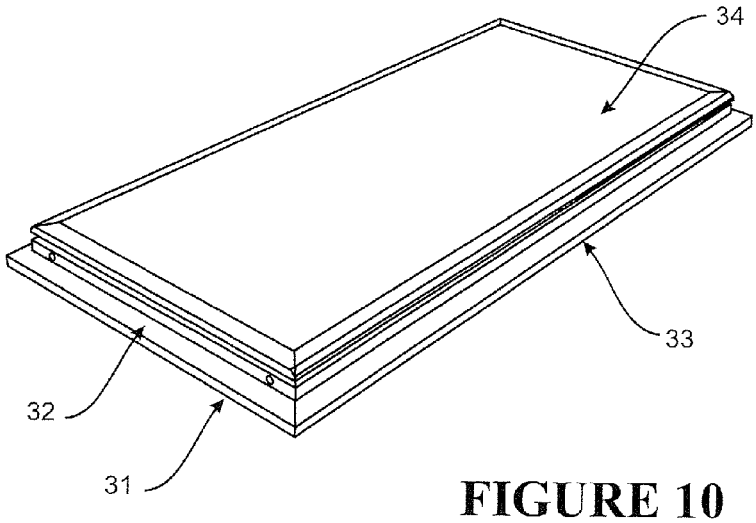
FIG. 10 shows an exterior wall panel.
Figure 11:
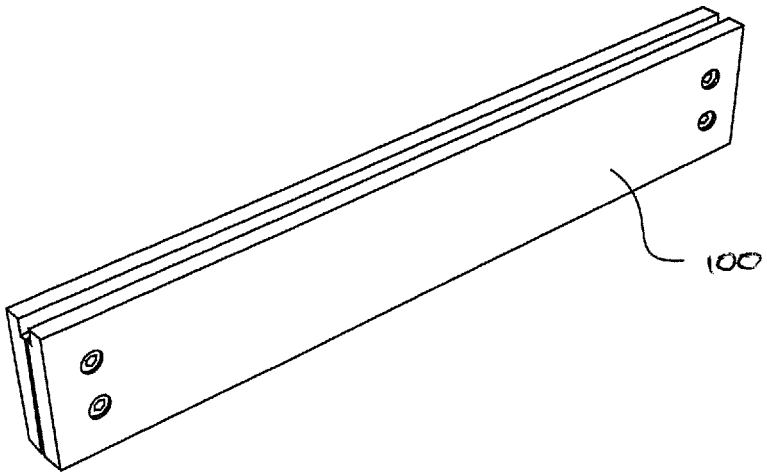
FIG. 11 shows a connecting beam for use to extend laterally between wall panels, to provide structural support.
Figure 12:
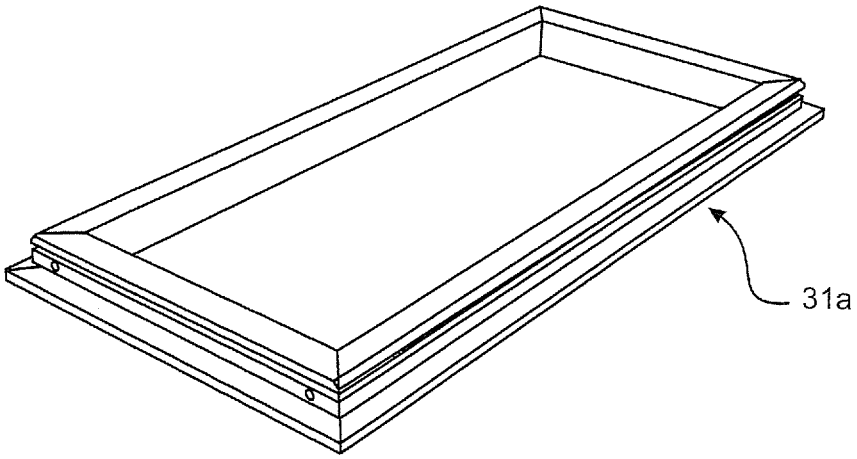
FIG. 12 shows an exterior panel for defining a passage (e.g. a door or window).

FIG. 10 shows an exterior wall panel 31. Preferably each panel is similar in configuration. FIG. 12 shows a frame wall panel 31*a* for defining a passage (e.g. a door or window).

A panel may have two parallel vertical edges 33 and two parallel horizontal edges. The panel 31 may be formed of laminated panels, or may be formed of in a single moulded material. A channel 32 may be formed around the perimeter of the panel. The external side 33*b* of the panel perimeter (the side of the panel that will form the outer wall of the building) preferably extends out further than the internal side 34 of the panel perimeter, forming a lip 33*a*, and at the base 31, overlaps the footing outer edge providing further weather proofing.

In alternative forms of the wall panels, the panels may be integrally moulded with (or without) a channel about their perimeter and having an external lip 33*a*.

When the panel is located on the footing seat, the lip 33*b* laps over the edge 3 of the external footing and the internal surface edge 34 of the panel abuts the lip 28. This helps provides weatherproofing and accurately locates the exterior walls in position. Additionally, an elongate seal may be placed within the channel 32 in the panel, to provide additional waterproofing.

With reference to FIGS. 29,26*a* and 26*c* the footer seat may include a wedge 75 to help drive the wall against the lip of the footer.

Figure 13:
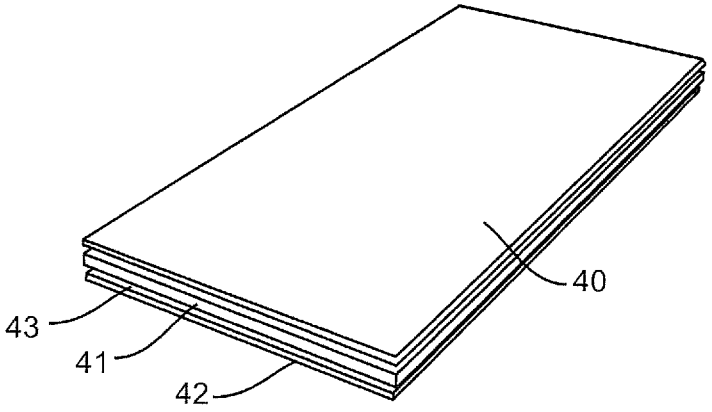
FIG. 13 shows an interior panel for room or area partitioning within the building.
Figure 14:
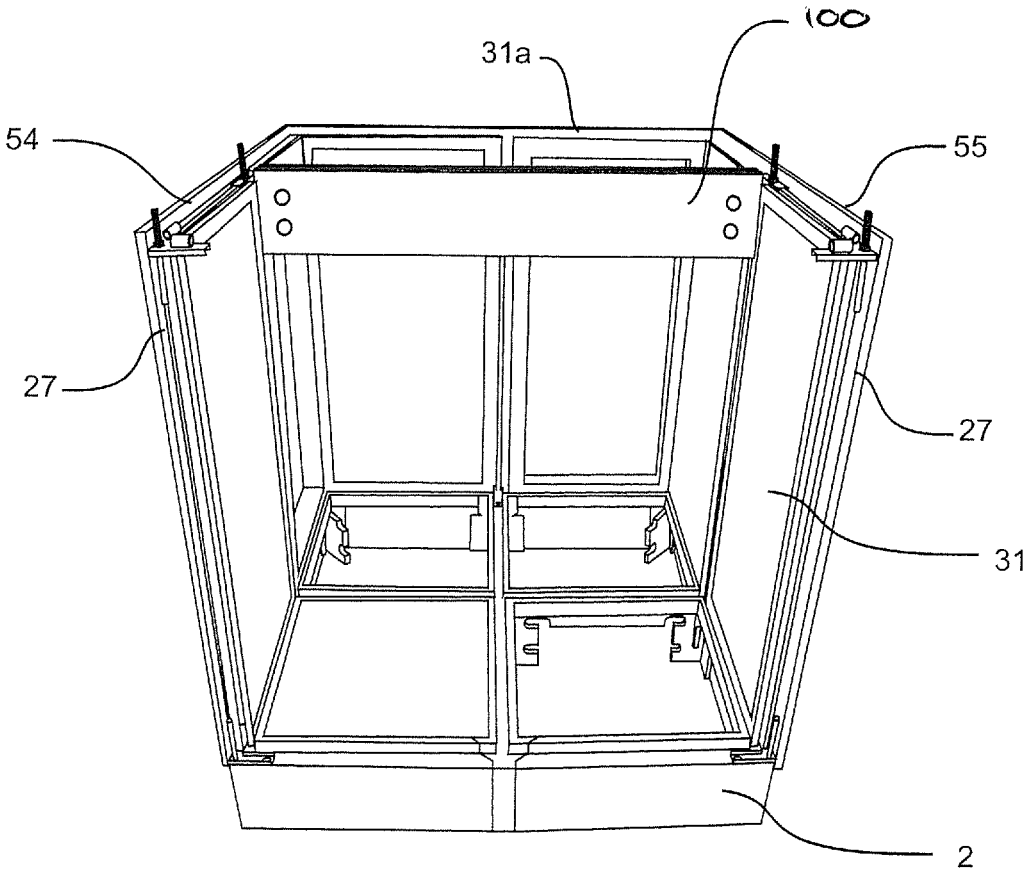
FIG. 14 shows an example of a partial building scale model built showing exterior wall panels and an internal beam extending across the building.

An interior wall panel is shown in FIG. 13, similar to the exterior wall panel, about the perimeter of the interior wall panels are formed two channels 41, 42. Preferably these extend completely about the perimeter of the panel. Between each channel is a projecting part 43 that fits into the channel 35 formed in the internal footers.

The channel 35 formed in the internal footer may in some forms be deep enough to take electrical wires, water and waste pipes for the buildings power and plumbing supplies. Alternatively or additionally, the channels 41, 42 formed in the interior wall panels 40 may take electrical wires, water or waste pipes.

The internal footers are structural members that can support the roof or upper level floor through the inner walls or partitions of the building.

It is preferred that all panels have identical edge detail and channels on all four sides, allowing optional rotation and location of the panels and formwork. For some panels, this will eliminate orientation errors. Additionally some of the channels may receive tensioners such as tensioning cables or rods. The channels may also receive rubber seals for dust and waterproofing.

The exterior edges of the panels may butt together as shown in FIG. 48 where two external wall panels 85 and 86 abut together at interface 87. The internal edges of two adjacent wall panels may be separated as seen in FIG. 48 and a cap or joiner or spaces 89 may be provided to bridge the gap. It may be configured to provide a passage 90 for cables etc. The cap 89 can be factory slotted, pre-cast or drilled or cut or similar to allow access to such cables for placement of light switches, power outlets etc.

Additional cladding, coating or trim 91 may be provided over the interface between adjacent panels on one level or between adjacent panels of two levels of the building structure.

At interfaces between corners located panels, the edges may be flush or also separated. As seen in FIG. 47, two external panels 31 abut each other but a cap 93 may be used to bridge the gap at their external faces.

The wall panels may include apertures for windows or doors. A panel may define an opening frame that may or may not be closed or closable by a door or window.

Figure 18:
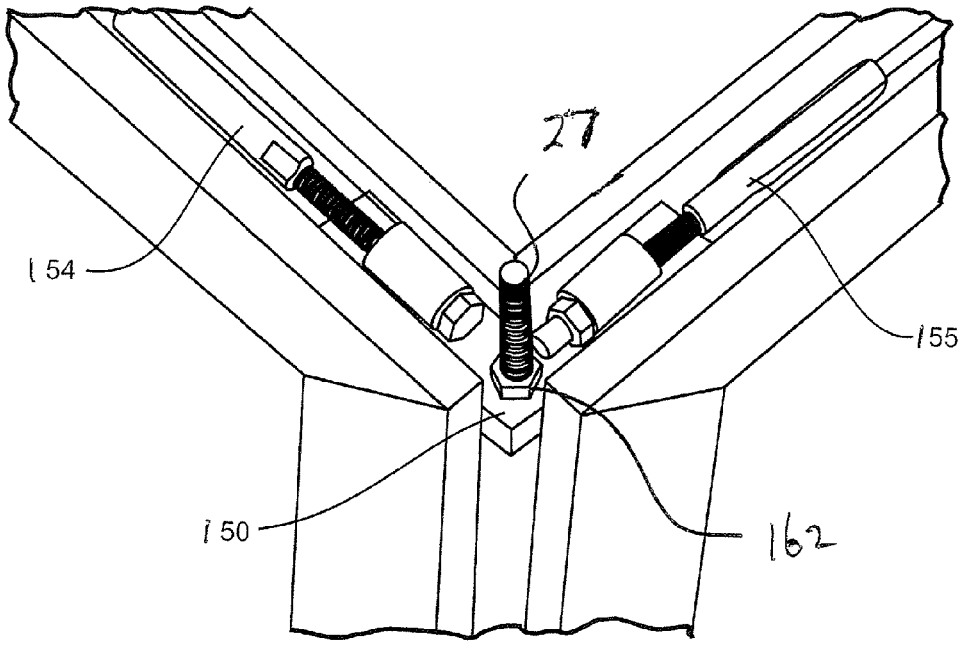
FIG. 18 is an alternative view of the anchor of FIG. 17.

Tensioners such as tensioning cables or rods are able to pass up between adjacent panels to or towards the top edge of the walls. At the top edge, the tensioners are able to secure to anchors such as anchor 150 that sit atop of the walls. Preferably the anchors sit in a recess at the top of the walls as seen in FIG. 18. The top of the panel is the logical place for the tensioners to be anchored given its a free surface at which a compression of the panel onto the seat at the footers can occur.

Figure 15:
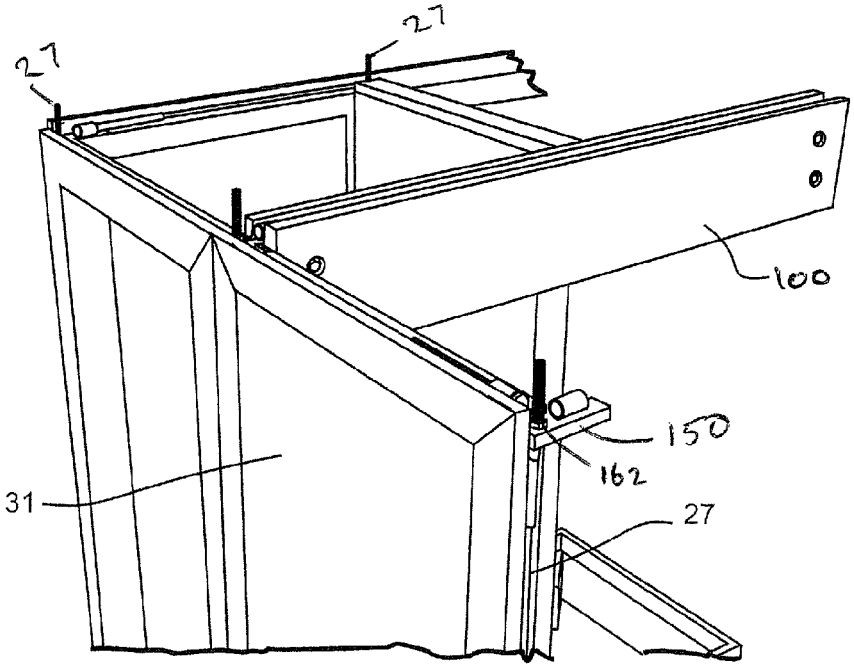
FIG. 15 shows a close up of the top of the panels of the building of FIG. 14, showing a tensioner protruding from the top of the panels.

The anchors receive the vertical tensioners as seen in FIG. 15 and locate these in manner so that they can be tensioned. This may be achieved by the tensioners passing through an aperture of the anchor 150 and having a nut 162 in which a threaded portion of the tensioner can locate to then be threadingly tightened up. Threaded connection may occur at the bottom or the top of the panels or both. Hence a tightening of the tensioner may be achieved at one or both of the top and bottom of the panel. Alternatively the tensioner may be made of multiple parts split between the top and bottom of the panel and a turnbuckle style adjustment of the tension may be achieved.

The tensioners are located intermediate of walls panels and where provided between floor or ceiling panels. They are located intermediate of such and obscured from view when the building is completed. This is may be by virtue of the panels having rebates at their edges that house the tensioners. The anchors also provided in a manner so at to be obscured from view.

With the anchor 150 resting on top of the panels and the tensioner being anchored at the fixture at the foundation, a compression force can be applied to the wall panels. This drives the wall panels into their seats below and by virtue of the location lips and/or friction, the wall panels become secured to the foundation. Lateral movement of a wall panel so secured relative the footer is very hard to achieve. Even more so when contiguous coplanar panels are so mounted and even more so when contiguous lateral wall panels are so mounted and even more so when a ceiling/floor/roof diaphragm is located at the top of the wall panels.

Anchors 150, 151 (see FIGS. 17, 18 and 19) are preferably provided for each of the corner junctions of wall panels, and intermediate of coplanar wall panels. The connectors preferably bridge across two contiguous panels.

Additionally, it is preferred that horizontal tensioners extend across at least two adjacent wall panels and are clamped preferably at the same anchors 150, 151, at adjacent joins or edges. Preferably such horizontal tensioners run along the entire perimeter of the structure. They may be secured to effect clamping at each adjacent panel interface or may be secured for clamping at spaced apart panels, e.g. at the ends of a multi-panel wall section.

Figure 17:
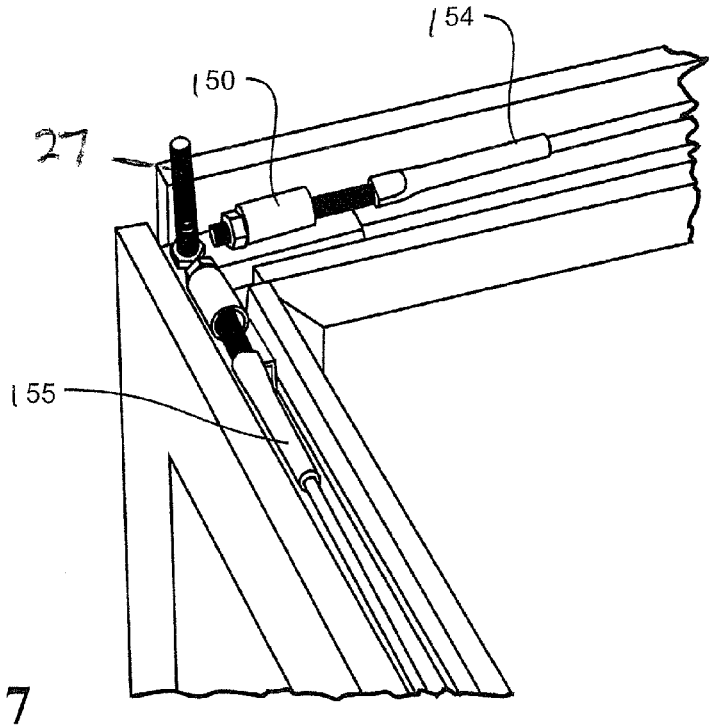
FIG. 17 shows a close up of a top edge of a building with a corner anchor that receives vertical and horizontal tensioners.

The tensioner anchor 150 as seen in FIG. 17 allows for the vertical and horizontal tensioners to be connected thereto and together. Horizontal tensioners 154 and 155 locate to the anchor 150 in a similar manner as the vertical tensioner 27. They may pass through an aperture and be captured to the anchor by a nut that can be threadingly adjusted to cause the tension in the horizontal tensioners to be increased. Other kinds of constructions enabling a threaded adjustment to be made for tensioning the tensioners will be possible.

In the preferred form the anchor that receives the vertical tensioner may also receive a or several horizontal tensioners as shown in FIGS. 49-50. However it is envisaged that separate anchors may connect with the vertical tensioners compared to the horizontal tensioners. However, for speed or assembly and for rigidity, it is the same anchor that connects to both vertical and horizontal tensioners at each panel interface. Features to allow the tensioners to extend at 90 or 180 degrees to each other are hence provided by the anchor.

In use, the vertical tensioning cables extend down each of vertical parallel edges of the wall panels, preferably in the channels formed in the edges, and the horizontal tensioning cables extending in, or adjacent similar channels in the horizontal edges of the wall panels.

Figure 16:
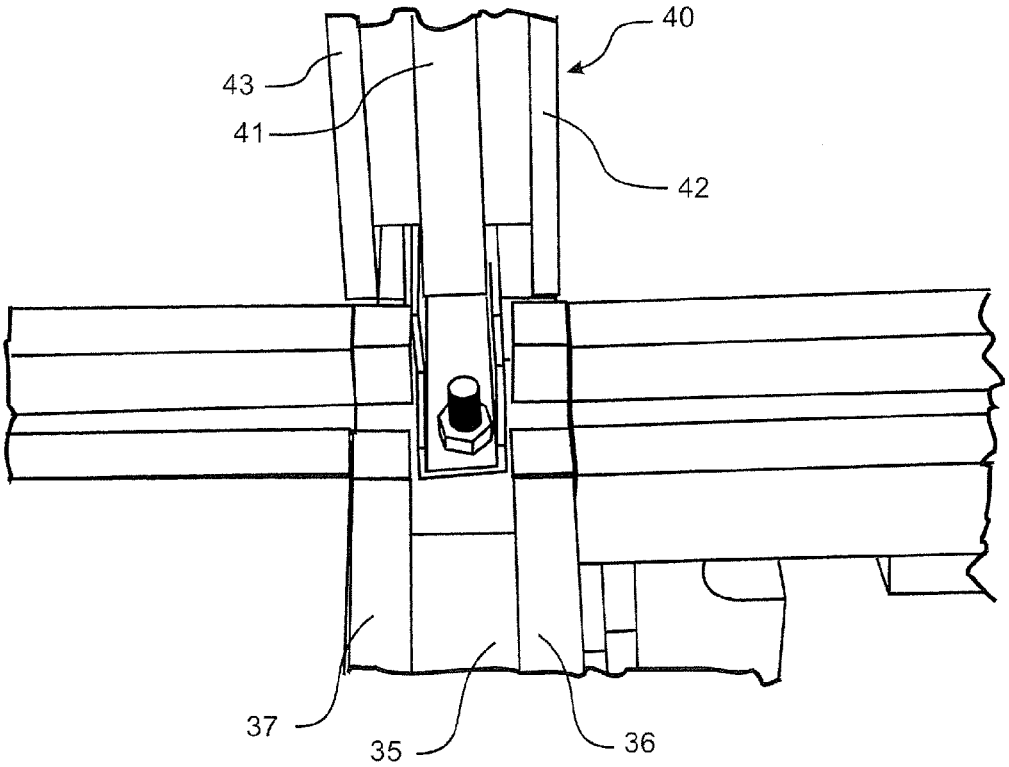
FIG. 16 shows a close up of the footing with a channel to receive the edges of each a wall.
Figure 19:
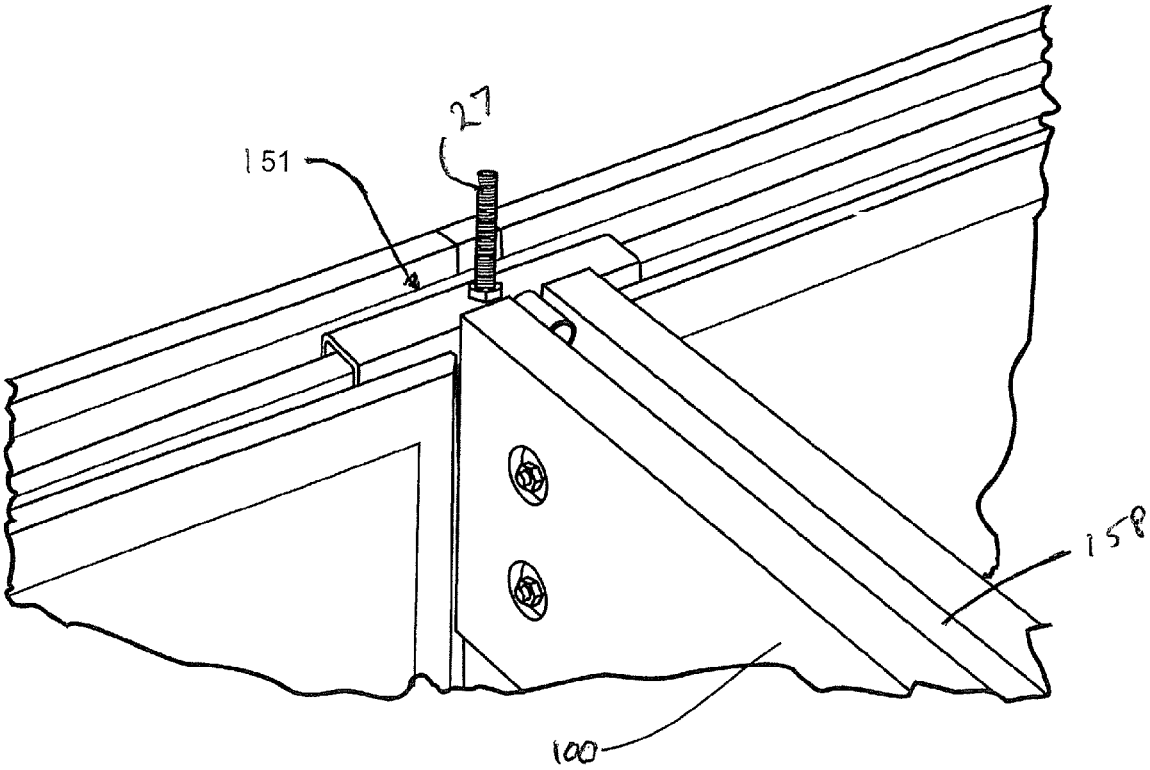
FIG. 19 shows a close up view of the internal beam and anchor, having received a vertical tensioner, the top of the cable ready to receive a roof or floor for the next level of the building, showing a groove in the beam that is capable of receiving a horizontal tensioner to engage the anchor.

If a support beam 100 is used between wall panels (as shown in FIGS. 16 and 19), a anchor 151 may be used to allow a tensioner to run along the beam 100. The anchor 151 can also support and locate the beam 100. The beam 100 may include a beam channel 158 (or hole) for such a tensioner to locate in and extend to a tensioner anchors at the other end of the tensioner.

In a preferred embodiment the anchor 151 can locate and support a beam 100 in multi-storey constructions also, as shown in FIGS. 51-56. The beam 100 can either support a roof, or floor depending on the construction. In single and multi-storey constructions the anchor 151 integrates the support and location of the beam 100 along with multiple apertures and features configured to integrate with the multiple tensioners (351 352 353 354 29).

It is preferred that the wall panels are formed from an ultra high performance concrete (UHPC), such as Taktl™. However, they may be formed from wood, glass fibre reinforced concrete (GFRC) or other appropriate materials. Furthermore, it is preferred that a core portion of the wall panels are polystyrene, or other similar materials, to provide for insulation, rigidity and weight saving.

To build the walls of a building the following steps may be followed.

1. Erect two exterior wall panels forming a corner, and connect the panels using an anchor 150 by dropping it the recess at the top of each panel to loosely hold the panels in position.
2. Continue to assemble the external panels, making up the external wall, and interior panels, making up the rooms inside the building, inserting connecting beams, and connectors as assembly progresses, as necessary.
3. Install the vertical tensioning cable or rod and loosely tension.
4. Install horizontal tensioning cables in the channels at the tops of the wall panels and loosely tension.
5. From each corner square and plumb each of the panels, then tension.
6. Progressively tension all cables; the result being a locked together integrated wall system and building.

The provision of the footers and their fixtures in a prefabricated manner and their ability to connect to each other so as to space the fixtures accurately as part of the foundation, provides for convenient subsequent erection of the wall panels. The accurate dimensioning of the fixtures position and the wall panels, means that the fixtures are going be accurately located so as to be able to extend between adjacent wall panels.

Along a multi-paneled wall section of the structure, a linear array of a plurality of fixtures are going to presented ensuring the wall is straight.

The wall structure is frameless and hence requires no extra structural posts as all compression and shear strength of a wall can be provided by the wall panels and associated tensioners. With the footings, walls and roof all connected in this overall fashion, the result is an integral structure of substantial strength and rigidity. The clamping forces exerted via the rods compresses the panels. This ensures they become snug with each other and the foundation. Any movement of the building (such as during a quake) causing the panels to move relative to each other in a manner reducing their snugness, is resisted. Any movement that may occur will result in the panels from becoming more snug with each other due to the bias that the clamping force exerts on each panel and the structure as a whole.

The Roof Construction

With reference to FIGS. 31 to 40 there is shown some slight variations to the construction of the walls and in addition how a roof may be established on the building structure. With reference to FIG. 36 there is shown horizontal tensioners 250 that extend across the tops of the external wall panels and lateral horizontal tensioners 251 that extend laterally from the external wall panels.

The lateral horizontal tensioners 251 may run across internal wall panels or may not run across internal wall panels but preferably intermediate of roof panels 252. Wall to roof anchors 253 are provided that connect the vertical tensioners 29 with the horizontal tensioners 250 and 251. A close up view of such an anchor is shown in FIG. 33.

FIG. 33 shows the anchor 253 with multiple holes for a lateral horizontal tensioner 251 to connect or fasten at/through. The lateral horizontal tensioner 251 can run, locate or be guided by a channel in the floor or roof panels.

In a preferred embodiment the top or bottom hole is used to connect a lateral horizontal tensioner 251 that runs across to an opposite wall. Horizontal tensioners running at right angles to theses horizontal tensioners do not interact with each other as the other of the top or bottom hole is used to fasten the lateral horizontal tensioner 251 running at right angles.

In some embodiments, the lateral horizontal tensioners 251 run in their own individual channel. In other embodiments the opposing (at right angles, or substantially thereto) lateral horizontal tensioners 251 may run in a similar opposing channel, and are kept separate from each other via use of the top and bottom fastening holes. In a less preferred embodiment, lateral horizontal tensioners 251 that cross paths can both use the top (or bottom) holes (or the anchor can only have one hole) and the lateral horizontal tensioners 251 are able to deflect around each other. This method allows for flexibility in the building process.

The anchor can receive a lateral horizontal tensioner 251 and a vertical tensioner 29 in a manner to allow for threaded adjustment of the tension as seen in FIG. 33 by the use of a nut that secures to a threaded portion of the tensioners. Turnbuckle style tensioning may be one of other ways of creating compression or the panel.

The horizontal tensioner 250 may likewise be secured to the anchor 253 or may alternatively pass therethrough for its tensioning to occur at another location remote from the anchor 253. Preferably tensioning occurs at the terminal end of the tensioners commensurate to the termination of the surface of the panel along which the tensioner runs.

The roof panels 252 locate preferably on top of the side walls as shown in FIG. 38. The tensioning of the tensioners forces the roof panel at the top of a wall panel against the wall panel. Preferably the forcing is in a horizontal direction where the roof panel is drawn against a vertical lip or other surface or surfaces of the wall panel or against such of the anchor as seen in the drawings, the anchor having been anchored relative the wall panel by virtue of the vertical tensioner acting on the anchor.

The roof panels may be pitched/sloped (not shown) for aesthetics and/or improved water run-off or increased interior space. In these cases a similar anchor to that of anchor 253 is used. However the sloped anchor will have a hole for a sloped roof panel tensioner to go through and fasten to. The hole will be at a similar angle to the slope/pitch. The anchor can still have horizontal holes for lateral horizontal tensioners of a level ceiling inside.

Extending from an upper surface or other surface of the roof 252 is a transitional cap or bridge incorporating drainage for rain water or other precipitation that may be collected on the roof for directing this to a gutter 270 as shown in FIGS. 32, 38-40. The gutter 270 locates over the top end 271 of the wall panel 31 so that rain water cannot penetrate between the roof panel 252 and the wall panel 31. Preferably the guttering 270 will nest or interlock with the roof panel 252 for ease of construction and waterproofness. Silicon sealer or other appropriate sealers may be used to seal any edges or joins for optimum waterproof qualities.

As will be appreciated, the roof as herein described can be a ceiling/floor for a multi storey construction instead of a roof. The roof panel, instead offering floor and/or ceiling functionality between floors of the building.

Multi-Storey Construction

With reference to FIG. 42 there is shown a multi-storey construction of a building utilising aspects of the present invention. The construction on the top of the first level is similar to that which has been described prior, including installation of a floor at the top of the first level (rather than a roof as what has herein been previously described). One of the differences however at the interface between levels is the use of a different anchor 350. The anchor 350 provided at the interface of the wall panels 31 of one level and of wall panels 331 of the next level and floor/roof panel 252, allows a connection of tensioners for both levels.

As can be seen with reference to FIG. 43, the anchor 350 locates and/or engages for tensioning the,

- lower wall tensioners 351 (horizontal tensioners 250) located at the top of the lower walls 31, and
- vertical tensioners 29 extending between the foundation and the top of the lower level walls 31, and
- lateral horizontal tensioners 352 (251) that run coplanar and along edges of flooring 332, and
- vertical tensioners 354 that are provided for compressing the wall panels of the level above.

Horizontal tensioners 353 may run along the lower edge of the wall panels of a level above may pass through the anchor 350 or may also be anchored thereto. The anchor shown in more detail in FIGS. 49-50 preferably terminates the vertical tensioners 29 rather than such passing through the anchor 350 to the next level.

Likewise the vertical tensioner 354 for the next level up is terminated at the anchor 350 to allow for independent tensioning of the vertical tensioner 29 below.

Preferably the horizontal tensioners 351 and 353 pass through the anchor 350 and are terminated at the terminal ends which correspond to the terminal ends of the wall along which such a tensioner runs.

The tensioners used to tension the building and hold the panels together are preferably rod. Preferably it is a metal rod such as a stainless steel rod. But a stainless steel 1/19 wire with swaged threaded fittings at each end may also be used. Other appropriate materials may be used, such a rope, chain, or similar.

At the interface between a wall panel of the lower level such as the wall panel 31 and a wall panel 331 of an upper more level as shown in FIG. 46, a flashing 360 may be provided for the purposes of draining any water on the interior side of the external face of the two-storey wall to direct any such water flow outwardly of the building envelope.

It is preferred that the wall panels are first drawn onto to the foundation, while the roof panels and/or other levels above can be locked down later as a separate operation.

The above described system and components can be factory made. This helps ensure accuracy for the foundation through to the roof or upper level(s) for assembly of the complete structure. The system includes the foundation and hence provides for accuracy and continuity from start to finish of a building in accordance with that described above. Yet the system and components of the present invention encourages design flexibility to enable creative architecture.

A building constructed in accordance to that described above can be rapidly and accurately assembled on site. Each component can be handled by two to four people, eliminating the need for cranes or powered lifting devices for single level structures. As such erection of a building according to the present invention can be by an un-skilled labourer, as no drilling or cutting is required, only assembly of the parts.

Additionally, any size or proportion of a building can be readily accommodated. Thus, this system can be utilized for many building types, for example, single residential, multi-residential, schools, halls, etc.

The connection system is self supporting and the final structure/building is post tensioned, ensuring all components are locked together. As such the building is seismic tolerant.

The structure can also be rapidly broken down as panels and many other components are not bonded together.

Finally, the system of the present invention provides for flexibility for electrical and plumbing installation services.

The components are for the total build, including the footing, to ensure continuity and accuracy is maintained throughout the build.

Floor, walls and roof are positioned and held in place with bracket connectors that once the component parts are in place, take tensioners for post tensioning vertically and horizontally. This ensures a "locked in" comprehensive and cohesive structure.

The invention claimed is:

1. A building comprising:

a foundation comprising a plurality of prefabricated modular footers having been assembled in-situ at a building site to form a footing, at least two of the footers of the footing each presenting at least one pre-fabricated, pre-positioned foundation anchor to collectively present along said footing at least three spaced apart foundation anchors, a wall seated on said footing and comprising:

a plurality of upstanding, juxtaposed, in-line pre-fabricated wall panels tied together and to said foundation by orthogonal tensioners comprising:

a. at each end of the wall, a vertical tensioner located parallel an adjacent wall end panel and fixed by and extending from a said foundation anchor to a respective wall end anchor positioned to act at or near the top of the adjacent wall end panel to bind the adjacent wall end panel by said vertical tensioner with the footing, b. a horizontal tensioner extending between said end anchors at each end of the wall to horizontally bind all the wall panels of the wall together, and c. an intermediate vertical tensioner intermediate of and parallel to two adjacent wall panels of said wall fixed by and extending from a said foundation anchor located mid wall to an intermediate end anchor positioned to act at or near the top of the two adjacent wall panels to bind the two adjacent wall panels by said intermediate vertical tensioner with said footing, wherein the pre-fabricated modular footers are adapted and configured to be connectively assembled in-situ to present the pre-positioned foundation anchors in locations (i) at each end of the wall, adjacent said wall end panels and (ii) intermediate of two adjacent wall panels of said wall.

2. The building as claimed in claim 1 wherein said horizontal tensioner extends from and only acts directly on the wall end anchors to bind all wall panels in the wall horizontally together.

3. The building as claimed in claim 1 wherein a lateral wall section extends from said first mentioned wall, said lateral wall section comprising of a lateral wall panel located contiguous a said wall end panel of the first mentioned wall, the vertical tensioner at the end of the first mentioned wall located between the lateral wall panel and the wall end panel, its respective foundation anchor located also adjacent the lateral wall panel.

4. The building as claimed in claim 3 wherein a lateral wall section horizontal tensioner extends from said respective wall end anchor to a further end anchor, the lateral wall section horizontal tensioner and the first mentioned horizontal tensioners able to cooperate together to bind the lateral wall section and the first mentioned wall horizontally together.

5. The building as claimed in claim 1 wherein a ceiling or roof comprising of a row of contiguous cover panels is at least partially supported by and at the top of at least some of the wall panels.

6. The building as claimed in claim 5 wherein the intermediate end anchor(s) anchor cover panel tensioners that extend horizontally between adjacent cover panels.

7. The building as claimed in claim 5 wherein cover panel tensioners extend between adjacent cover panels from an intermediate end anchor of said first mentioned wall to an intermediate end anchor of another like wall.

8. The building as claimed in claim 1 that has a second storey located above the wall panels, the second storey comprising of a plurality of second storey wall panels supported above and by the first mentioned wall panels.

9. The building as claimed in claim 1 wherein the anchors presented by said footing are spaced apart from each other at predefined identical spaced intervals.

10. The building as claimed in claim 1 wherein the footers are each shaped and adapted to allow and interlocking together with a said wall panel.

11. The building as claimed in claim 1 wherein footers present a seat, the seat includes a lip laterally against which a wall panel can register and a lower surface on top of which a said wall panel can register.

12. The building as claimed in claim 11 wherein the lower surface is outward of the building more than the lip.

13. A modular building structure comprising:

(a) a foundation comprising a plurality of prefabricated footers assembled together on site to define a footing and each including a pre-positioned, pre-fabricated foundation anchor spaced apart along said footing, (b) a plurality of abutting transverse wall sections, each wall section comprising of a linear array of adjacent abutting pre-fabricated wall panels, each seated at a seat on the footing and each having a vertical edge located at a said pre-positioned foundation anchor, (c) a plurality of vertical tensioners upwardly extending from the prepositioned foundation anchors to an upper wall anchoring location allowing them to compress the wall panels against the foundation to bind them onto the seat, (d) extending at the top of each wall section and parallel thereto, a horizontal tensioner terminating with a like located horizontal tensioner of an abutting wall section at an anchor to together bind said abutting wall sections horizontally together and bind the wall panels of their respective wall sections horizontally together, wherein the pre-fabricated footers are adapted and configured to present the pre-positioned foundation anchors in locations (i) at each end of a said wall section, adjacent wall end panels of said wall section and (ii) intermediate of two adjacent wall panels of a said wall section and (iii) intermediate of two abutting wall panels of abutting transverse wall sections.

14. A modular building system to create a building at a building site, said system comprising:

a. prefabricated footers each able to be connected together in a modular manner to create a continuous footing, each footer comprising at least one prepositioned foundation anchor, said prefabricated footers to be rigidly connected together to define a footing on site to create a building foundation supported by ground below and present said anchors in regularly spaced apart positions along said footing, b. a plurality of prefabricated wall panels of a fixed width to be supported on said footers in a manner such that said foundation anchors are positioned adjacent each said wall panel and anchored by a tensioner at one end to said footers and at or near a top of each wall panel, c. a plurality of adjustable vertical tensioners to each be secured at one end to a respective foundation anchor and at an opposite end to a respective upper anchor at or near the top of each wall panel to vertically draw the wall panels onto said footer, and d. a plurality of horizontal tensioners to each be extended between two upper anchors at the top of two or more in-line wall panels to bind the two or more in-line wall panels horizontally together, wherein the pre-fabricated footers are adapted and configured to present the pre-positioned foundation anchors in locations (i) at each end a wall section comprising of a plurality of in-line wall panels, adjacent wall end wall panels and (ii) intermediate of two adjacent wall panels of said wall section.

* * * * *